US007207302B2

(12) United States Patent
Williams et al.

(10) Patent No.: US 7,207,302 B2
(45) Date of Patent: Apr. 24, 2007

(54) VALVE LIFTER BODY

(75) Inventors: Carroll Williams, Pocahontas, AR (US); Dhruva Mandal, Vernon Hills, IL (US)

(73) Assignee: MacLean-Fogg Company, Mundelein, IL (US)

( * ) Notice: Subject to any disclaimer, the term of this patent is extended or adjusted under 35 U.S.C. 154(b) by 0 days.

(21) Appl. No.: 11/355,223

(22) Filed: Feb. 15, 2006

(65) Prior Publication Data

US 2006/0130795 A1 Jun. 22, 2006

Related U.S. Application Data

(63) Continuation of application No. 10/316,263, filed on Oct. 18, 2002.

(51) Int. Cl.
*F01L 1/14* (2006.01)

(52) U.S. Cl. ..... 123/90.48; 123/90.61; 123/90.52; 29/888.03

(58) Field of Classification Search ..... 123/90.48, 123/90.61, 90.52; 29/888.03
See application file for complete search history.

(56) References Cited

U.S. PATENT DOCUMENTS 4,741,298 A * 5/1988 Rhoads ..... 123/90.5

OTHER PUBLICATIONS

Labeled IDS 02716.*
Prints, Apr. 11, 1989, 02170.
Drawing depicting leakdown plunger, Jan. 10, 1984, 02439.
Drawing depicting leakdown plunger in dye block, Oct. 29, 1985, 02471.
Drawing depicting grain flow, Jun. 19, 1985, 02485.
Drawing depicting leakdown plunger, Oct. 3, 1986, 02505.
Print predating Oct. 18, 2002, 02509.
Print predating Oct. 18, 2002, 02519.
Print, Apr. 3, 1989, 02768.
Prints, Jun. 19, 1987, 02795-02796.
Drawing depicting leakdown plunger predating Oct. 18, 2002, 03213.
Drawing, Jan. 8, 1985, 03759.
Drawings predating Oct. 18, 2002, 03791-03794.
Print predating Oct. 18, 2002, 03795.
Drawing predating Oct. 18, 2002, 03808.
Drawings predating Oct. 18, 2002, 03811-03812.
Drawings predating Oct. 18, 2002, 03813-03814.
Drawings predating Oct. 18, 2002, 03815-03817.
Drawing predating Oct. 18, 2002, 03837.
Drawing predating Oct. 18, 2002, 03838.
Drawings predating Oct. 18, 2002, 03853-03858.
Drawing predating Oct. 18, 2002, 03930.
Drawing predating Oct. 18, 2002, 03932.
Print showing leakdown plunger predating Oct. 18, 2002, 03934.
Drawing showing leakdown plunger and tooling predating Oct. 18, 2002, 03959.
Print, Sep. 9, 1984 and Technical Documetns 02816, 01505-01508.
Drawing predating Oct. 18, 2002, 03100.
Drawing predating Oct. 18, 2002, 03748.

* cited by examiner

*Primary Examiner*—Thomas Denion
*Assistant Examiner*—Zelalem Eshete
(74) *Attorney, Agent, or Firm*—Dana Andrew Alden

(57) ABSTRACT

The present invention relates to a valve lifter body, comprising an outer surface, enclosing a first cavity and a second cavity, wherein the first cavity includes a first inner surface configured to house a cylindrical insert, the second cavity includes a second inner surface cylindrically shaped, and at least one of the cavities is fabricated through forging.

8 Claims, 66 Drawing Sheets

VALVE LIFTER BODY

This application is a continuation of application Ser. No. 10/316,263, filed Oct. 18, 2002, the disclosure of which is hereby incorporated herein by reference.

FIELD OF THE INVENTION

This invention relates to bodies for valve lifters, and particularly to valve lifters used in combustion engines.

BACKGROUND OF THE INVENTION

Valve lifter bodies are known in the art and are used in camshaft internal combustion engines. Valve lifter bodies open and close valves that regulate fuel and air intake. As noted in U.S. Pat. No. 6,328,009 to Brothers, the disclosure of which is hereby incorporated herein by reference, valve lifters are typically fabricated through machining. Col. 8, 11. 1–3. However, machining is inefficient, resulting in increased labor and decreased production.

The present invention is directed to overcoming this and other disadvantages inherent in prior-art lifter bodies.

SUMMARY OF THE INVENTION

The scope of the present invention is defined solely by the appended claims, and is not affected to any degree by the statements within this summary. Briefly stated, a valve lifter body, comprising an outer surface, enclosing a first cavity and a second cavity, wherein the first cavity includes a first inner surface configured to house a cylindrical insert, the second cavity includes a second inner surface cylindrically shaped, and at least one of the cavities is fabricated through forging.

BRIEF DESCRIPTION OF THE DRAWINGS

FIG. 57-*b* depicts the top view of a preferred embodiment of a roller follower body.

DETAILED DESCRIPTION OF THE PRESENTLY PREFERRED EMBODIMENTS

Figure 1:
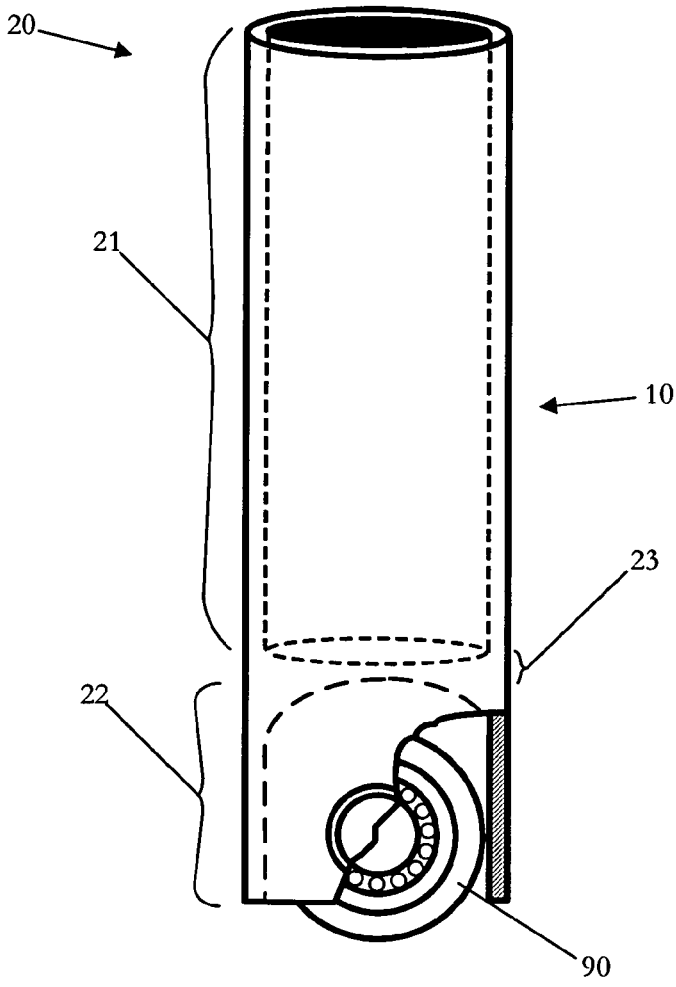
FIG. 1 depicts a preferred embodiment of a valve lifter body.
Figure 2:
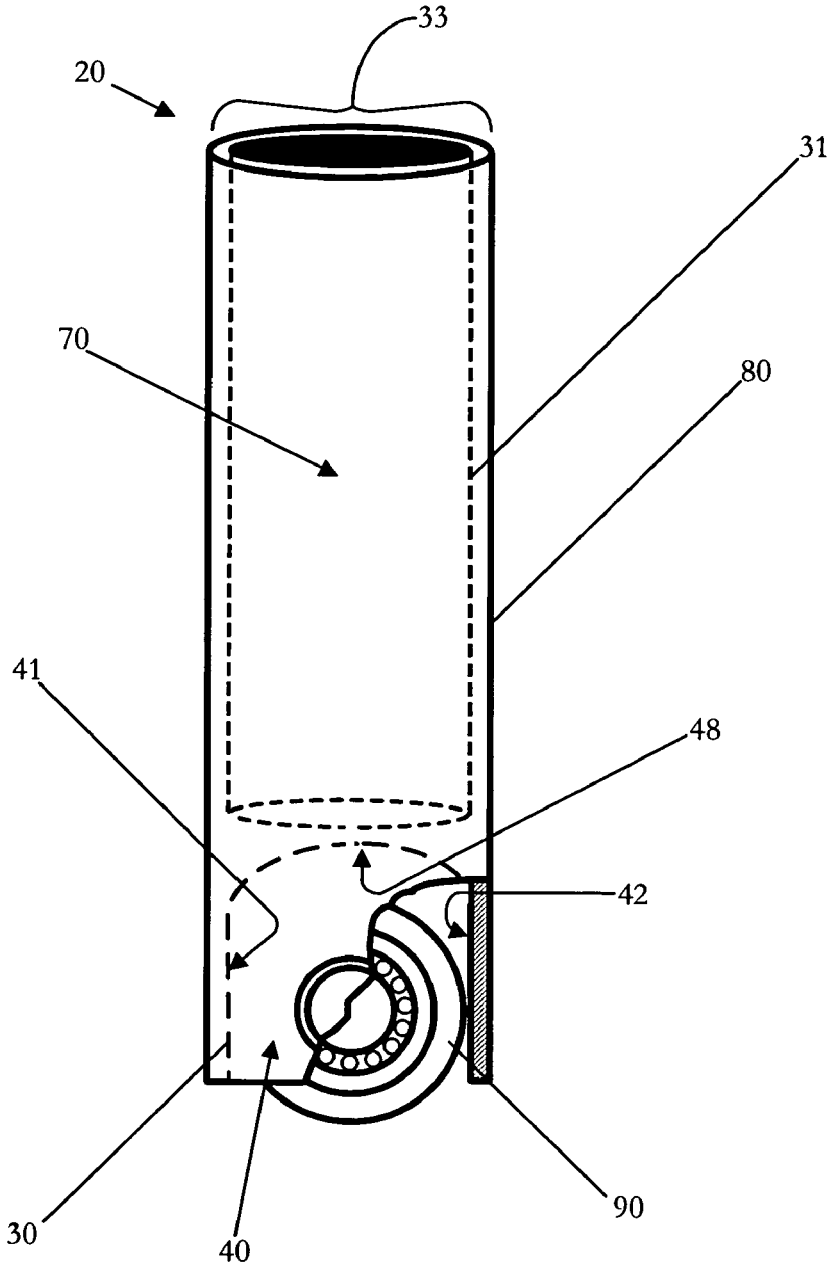
FIG. 2 depicts a preferred embodiment of a valve lifter body.
Figure 3:
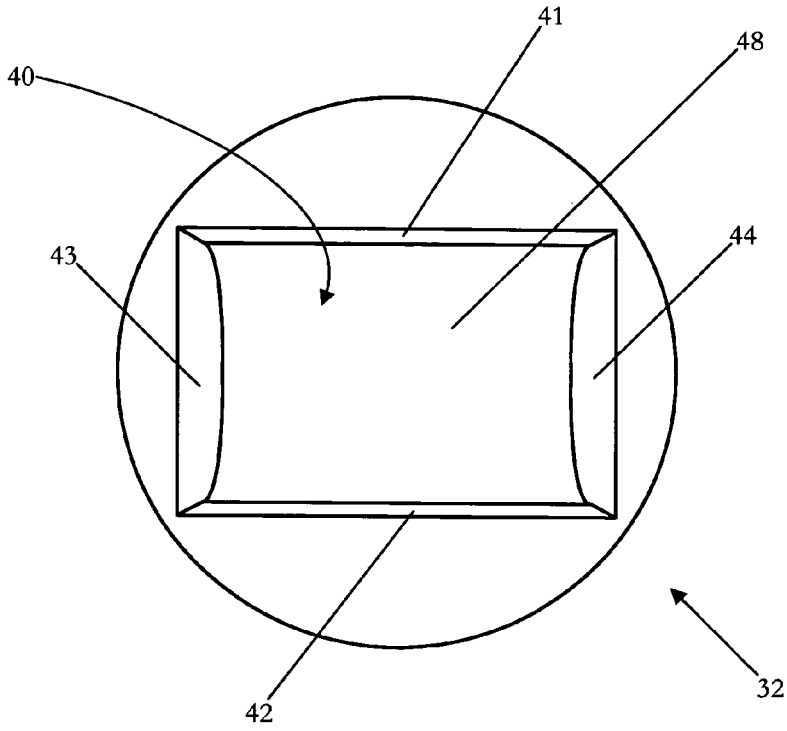
FIG. 3 depicts the top view of a preferred embodiment of a valve lifter body.

Turning now to the drawings, FIGS. 1, 2, and 3 show a valve lifter body 10 of the preferred embodiment of the present invention. The valve lifter 10 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the valve lifter 10 is composed of pearlitic material. According to still another aspect of the present invention, the valve lifter 10 is composed of austenitic material. According to another aspect of the present invention, the metal is a ferritic material.

The body 20 is composed of a plurality of shaft elements. According to one aspect of the present invention, the shaft element is cylindrical in shape. According to another aspect of the present invention, the shaft element is conical in shape. According to yet another aspect of the present invention, the shaft element is solid. According to still another aspect of the present invention, the shaft element is hollow.

FIG. 1 depicts a cross-sectional view of the valve lifter body 10 of the preferred embodiment of the present invention composed of a plurality of shaft elements. FIG. 1 shows the body, generally designated 20, with a roller 90. The body 20 of the preferred embodiment is fabricated from a single piece of metal wire or rod and is described herein as a plurality of shaft elements. The body 20 includes a first hollow shaft element 21, a second hollow shaft element 22, and a solid shaft element 23. In the preferred embodiment, the solid shaft element 23 is located between the first hollow shaft element 21 and the second hollow shaft element 22.

The body 20 functions to accommodate a plurality of inserts. According to one aspect of the present invention, the body 20 accommodates a lash adjuster such as that disclosed in "Lash Adjuster Body," application Ser. No. 10/316,264, filed on Oct. 18, 2002, a copy of which is attached hereto, the disclosure of which is hereby incorporated herein by reference. In an alternative embodiment, the body 20 accommodates the lash adjuster body 110. According to another aspect of the present invention, the body 20 accommodates a leakdown plunger, such as that disclosed in "Leakdown Plunger," application Ser. No. 10/274,519, filed on Oct. 18, 2002, a copy of which is attached hereto, the disclosure of which is hereby incorporated herein by reference. In the preferred embodiment, the body 20 accommodates the leakdown plunger 210. According to another aspect of the present invention, the body 20 accommodates a push rod seat (not shown). According to yet another aspect of the present invention, the body 20 accommodates a metering socket such as that disclosed in "Metering Socket," application Ser. No. 10/316,262, filed on Oct. 18, 2002, a copy of which is attached hereto, the disclosure of which is hereby incorporated herein by reference. In the preferred embodiment, the body 20 accommodates the socket 310.

The body 20 is provided with a plurality of outer surfaces and inner surfaces. FIG. 2 depicts a cross-sectional view of the valve lifter body 10 of the preferred embodiment of the present invention. As shown in FIG. 2, the body 20 is provided with an outer surface 80 which is cylindrically shaped. The outer surface 80 encloses a plurality of cavities. As depicted in FIG. 2, the outer surface 80 encloses a first cavity 30 and a second cavity 31. The first cavity 30 includes a first inner surface 40. The second cavity 31 includes a second inner surface 70.

FIG. 3 depicts a top view and provides greater detail of the first cavity 30 of the preferred embodiment. As shown in FIG. 3, the first cavity 30 is provided with a first opening 32 shaped to accept a cylindrical insert. The first inner surface 40 is configured to house a cylindrical insert 90, which, in the preferred embodiment of the present invention, functions as a roller. Those skilled in the art will appreciate that housing a cylindrical insert can be accomplished through a plurality of different configurations. The first inner surface 40 of the preferred embodiment includes a curved surface and a plurality of walls. As depicted in FIG. 3, the inner surface 40 includes a first wall 41, a second wall 42, a third wall 43, and a fourth wall 44. A first lifter wall 41 is adjacent to a curved surface 48. The curved surface 48 is adjacent to a second wall 42. Third and fourth walls 43, 44 are located on opposing sides of the curved surface 48.

Referring to FIG. 2, the body 20 of the present invention is provided with a second cavity 31 which includes a second opening 33 which is in a circular shape. The second cavity 31 is provided with a second inner surface 70. The second inner surface 70 of the preferred embodiment is cylindrically shaped. Alternatively, the second inner surface 70 is configured to house a lash adjuster generally designated 110 on FIG. 13. However, those skilled in the art will appreciate that the second inner surface 70 can be conically or frustoconically shaped without departing from the spirit of the present invention.

The present invention is fabricated through a plurality of processes. According to one aspect of the present invention, the valve lifter body 10 is machined. According to another aspect of the present invention, the valve lifter body 10 is forged. According to yet another aspect of the present invention, the valve lifter body 10 is fabricated through casting. The valve lifter body 10 of the preferred embodiment of the present invention is forged. As used herein, the term "forge," "forging," or "forged" is intended to encompass what is known in the art as "cold forming," "cold heading," "deep drawing," and "hot forging."

The valve lifter body 10 is preferably forged with use of a National® 750 parts former machine. Those skilled in the art will appreciate that other part formers, such as, for example, a Waterbury machine can be used. Those skilled in the art will further appreciate that other forging methods can be used as well.

The process of forging the valve lifter body 10 preferably begins with a metal wire or metal rod which is drawn to size. The ends of the wire or rod are squared off by a punch. After being drawn to size, the wire or rod is run through a series of dies or extrusions. The second cavity 31 is extruded through use of a punch and an extruding pin. After the second cavity 31 has been extruded, the first cavity 30 is forged. The first cavity 30 is extruded through use of an extruding punch and a forming pin.

Alternatively, the body 20 is fabricated through machining. As used herein, machining means the use of a chucking machine, a drilling machine, a grinding machine, or a broaching machine. Machining is accomplished by first feeding the body 20 into a chucking machine, such as an ACME-Gridley automatic chucking machine. Those skilled in the art will appreciate that other machines and other manufacturers of automatic chucking machines can be used.

To machine the second cavity 31, the end containing the second opening 33 is faced so that it is substantially flat. The second cavity 31 is bored. Alternatively, the second cavity 31 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second cavity 31 is ground using an internal diameter grinding machine, such as a Heald grinding machine. Those skilled in the art will appreciate that the second cavity 31 can be ground using other grinding machines.

Those skilled in the art will appreciate that the other features of the present invention may be fabricated through machining. For example, the first cavity 30 can be machined. To machine the first cavity 30, the end containing the first opening 32 is faced so that it is substantially flat. The first cavity 30 is drilled and then the first opening 32 is broached using a broaching machine.

Figure 4:
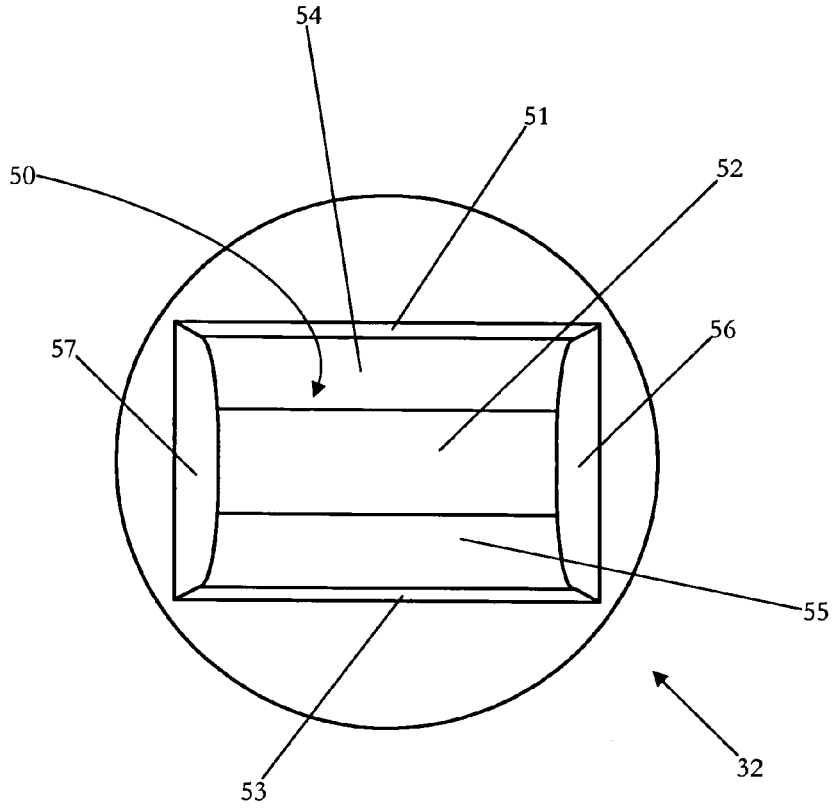
FIG. 4 depicts the top view of another preferred embodiment of a valve lifter body.
Figure 5:
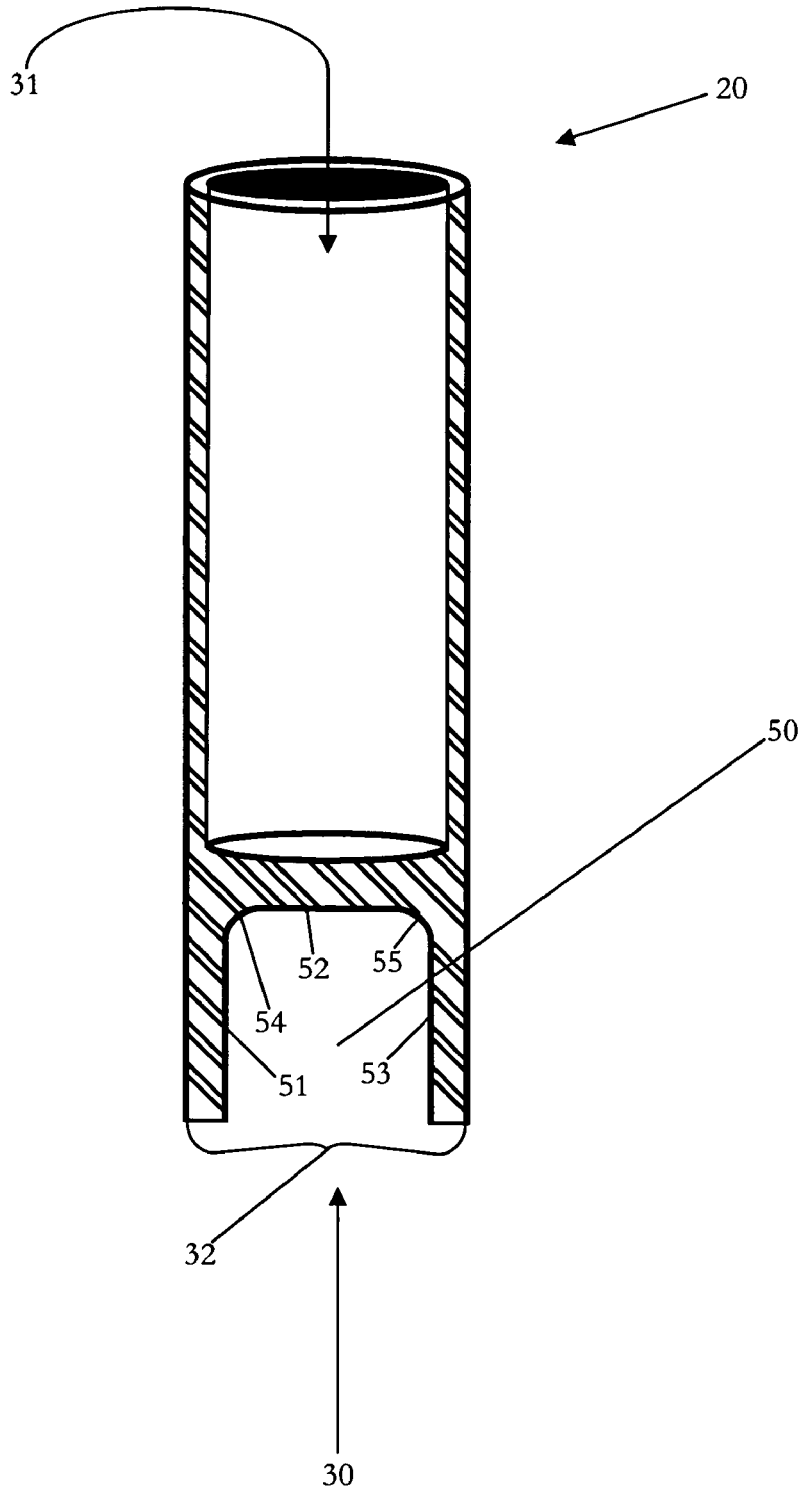
FIG. 5 depicts a second embodiment of a valve lifter body.

In an alternative embodiment of the present invention depicted in FIG. 4, the first cavity 30 is provided with a first opening 32 shaped to accept a cylindrical insert and a first inner surface 50. The first inner surface 50 includes a flat surface, a plurality of curved surfaces, and a plurality of walls. As depicted in FIG. 4, a first wall 51 is adjacent to a first curved surface 54. The first curved surface 54 is adjacent to a flat surface 52. The flat surface 52 is adjacent to a second curved surface 55. The second curved surface 55 is adjacent to a second wall 53. On opposing sides of the second wall 53 are the third wall 56 and the fourth wall 57. FIG. 5 depicts a cross-sectional view of the body 20 with the first cavity 30 shown in FIG. 4.

Figure 6:
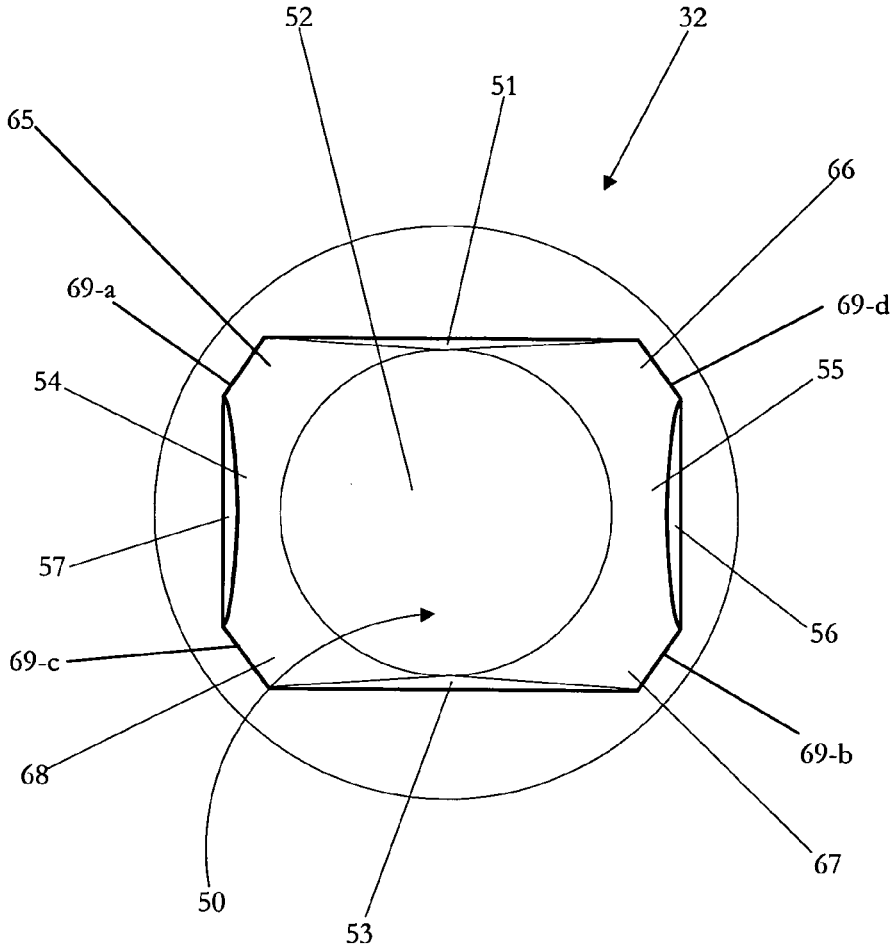
FIG. 6 depicts the top view of another preferred embodiment of a valve lifter body.
Figure 7:
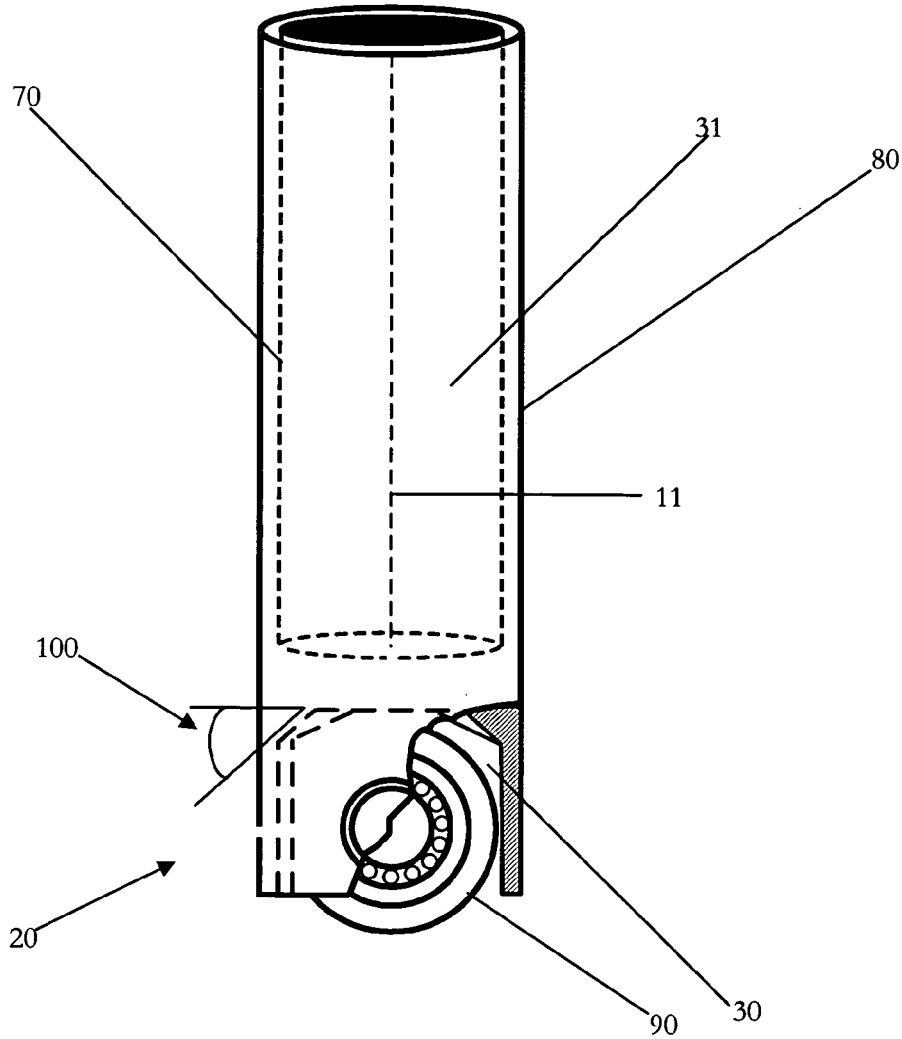
FIG. 7 depicts a third embodiment of a valve lifter body.

In another alternative embodiment of the present invention, as depicted in FIGS. 6 and 7, the first cavity 30 is provided with a first opening 32 shaped to accept a cylindrical insert and a first inner surface 50. The first inner surface 50 includes a plurality of curved surfaces, a plurality of angled surfaces, a plurality of walls, a plurality of angled walls, and a flat surface. Referring to FIG. 6, a first wall 51 is adjacent to a flat surface 52, a first angled surface 65, and a second angled surface 66. The first angled surface 65 is adjacent to the flat surface 52, a first curved surface 54, and a first angled wall 69-*a*. As depicted in FIG. 7 the first angled surface 65 is configured to be at an angle 100 relative to the plane of the flat surface 52, which as shown in FIG. 7 is perpendicular or orthagonal to the axis 11 of the valve lifter body 10. The angle 100 is preferably between twenty-five and about ninety degrees.

The second angled surface 66 is adjacent to the flat surface 52 and a fourth angled wall 69-*d*. As shown in FIG. 7, the second angled surface 66 is configured to be at an angle 100 relative to the plane of the flat surface 52, which as shown in FIG. 7 is perpendicular or orthagonal to the axis 11 of the valve lifter body 10. The angle 100 is preferably between twenty-five and about ninety degrees. The second angled surface 66 is adjacent to a second curved surface 55. The second curved surface 55 is adjacent to a third angled surface 67 and a third wall 56. The third angled surface 67 is adjacent to the flat surface 52, the second wall 53, and a second angled wall 69-*b*. As depicted in FIG. 7, the third angled surface 67 is configured to be at an angle 100 relative to the plane of the flat surface 52, which as shown in FIG. 7 is perpendicular or orthagonal to the axis 11 of the valve lifter body 10. The angle 100 is preferably between twenty-five and about ninety degrees.

The second wall 53 is adjacent to a fourth angled surface 68. The fourth angled surface 68 is adjacent to the first curved surface 54, a fourth wall 57, and a third angled wall 69-*c*. As depicted in FIG. 7, the fourth angled surface 68 is configured to be at an angle 100 relative to the plane of the flat surface 52, which as shown in FIG. 7 is perpendicular or orthagonal to the axis 11 of the valve lifter body 10. The angle 100 is preferably between twenty-five and about ninety degrees. FIG. 7 depicts a cross-sectional view of an embodiment with the first cavity 30 of FIG. 6.

Figure 8:
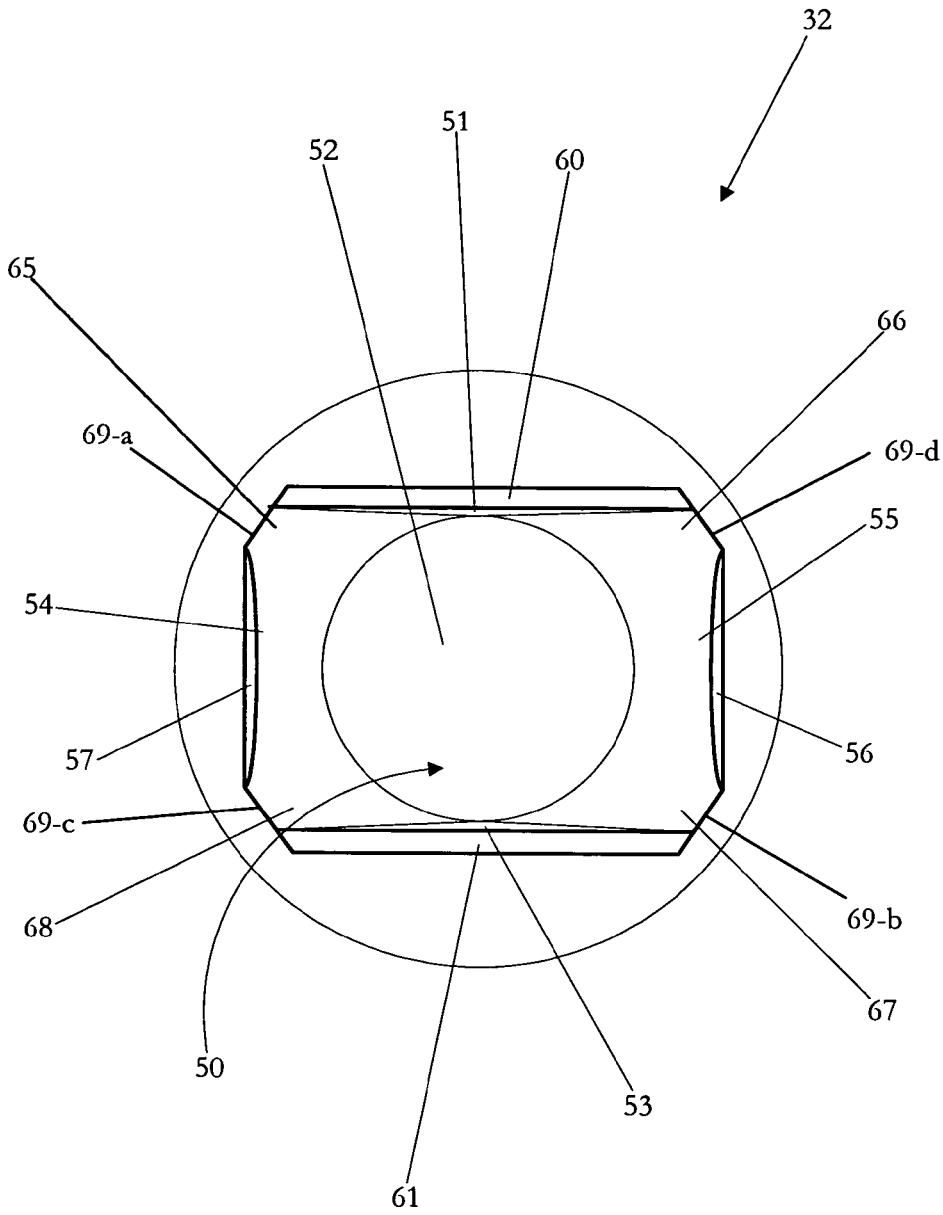
FIG. 8 depicts the top view of another preferred embodiment of a valve lifter body.

Shown in FIG. 8 is an alternative embodiment of the first cavity 30 depicted in FIG. 6. In the embodiment depicted in FIG. 8, the first cavity 30 is provided with a chamfered opening 32 and a first inner surface 50. The chamfered opening 32 functions so that a cylindrical insert can be introduced to the body 20 with greater ease. The chamfered opening 32 accomplishes this function through chamfers 60, 61 which are located on opposing sides of the chamfered opening 32. The chamfers 60, 61 of the embodiment shown in FIG. 8 are flat surfaces at an angle relative to the flat surface 52 and the walls 51, 53 so that a cylindrical insert 90 can be introduced through the first opening 32 with greater ease. Those skilled in the art will appreciate that the chamfers 60, 61 can be fabricated in a number of different configurations; so long as the resulting configuration renders introduction of a cylindrical insert 90 through the first opening 32 with greater ease, it is a "chamfered opening" within the spirit and scope of the present invention.

The chamfers 60, 61 are preferably fabricated through forging via an extruding punch pin. Alternatively, the chamfers 60, 61 are machined by being ground before heat-treating. Those skilled in the art will appreciate that other methods of fabrication can be employed within the scope of the present invention.

Figure 9:
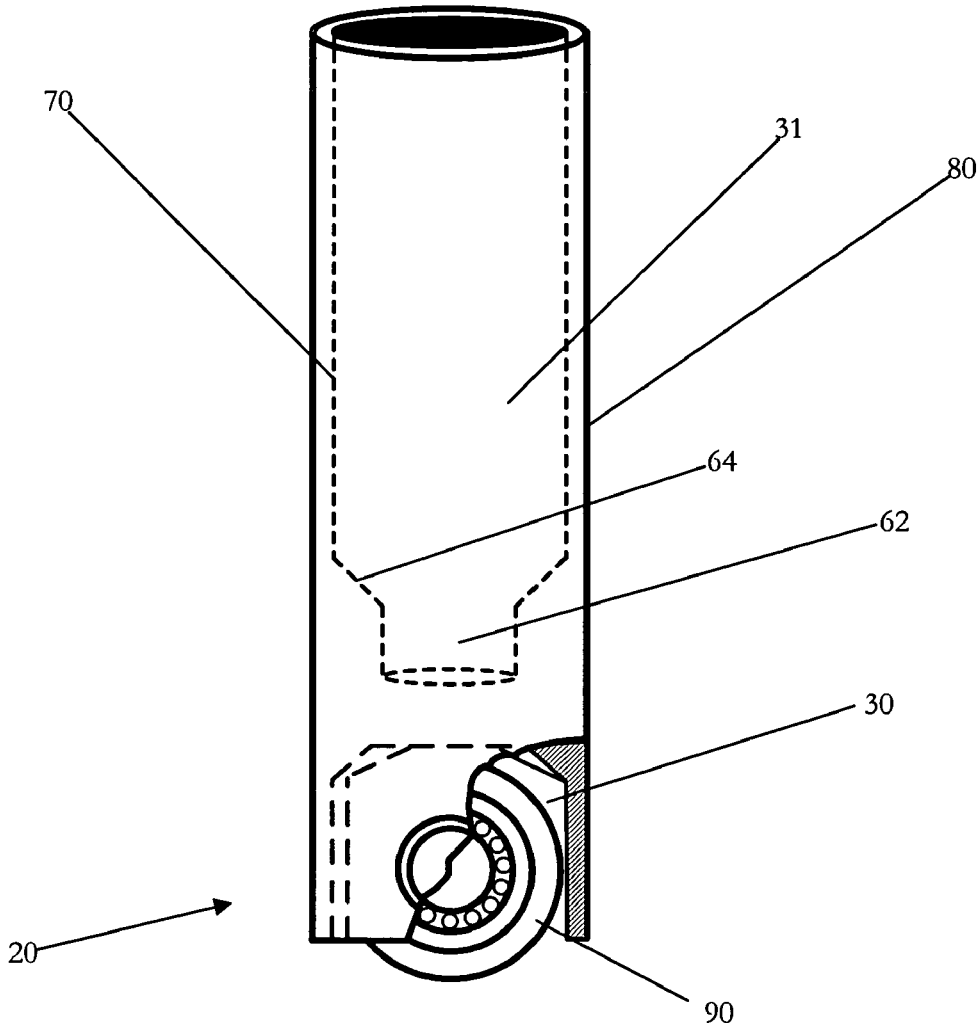
FIG. 9 depicts a fourth embodiment of a valve lifter body.

FIG. 9 discloses yet another alternative embodiment of the present invention. As depicted in FIG. 9, the body 20 is provided with a second cavity 31 which includes a plurality of cylindrical and conical surfaces. The second cavity 31 depicted in FIG. 9 includes a second inner surface 70. The second inner surface 70 of the preferred embodiment is cylindrically shaped, concentric relative to the cylindrically shaped outer surface 80. The second inner surface 70 is provided with a well 62. The well 62 is shaped to accommodate a spring (not shown). In the embodiment depicted in FIG. 9, the well 62 is cylindrically shaped at a diameter that is smaller than the diameter of the second inner surface 70. The cylindrical shape of the well 62 is preferably concentric relative to the outer surface 80. The well 62 is preferably forged through use of an extruding die pin.

Alternatively, the well 62 is machined by boring the well 62 in a chucking machine. Alternatively, the well 62 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the well 62 is ground using an internal diameter grinding machine, such as a Heald grinding machine. Those skilled in the art will appreciate that the well 62 can be ground using other grinding machines.

Adjacent to the well 62, the embodiment depicted in FIG. 9 is provided with a conically-shaped lead surface 64 which can be fabricated through forging or machining. However, those skilled in the art will appreciate that the present invention can be fabricated without the lead surface 64.

Figure 10:
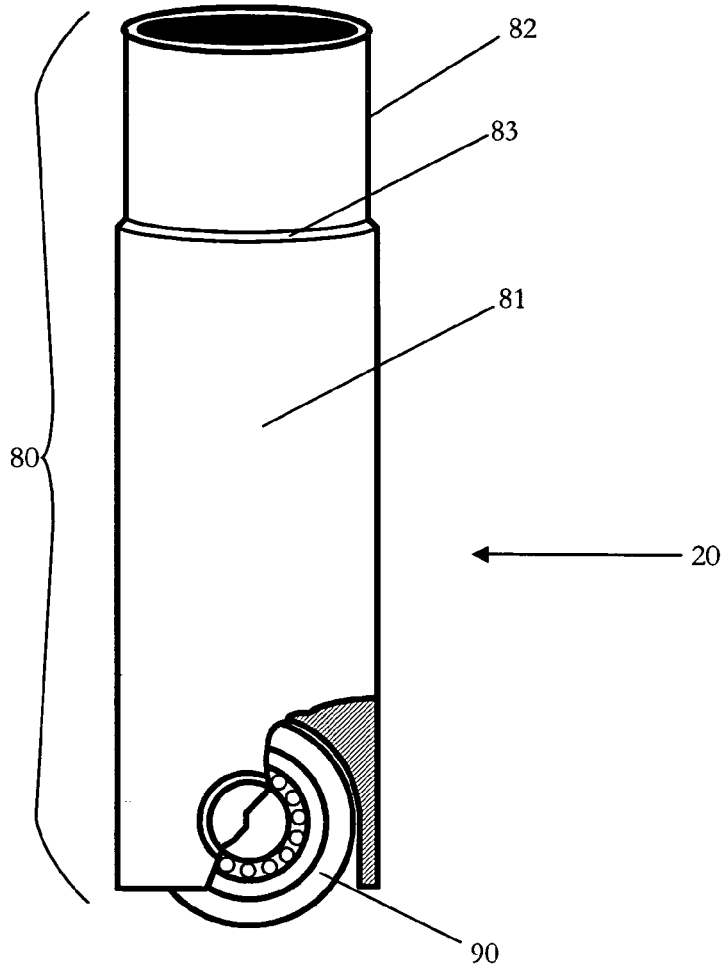
FIG. 10 depicts a fourth embodiment of a valve lifter body.

Depicted in FIG. 10 is another alternative embodiment of the present invention. As shown in FIG. 10, the body 20 is provided with an outer surface 80. The outer surface 80 includes a plurality of surfaces. In the embodiment depicted in FIG. 10, the outer surface 80 includes a cylindrical surface 81, an undercut surface 82, and a conical surface 83. As depicted in FIG. 10, the undercut surface 82 extends from one end of the body 20 and is cylindrically shaped. The diameter of the undercut surface 82 is smaller than the diameter of the cylindrical surface 81.

The undercut surface 82 is preferably forged through use of an extruding die. Alternatively, the undercut surface 82 is fabricated through machining. Machining the undercut surface 82 is accomplished through use of an infeed centerless grinding machine, such as a Cincinnati grinder. The surface is first heat-treated and then the undercut surface 82 is ground via a grinding wheel. Those skilled in the art will appreciate that additional surfaces can be ground into the outer surface with minor alterations to the grinding wheel.

As depicted in FIG. 10, the conical surface 83 is located between the cylindrical surface and the undercut surface. The conical surface 83 is preferably forged through use of an extruding die. Alternatively, the conical surface 83 is fabricated through machining. Those with skill in the art will appreciate that the outer surface 80 can be fabricated without the conical surface 83 so that the cylindrical surface 81 and the undercut surface 82 abut one another.

Figure 11:
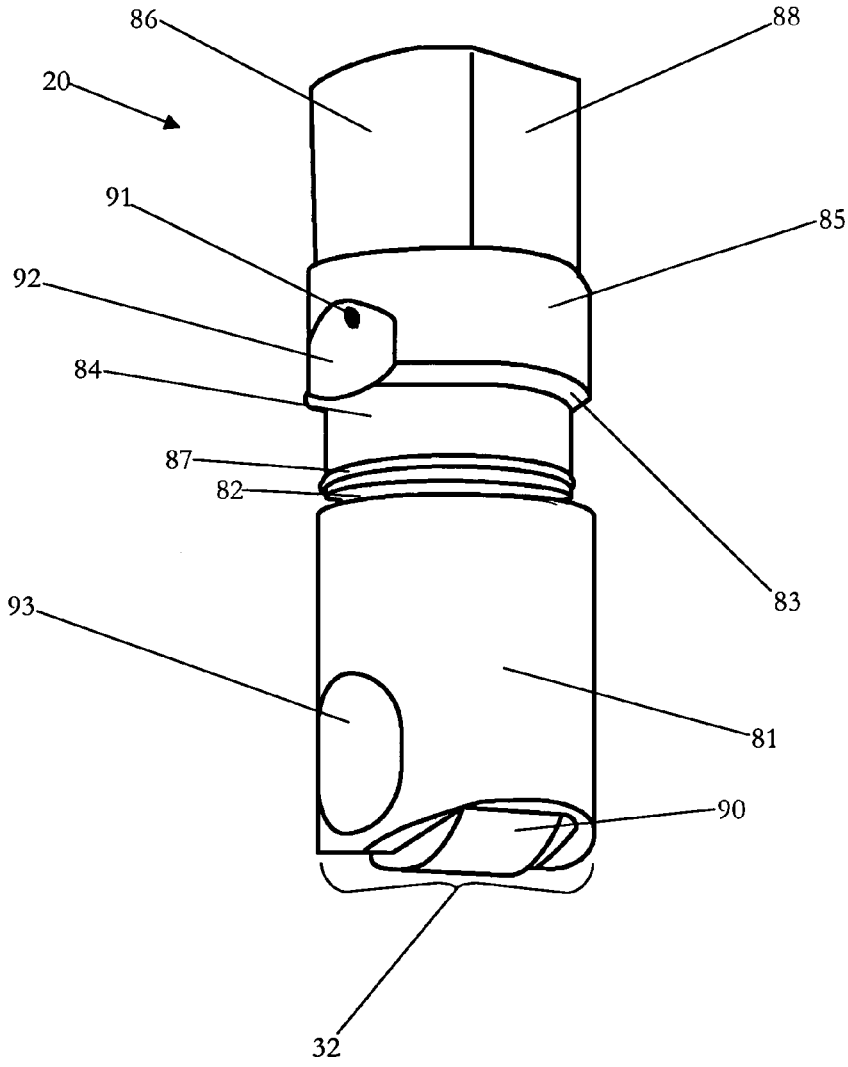
FIG. 11 depicts a fifth embodiment of a valve lifter body.

FIG. 11 depicts another embodiment of the present invention. In the embodiment depicted in FIG. 11, the outer surface 80 includes a plurality of outer surfaces. The outer surface 80 is provided with a first cylindrical surface 81. The first cylindrical surface 81 contains a first depression 93. Adjacent to the first cylindrical surface 81 is a second cylindrical surface 82. The second cylindrical surface 82 has a radius which is smaller than the radius of the first cylindrical surface 81. The second cylindrical surface 82 is adjacent to a third cylindrical surface 84. The third cylindrical surface 84 has a radius which is greater than the radius of the second cylindrical surface 82. The third cylindrical surface 84 contains a ridge 87. Adjacent to the third cylindrical surface 84 is a conical surface 83. The conical surface 83 is adjacent to a fourth cylindrical surface 85. The fourth cylindrical surface 85 and the conical surface 83 contain a second depression 92. The second depression 92 defines a hole 91. Adjacent to the fourth cylindrical surface 85 is a flat outer surface 88. The flat outer surface 88 is adjacent to a fifth cylindrical surface 86.

Those skilled in the art will appreciate that the features of the valve lifter body 10 may be fabricated through a combination of machining, forging, and other methods of fabrication. By way of example and not limitation, the first cavity 30 can be machined while the second cavity 31 is forged. Conversely, the second cavity 31 can be machined while the first cavity is forged.

Figure 12:
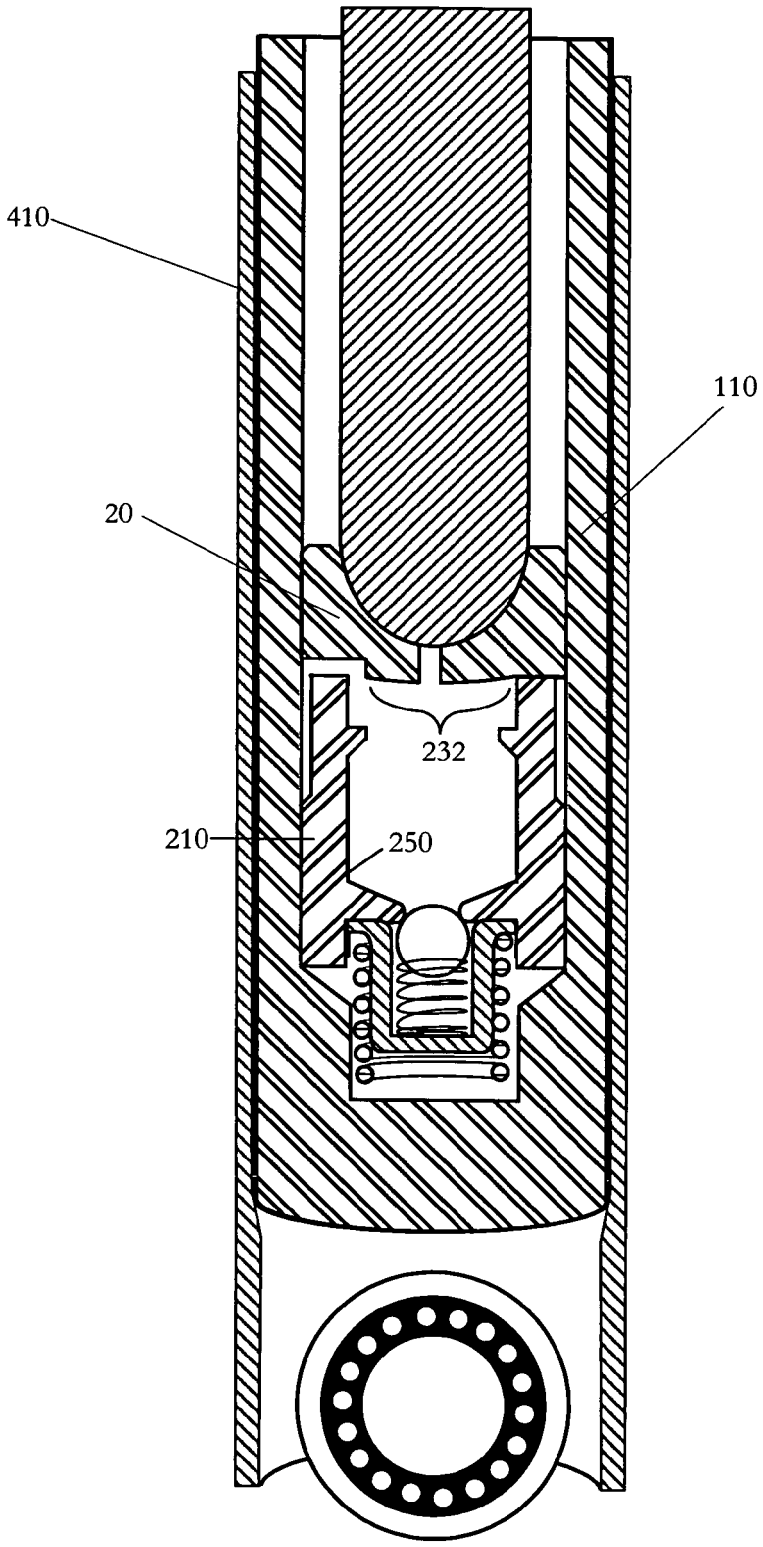
FIG. 12 depicts a lash adjuster body.
Figure 13:
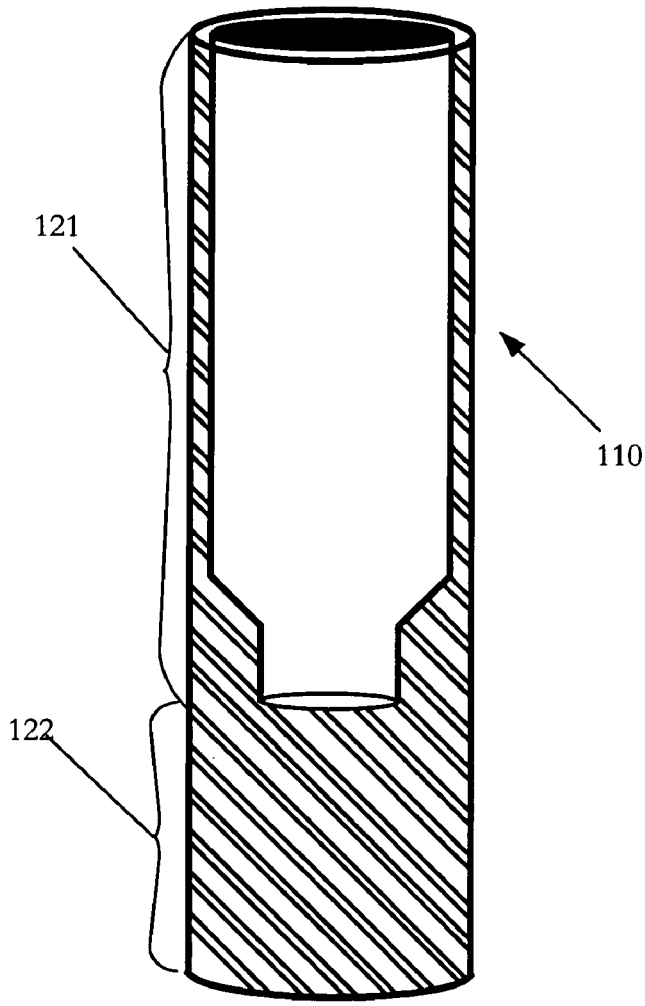
FIG. 13 depicts a preferred embodiment of a lash adjuster body.
Figure 14:
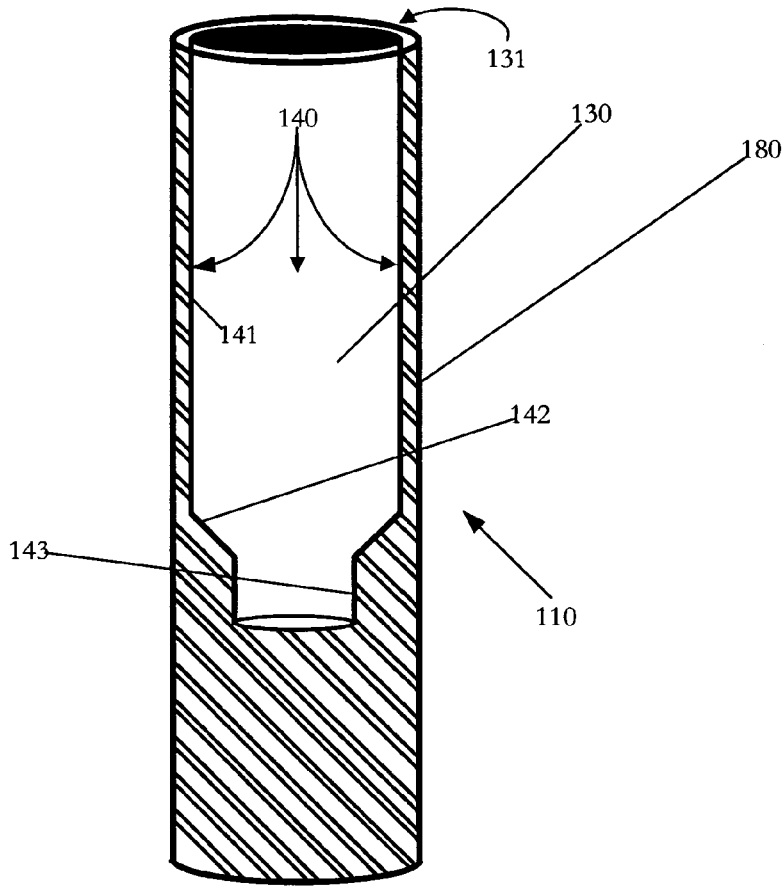
FIG. 14 depicts a preferred embodiment of a lash adjuster body.

FIGS. 12, 13, and 14 show a lash adjuster body 110 of an embodiment of the present invention. The lash adjuster body 110 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the lash adjuster body 110 is composed of pearlitic material. According to still another aspect of the present invention, the lash adjuster body 110 is composed of austenitic material. According to another aspect of the present invention, the metal is a ferritic material.

The lash adjuster body 110 is composed of a plurality of lash adjuster elements. According to one aspect of the present invention, the lash adjuster element is cylindrical in shape. According to another aspect of the present invention, the lash adjuster element is conical in shape. According to yet another aspect of the present invention, the lash adjuster element is solid. According to still another aspect of the present invention, the lash adjuster element is hollow.

FIG. 13 depicts a cross-sectional view of the lash adjuster 110 composed of a plurality of lash adjuster elements. FIG. 13 shows the lash adjuster body, generally designated 110. The lash adjuster body 110 of the preferred embodiment is fabricated from a single piece of metal wire or rod and is described herein as a plurality of lash adjuster elements. The lash adjuster body 110 includes a hollow lash adjuster element 121 and a solid lash adjuster element 122. In the preferred embodiment, the solid lash adjuster element 122 is located adjacent to the hollow lash adjuster element 121.

The lash adjuster body 110 functions to accommodate a plurality of inserts. According to one aspect of the present invention, the lash adjuster body 110 accommodates a leakdown plunger, such as the leakdown plunger 210. According to another aspect of the present invention, the lash adjuster body 110 accommodates a push rod seat (not shown). According to yet another aspect of the present invention, the lash adjuster body 110 accommodates a socket, such as the socket 310.

The lash adjuster body 110 is provided with a plurality of outer surfaces and inner surfaces. FIG. 14 depicts a cross-sectional view of the preferred embodiment of the present invention. As shown in FIG. 14, the lash adjuster body 110 is provided with an outer lash adjuster surface 180 which is configured to be inserted into another body. According to one aspect of the present invention, the outer lash adjuster surface 180 is configured to be inserted into a valve lifter, such as the valve lifter body 10. According to another aspect of the present invention, the outer lash adjuster surface 180 is configured to be inserted into a roller follower, such as the roller follower body 410.

The outer lash adjuster surface 180 encloses at least one cavity. As depicted in FIG. 14, the outer lash adjuster surface 180 encloses a lash adjuster cavity 130. The lash adjuster cavity 130 is configured to cooperate with a plurality of inserts. According to one aspect of the present invention, the lash adjuster cavity 130 is configured to cooperate with a leakdown plunger. In the preferred embodiment, the lash adjuster cavity 130 is configured to cooperate with the leakdown plunger 210. According to another aspect of the present invention, the lash adjuster cavity 130 is configured to cooperate with a socket. In the preferred embodiment, the lash adjuster cavity 130 is configured to cooperate with the socket 310. According to yet another aspect of the present invention, the lash adjuster cavity 130 is configured to cooperate with a push rod. According to still yet another aspect of the present invention, the lash adjuster cavity is configured to cooperate with a push rod seat.

Referring to FIG. 14, the lash adjuster body 110 of the present invention is provided with a lash adjuster cavity 130 that includes a lash adjuster opening 131. The lash adjuster opening 131 is in a circular shape. The lash adjuster cavity 130 is provided with the inner lash adjuster surface 140.

The inner lash adjuster surface 140 includes a plurality of surfaces. According to one aspect of the present invention, the inner lash adjuster surface 140 includes a cylindrical lash adjuster surface. According to another aspect of the present invention, the inner lash adjuster surface 140 includes a conical or frustoconical surface.

As depicted in FIG. 14, the inner lash adjuster surface 140 is provided with a first cylindrical lash adjuster surface 141, preferably concentric relative to the outer lash adjuster surface 180. Adjacent to the first cylindrical lash adjuster surface 141 is a conical lash adjuster surface 142. Adjacent to the conical lash adjuster surface 142 is a second cylindrical lash adjuster surface 143. However, those skilled in the art will appreciate that the inner lash adjuster surface 140 can be fabricated without the conical lash adjuster surface 142.

Figure 15:
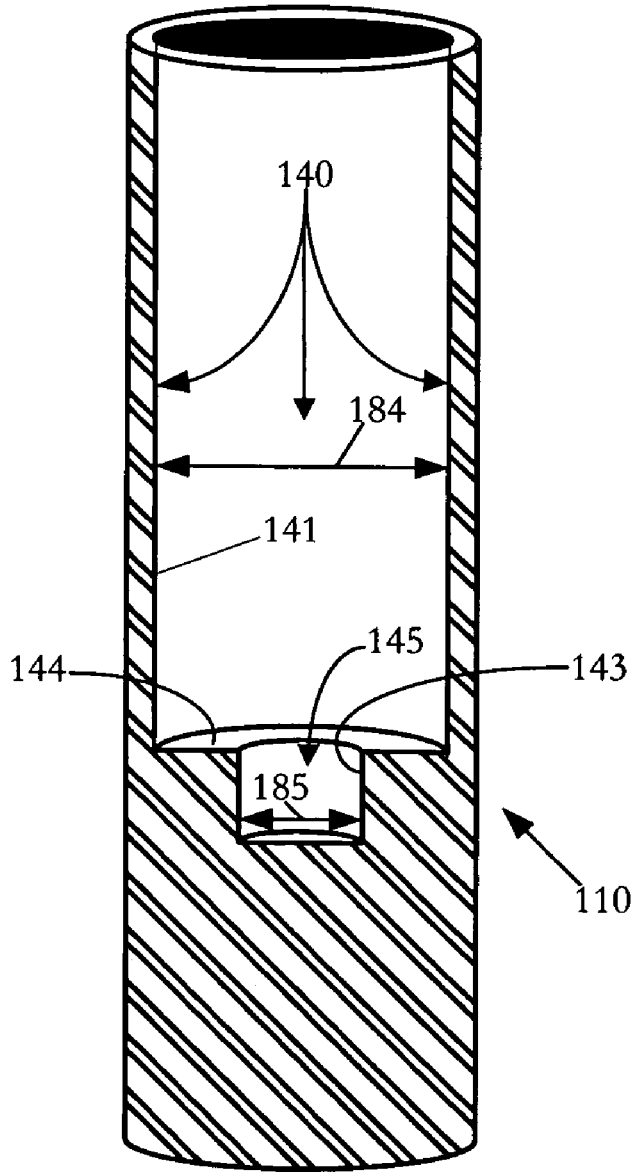
FIG. 15 depicts another embodiment of a lash adjuster body.

FIG. 15 depicts a cut-away view of the lash adjuster body 110 of the preferred embodiment. The inner lash adjuster surface 140 is provided with a first cylindrical lash adjuster surface 141 that includes a first inner lash adjuster diameter 184. The first cylindrical lash adjuster surface 141 abuts an annular lash adjuster surface 144 with an annulus 145. The annulus 145 defines a second cylindrical lash adjuster surface 143 that includes a second inner lash adjuster diameter 185. In the embodiment depicted, the second inner lash adjuster diameter 185 is smaller than the first inner lash adjuster diameter 184.

The lash adjuster body 110 of the present invention is fabricated through a plurality of processes. According to one aspect of the present invention, the lash adjuster body 110 is machined. According to another aspect of the present invention, the lash adjuster body 110 is forged. According to yet another aspect of the present invention, the lash adjuster body 110 is fabricated through casting. The preferred embodiment of the present invention is forged. As used herein, the term "forge," "forging," or "forged" is intended to encompass what is known in the art as "cold forming," "cold heading," "deep drawing," and "hot forging."

In the preferred embodiment, the lash adjuster body 110 is forged with use of a National® 750 parts former machine. However, those skilled in the art will appreciate that other part formers, such as, for example, a Waterbury machine can be used. Those skilled in the art will further appreciate that other forging methods can be used as well.

The process of forging the preferred embodiment begins with a metal wire or metal rod which is drawn to size. The ends of the wire or rod are squared off by a punch. After being drawn to size, the wire or rod is run through a series of dies or extrusions.

The lash adjuster cavity 130 is extruded through use of a punch and an extruding pin. After the lash adjuster cavity 130 has been extruded, the lash adjuster cavity 130 is forged. The lash adjuster cavity 130 is extruded through use of an extruding punch and a forming pin.

Alternatively, the lash adjuster body 110 is fabricated through machining. As used herein, machining means the use of a chucking machine, a drilling machine, a grinding machine, or a broaching machine. Machining is accomplished by first feeding the lash adjuster body 110 into a chucking machine, such as an ACME-Gridley automatic chucking machine. Those skilled in the art will appreciate that other machines and other manufacturers of automatic chucking machines can be used.

To machine the lash adjuster cavity 130, the end containing the lash adjuster opening 131 is faced so that it is substantially flat. The lash adjuster cavity 130 is bored. Alternatively, the lash adjuster cavity 130 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the lash adjuster cavity 130 is ground using an internal diameter grinding machine, such as a Heald grinding machine. Those skilled in the art will appreciate that the lash adjuster cavity 130 can be ground using other grinding machines.

Figure 16:
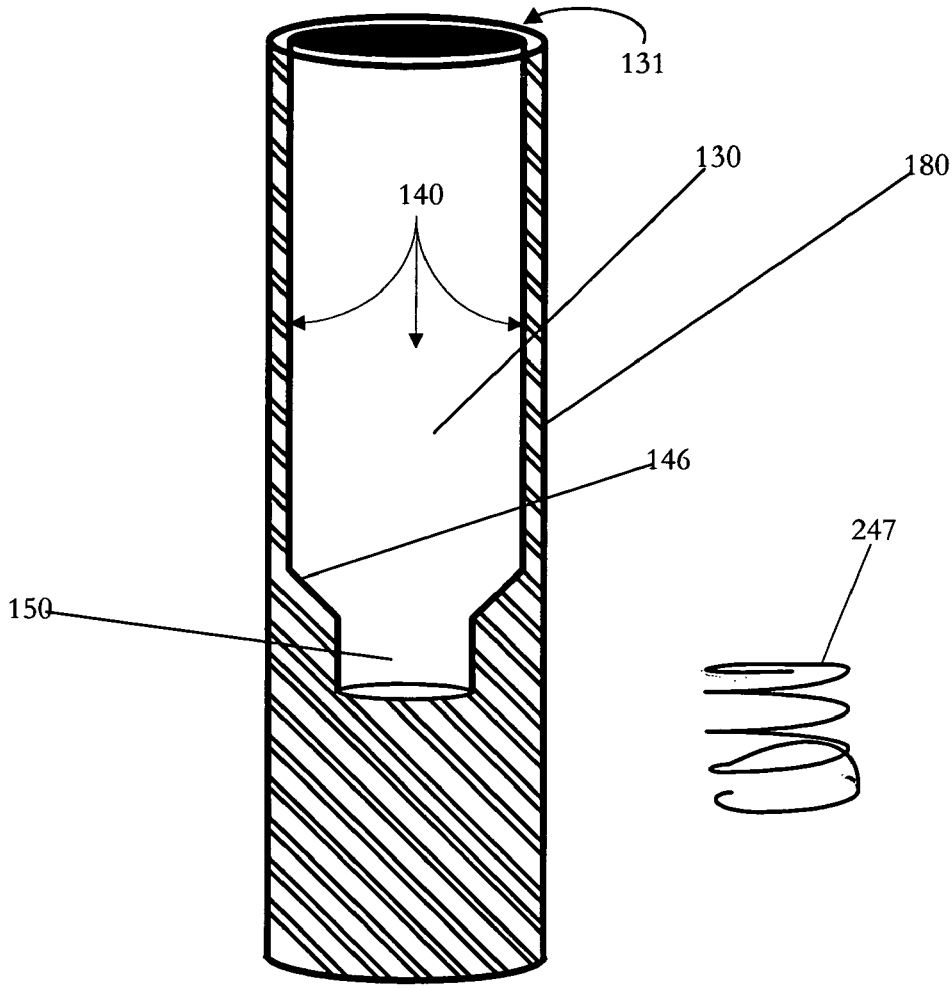
FIG. 16 depicts another embodiment of a lash adjuster body.

FIG. 16 depicts the inner lash adjuster surface 140 provided with a lash adjuster well 150. The lash adjuster well 150 is shaped to accommodate a cap spring 247. In the embodiment depicted in FIG. 16, the lash adjuster well 150 is cylindrically shaped at a diameter that is smaller than the diameter of the inner lash adjuster surface 140. The cylindrical shape of the lash adjuster well 150 is preferably concentric relative to the outer lash adjuster surface 180. The lash adjuster well 150 is preferably forged through use of an extruding die pin.

Alternatively, the lash adjuster well 150 is machined by boring the lash adjuster well 150 in a chucking machine. Alternatively, the lash adjuster well 150 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lash adjuster well 150 is ground using an internal diameter grinding machine, such as a Heald grinding machine. Those skilled in the art will appreciate that the lash adjuster well 150 can be ground using other grinding machines.

Adjacent to the lash adjuster well 150, in the embodiment depicted in FIG. 16, is a lash adjuster lead surface 146 which is conically shaped and can be fabricated through forging or machining. However, those skilled in the art will appreciate that the present invention can be fabricated without the lash adjuster lead surface 146.

Figure 17:
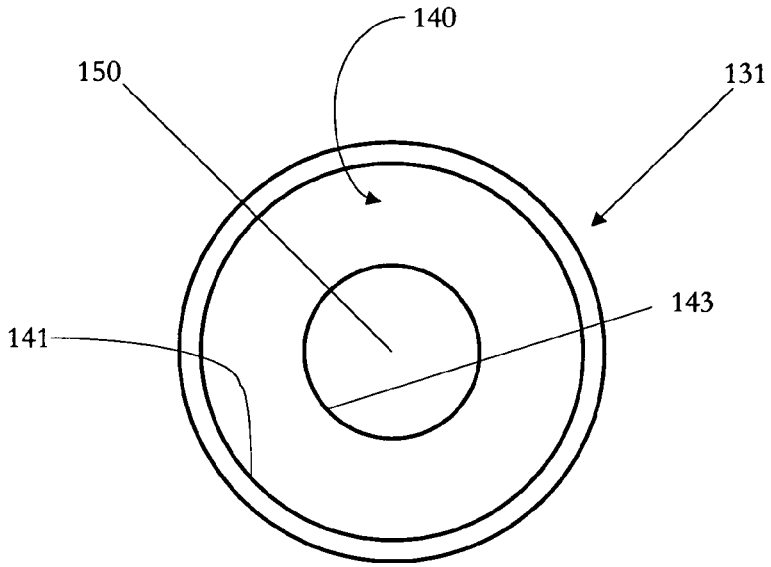
FIG. 17 depicts a top view of an embodiment of a lash adjuster body.

FIG. 17 depicts a view of the lash adjuster opening 131 that reveals the inner lash adjuster surface 140 of the preferred embodiment of the present invention. The inner lash adjuster surface 140 is provided with a first cylindrical lash adjuster surface 141. A lash adjuster well 150 is defined by a second cylindrical lash adjuster surface 143. As shown in FIG. 17, the second cylindrical lash adjuster surface 143 is concentric relative to the first cylindrical lash adjuster surface 141.

Figure 18:
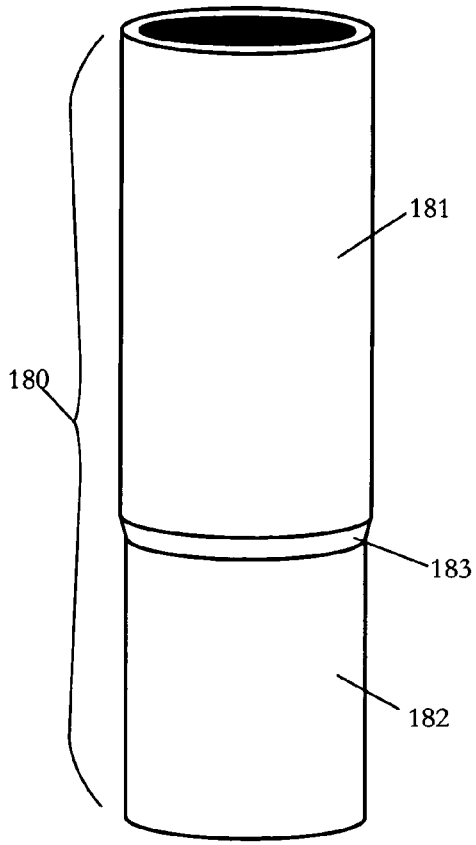
FIG. 18 depicts the top view of another preferred embodiment of a lash adjuster body.

Depicted in FIG. 18 is a lash adjuster body 110 of an alternative embodiment. As shown in FIG. 18, the lash adjuster body 110 is provided with an outer lash adjuster surface 180. The outer lash adjuster surface 180 includes a plurality of surfaces. In the embodiment depicted in FIG. 18, the outer lash adjuster surface 180 includes an outer cylindrical lash adjuster surface 181, an undercut lash adjuster surface 182, and a conical lash adjuster surface 183. As depicted in FIG. 18, the undercut lash adjuster surface 182 extends from one end of the lash adjuster body 110 and is cylindrically shaped. The diameter of the undercut lash adjuster surface 182 is smaller than the diameter of the outer cylindrical lash adjuster surface 181.

The undercut lash adjuster surface 182 is forged through use of an extruding die. Alternatively, the undercut lash adjuster surface 182 is fabricated through machining. Machining the undercut lash adjuster surface 182 is accomplished through use of an infeed centerless grinding machine, such as a Cincinnati grinder. The surface is first heat-treated and then the undercut lash adjuster surface 182 is ground via a grinding wheel. Those skilled in the art will appreciate that additional surfaces can be ground into the outer lash adjuster surface 180 with minor alterations to the grinding wheel.

As depicted in FIG. 18, the conical lash adjuster surface 183 is located between the outer cylindrical lash adjuster surface 181 and the undercut lash adjuster surface 182. The conical lash adjuster surface 183 is forged through use of an extruding die. Alternatively, the conical lash adjuster surface 183 is fabricated through machining. Those with skill in the art will appreciate that the outer lash adjuster surface 180 can be fabricated without the conical lash adjuster surface 183 so that the outer cylindrical lash adjuster surface 181 and the undercut lash adjuster surface 182 abut one another.

Those skilled in the art will appreciate that the features of the lash adjuster body 110 may be fabricated through a combination of machining, forging, and other methods of fabrication. By way of example and not limitation, aspects of the lash adjuster cavity 130 can be machined; other aspects of the lash adjuster cavity can be forged.

Figure 19:
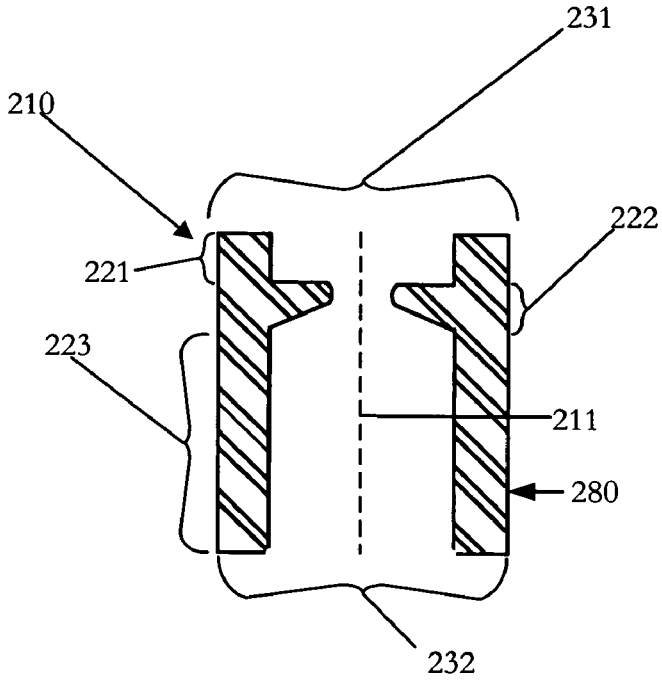
FIG. 19 depicts a preferred embodiment of a leakdown plunger.
Figure 20:
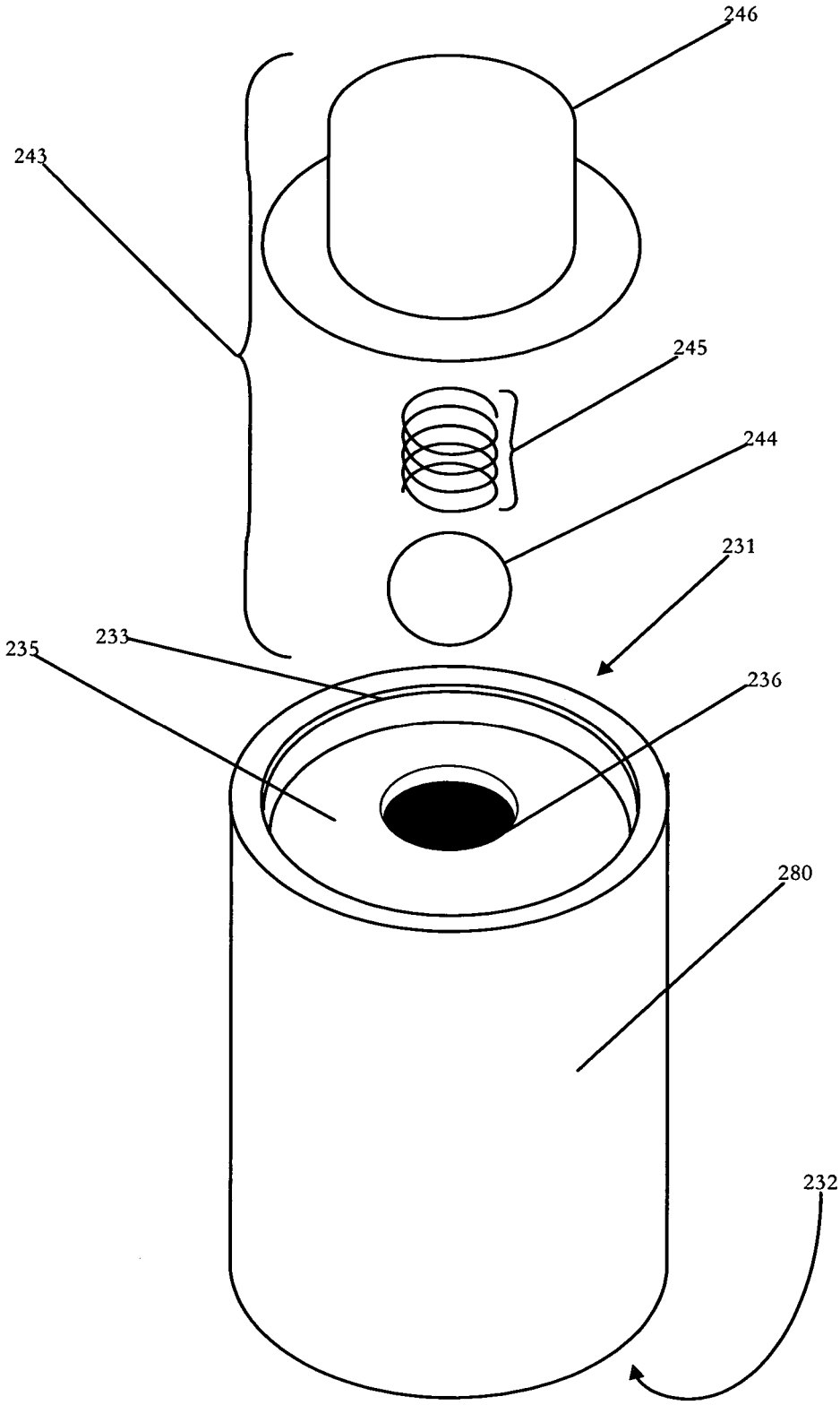
FIG. 20 depicts a preferred embodiment of a leakdown plunger.
Figure 21:
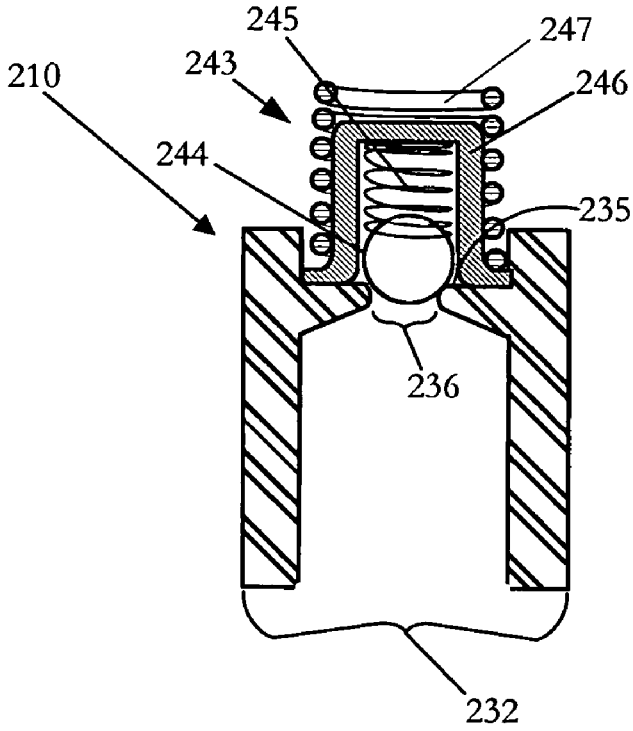
FIG. 21 depicts a cross-sectional view of a preferred embodiment of a leakdown plunger.

FIGS. 19, 20, and 21 show a leakdown plunger 210 constituting a preferred embodiment. The leakdown plunger 210 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the leakdown plunger 210 is composed of pearlitic material. According to still another aspect of the present invention, the leakdown plunger 210 is composed of austenitic material. According to another aspect of the present invention, the metal is a ferritic material.

The leakdown plunger 210 is composed of a plurality of plunger elements. According to one aspect of the present invention, the plunger element is cylindrical in shape. According to another aspect of the present invention, the plunger element is conical in shape. According to yet another aspect of the present invention, the plunger element is hollow.

FIG. 19 depicts a cross-sectional view of the leakdown plunger 210 composed of a plurality of plunger elements. FIG. 19 shows the leakdown plunger, generally designated 210. The leakdown plunger 210 functions to accept a liquid, such as a lubricant and is provided with a first plunger opening 231 and a second plunger opening 232. The first plunger opening 231 functions to accommodate an insert.

The leakdown plunger 210 of the preferred embodiment is fabricated from a single piece of metal wire or rod and is described herein as a plurality of plunger elements. The leakdown plunger 210 includes a first hollow plunger element 221, a second hollow plunger element 223, and an insert-accommodating plunger element 222. As depicted in FIG. 19, the first hollow plunger element 221 is located adjacent to the insert-accommodating plunger element 222. The insert-accommodating plunger element 222 is located adjacent to the second hollow plunger element 223.

The leakdown plunger 210 is provided with a plurality of outer surfaces and inner surfaces. FIG. 20 depicts the first plunger opening 231 of an alternative embodiment. The first plunger opening 231 of the embodiment depicted in FIG. 20 is advantageously provided with a chamfered plunger surface 233, however a chamfered plunger surface 233 is not necessary. When used herein in relation to a surface, the term "chamfered" shall mean a surface that is rounded or angled.

The first plunger opening 231 depicted in FIG. 20 is configured to accommodate an insert. The first plunger opening 231 is shown in FIG. 20 accommodating a valve insert 243. In the embodiment depicted in FIG. 20, the valve insert 243 is shown in an exploded view and includes a generally spherically shaped valve insert member 244, an insert spring 245, and a cap 246. Those skilled in the art will appreciate that valves other than the valve insert 243 shown herein can be used without departing from the scope and spirit of the present invention.

As shown in FIG. 20, the first plunger opening 231 is provided with an annular plunger surface 235 defining a plunger hole 236. The plunger hole 236 is shaped to accommodate an insert. In the embodiment depicted in FIG. 20, the plunger hole 236 is shaped to accommodate the spherical valve insert member 244. The spherical valve insert member 244 is configured to operate with the insert spring 245 and the cap 246. The cap 246 is shaped to at least partially cover the spherical valve insert member 244 and the insert spring 245. The cap 246 is preferably fabricated through stamping. However, the cap 246 may be forged or machined without departing from the scope or spirit of the present invention.

FIG. 21 shows a cross-sectional view of the leakdown plunger 210 depicted in FIG. 20 in a semi-assembled state. In FIG. 21 the valve insert 243 is shown in a semi-assembled state. As depicted in FIG. 21, a cross-sectional view of a cap spring 247 is shown around the cap 246. Those skilled in the art will appreciate that the cap spring 247 and the cap 246 are configured to be inserted into the well of another body. According to one aspect of the present invention, the cap spring 247 and the cap 246 are configured to be inserted into the well of a lash adjuster, such as the lash adjuster well 150 of the lash adjuster 110. According to another aspect of the present invention, the cap spring 247 and the cap 246 are configured to be inserted into the well of a valve lifter such as the well 62 of the valve lifter body 10.

The cap 246 is configured to at least partially depress the insert spring 245. The insert spring 245 exerts a force on the spherical valve insert member 244. In FIG. 21, the annular plunger surface 235 is shown with the spherical valve insert member 244 partially located within the plunger hole 236.

Figure 29:
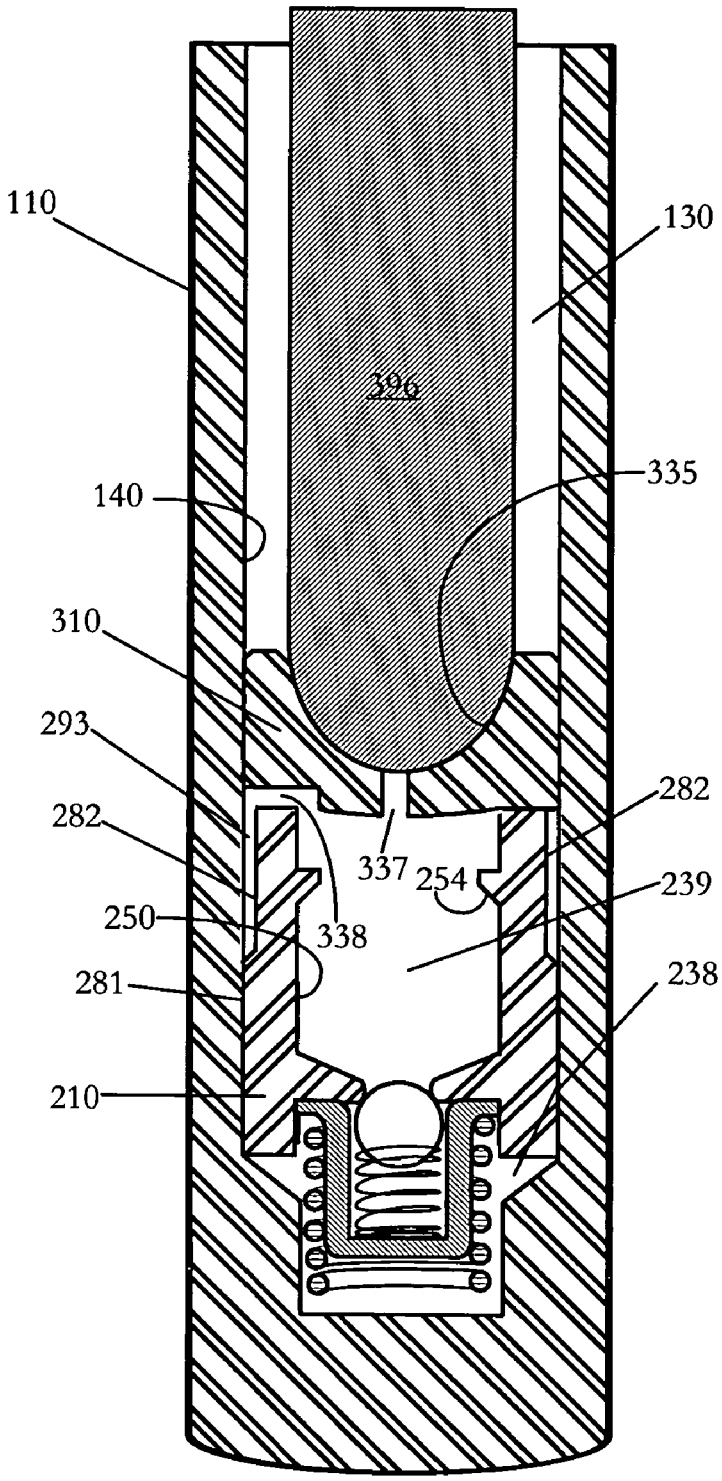
FIG. 29 depicts a sixth embodiment of a leakdown plunger.

Referring now to FIGS. 19 and 20, the leakdown plunger 210 is provided with an outer plunger surface 280 that includes an axis 211. The outer plunger surface 280 is preferably shaped so that the leakdown plunger can be inserted into a lash adjuster body, such as the lash adjuster body 110. Depicted in FIG. 29 is a lash adjuster body 110 having an inner lash adjuster surface 140 defining a cavity 130. An embodiment of the leakdown plunger 210 is depicted in FIG. 29 within the cavity 130 of the lash adjuster body 110. As shown in FIG. 29, the leakdown plunger 210 is preferably provided with an outer plunger surface 280 that is cylindrically shaped.

Figure 22:
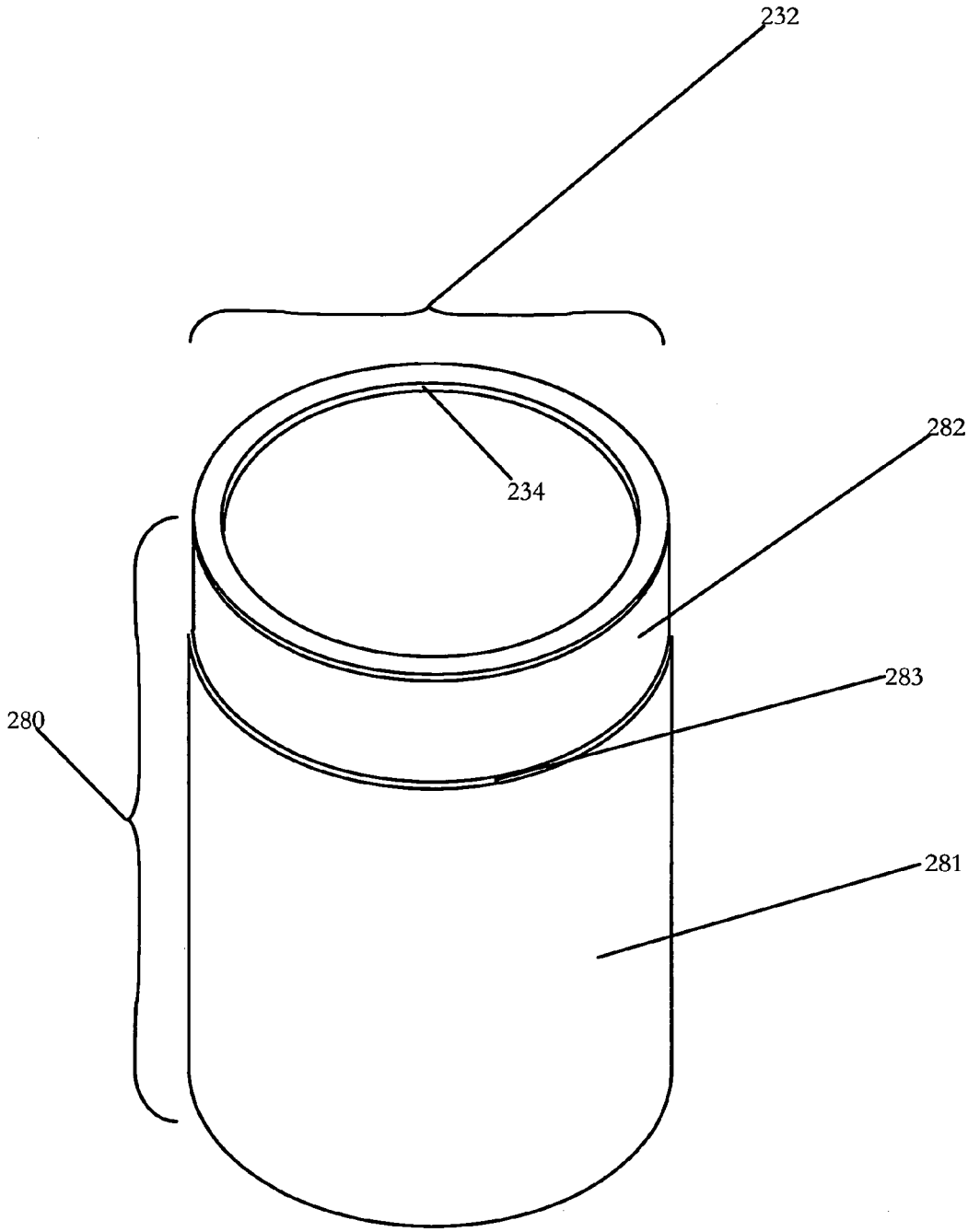
FIG. 22 depicts a perspective view of another preferred embodiment of a leakdown plunger.

FIG. 22 depicts a leakdown plunger 210 of an alternative embodiment. FIG. 22 depicts the second plunger opening 232 in greater detail. The second plunger opening 232 is shown with a chamfered plunger surface 234. However, those with skill in the art will appreciate that the second plunger opening 232 may be fabricated without the chamfered plunger surface 234.

In FIG. 22 the leakdown plunger 210 is provided with a plurality of outer surfaces. As shown therein, the embodiment is provided with an outer plunger surface 280. The outer plunger surface 280 includes a plurality of surfaces. FIG. 22 depicts a cylindrical plunger surface 281, an undercut plunger surface 282, and a conical plunger surface 283. As depicted in FIG. 22, the undercut plunger surface 282 extends from one end of the leakdown plunger 210 and is cylindrically shaped. The diameter of the undercut plunger surface 282 is smaller than the diameter of the cylindrical plunger surface 281.

The undercut plunger surface 282 is preferably forged through use of an extruding die. Alternatively, the undercut plunger surface 282 is fabricated through machining. Machining the undercut plunger surface 282 is accomplished through use of an infeed centerless grinding machine, such as a Cincinnati grinder. The surface is first heat-treated and then the undercut plunger surface 282 is ground via a grinding wheel. Those skilled in the art will appreciate that additional surfaces can be ground into the outer plunger surface 280 with minor alterations to the grinding wheel.

Referring again to FIG. 22, the conical plunger surface 283 is located between the cylindrical plunger surface 281 and the undercut plunger surface 282. Those with skill in the art will appreciate that the outer plunger surface 280 can be fabricated without the conical plunger surface 283 so that the cylindrical plunger surface 281 and the undercut plunger surface 282 abut one another.

Figure 23:
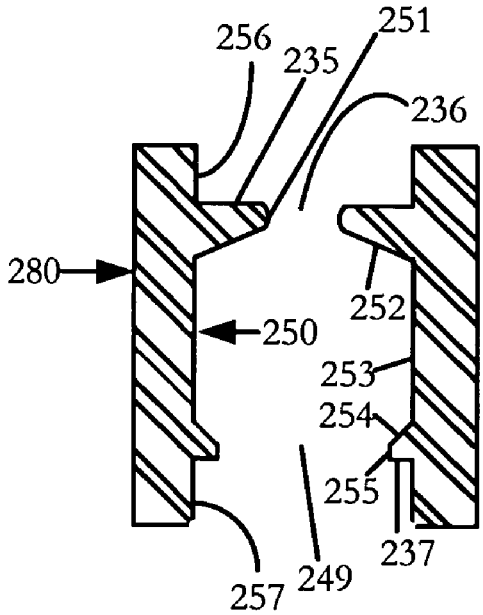
FIG. 23 depicts a second embodiment of a leakdown plunger.
Figure 24:
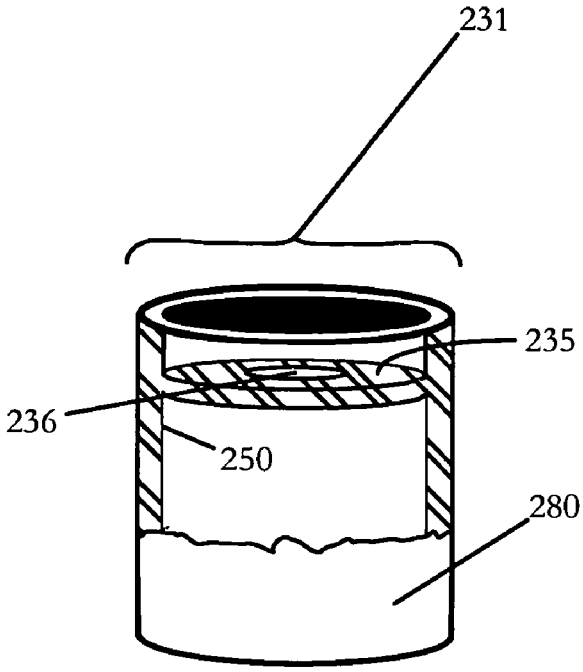
FIG. 24 depicts a third embodiment of a leakdown plunger.

FIG. 24 depicts an embodiment of the leakdown plunger 210 with a section of the outer plunger surface 280 broken away. The embodiment depicted in FIG. 24 is provided with a first plunger opening 231. As shown in FIG. 24, the outer plunger surface 280 encloses an inner plunger surface 250. As shown in FIG. 23, the inner plunger surface 250 includes a first annular plunger surface 235 that defines a first plunger hole 236 and a second annular plunger surface 237 that defines a second plunger hole 249.

Figure 25:
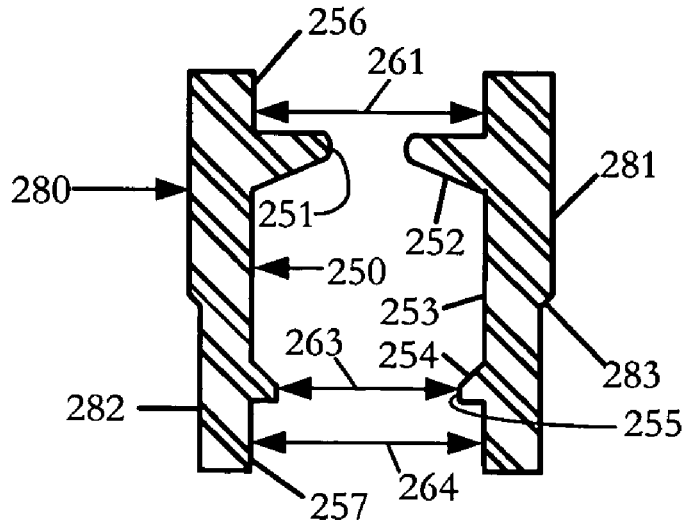
FIG. 25 depicts a fourth embodiment of a leakdown plunger.

FIG. 25 depicts a cross-sectional view of a leakdown plunger of an alternative embodiment. The leakdown plunger 210 shown in FIG. 25 is provided with an outer plunger surface 280 that includes a plurality of cylindrical and conical surfaces. In the embodiment depicted in FIG. 25, the outer plunger surface 280 includes an outer cylindrical plunger surface 281, an undercut plunger surface 282, and an outer conical plunger surface 283. As depicted in FIG. 25, the undercut plunger surface 282 extends from one end of the leakdown plunger 210 and is cylindrically shaped. The diameter of the undercut plunger surface 282 is smaller than, and preferably concentric relative to, the diameter of the outer cylindrical plunger surface 281. The outer conical plunger surface 283 is located between the outer cylindrical plunger surface 281 and the undercut plunger surface 282. Those with skill in the art will appreciate that the outer plunger surface 280 can be fabricated without the conical plunger surface 283 so that the outer cylindrical plunger surface 281 and the undercut plunger surface 282 abut one another.

Figure 26:
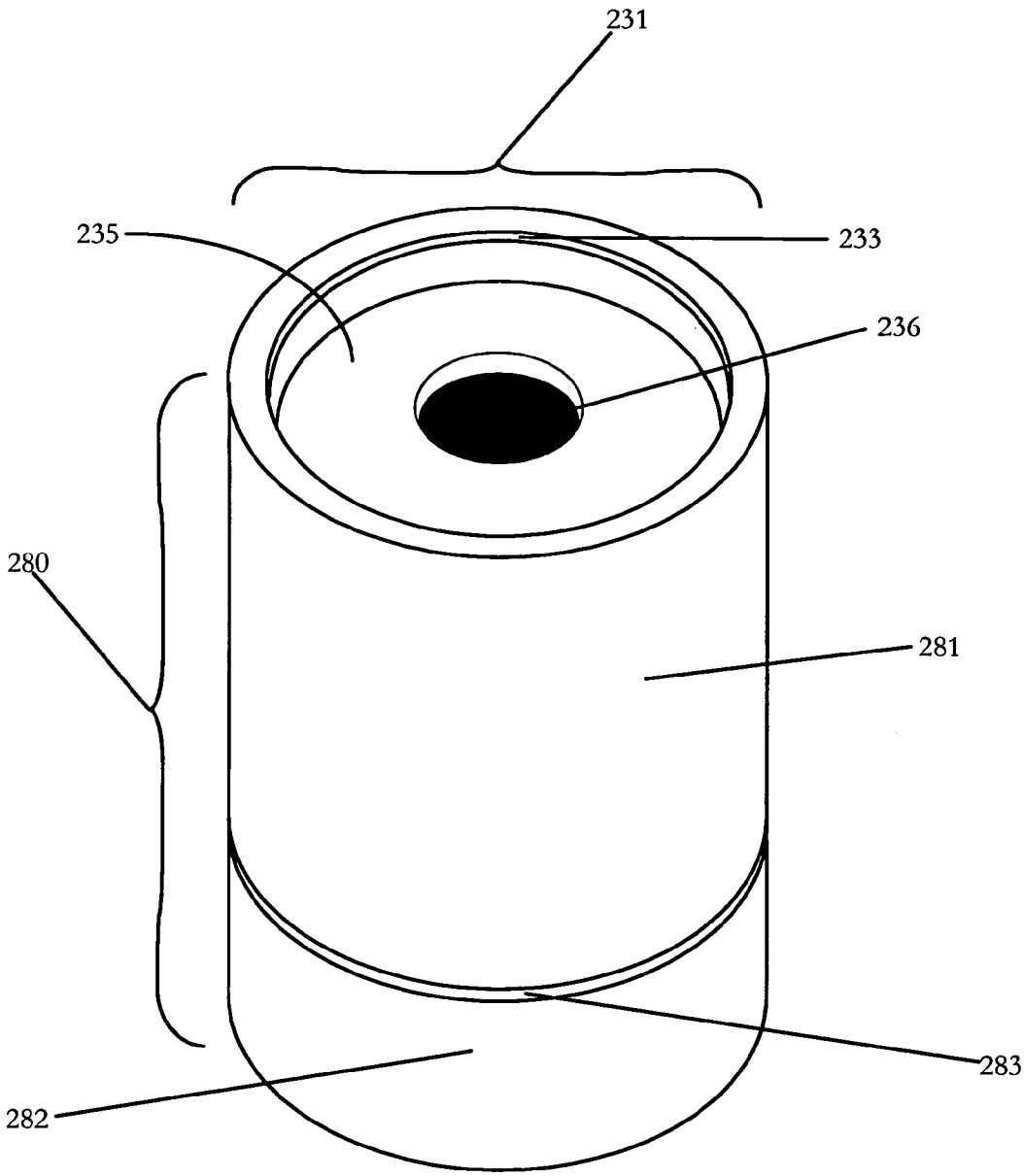
FIG. 26 depicts a fifth embodiment of a leakdown plunger.

FIG. 26 depicts in greater detail the first plunger opening 231 of the embodiment depicted in FIG. 25. The first plunger opening 231 is configured to accommodate an insert and is preferably provided with a first chamfered plunger surface 233. Those skilled in the art, however, will appreciate that the first chamfered plunger surface 233 is not necessary. As further shown in FIG. 26, the first plunger opening 231 is provided with a first annular plunger surface 235 defining a plunger hole 236.

The embodiment depicted in FIG. 26 is provided with an outer plunger surface 280 that includes a plurality of surfaces. The outer plunger surface 280 includes a cylindrical plunger surface 281, an undercut plunger surface 282, and a conical plunger surface 283. As depicted in FIG. 26, the undercut plunger surface 282 extends from one end of the leakdown plunger 210 and is cylindrically shaped. The diameter of the undercut plunger surface 282 is smaller than the diameter of the cylindrical plunger surface 281. The conical plunger surface 283 is located between the cylindrical plunger surface 281 and the undercut plunger surface 282. However, those with skill in the art will appreciate that the outer plunger surface 280 can be fabricated without the conical plunger surface 283 so that the cylindrical plunger surface 281 and the undercut plunger surface 282 abut one another. Alternatively, the cylindrical plunger surface 281 may abut the undercut plunger surface 282 so that the conical plunger surface 283 is an annular surface.

Figure 27:
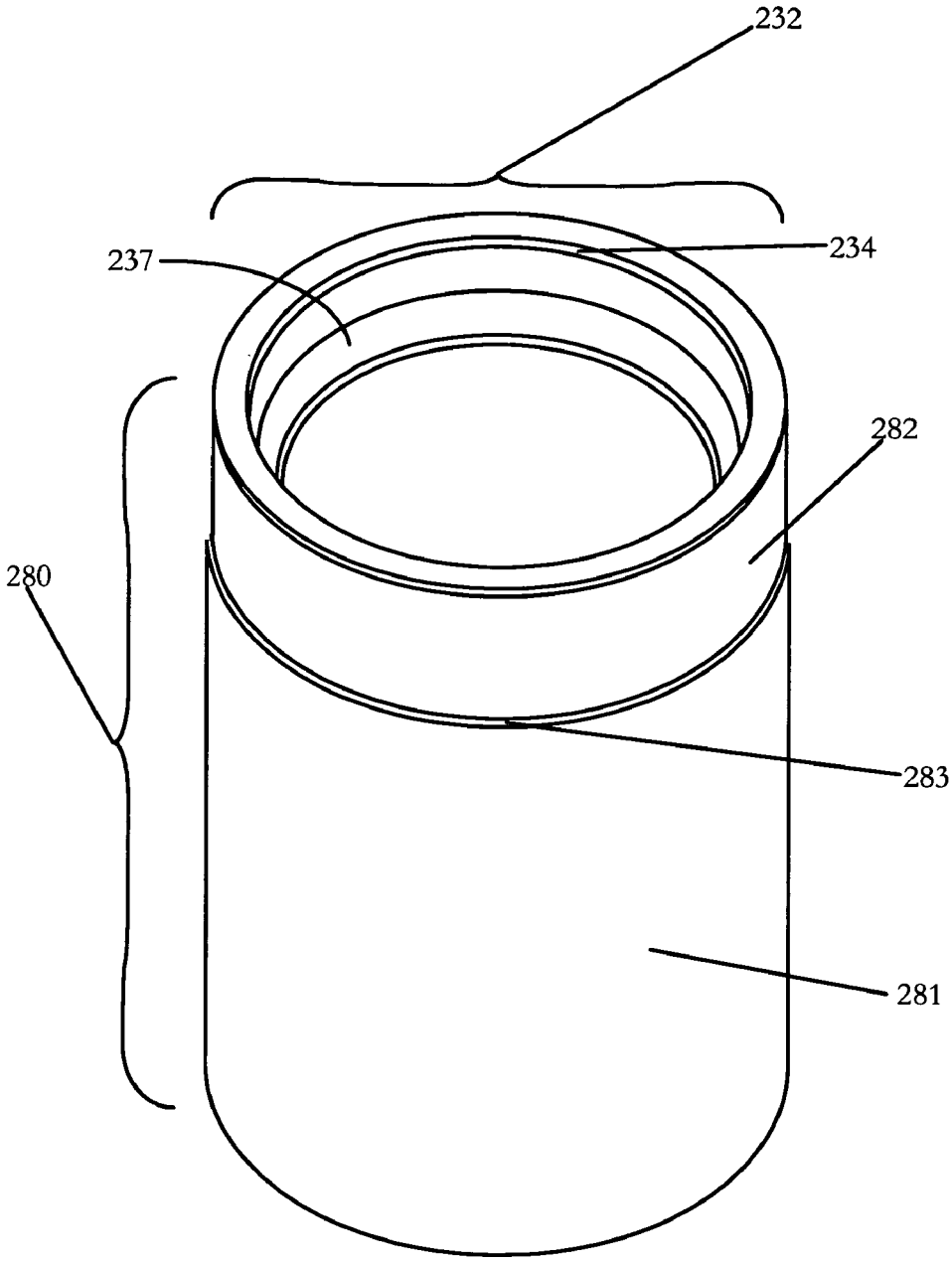
FIG. 27 depicts a perspective view of another preferred embodiment of a leakdown plunger.

FIG. 27 depicts the second plunger opening 232 of the embodiment depicted in FIG. 25. The second plunger opening 232 is shown with a second chamfered plunger surface 234. However, those with skill in the art will appreciate that the second plunger opening 232 may be fabricated without the second chamfered plunger surface 234. The second plunger opening 232 is provided with a second annular plunger surface 237.

Figure 28:
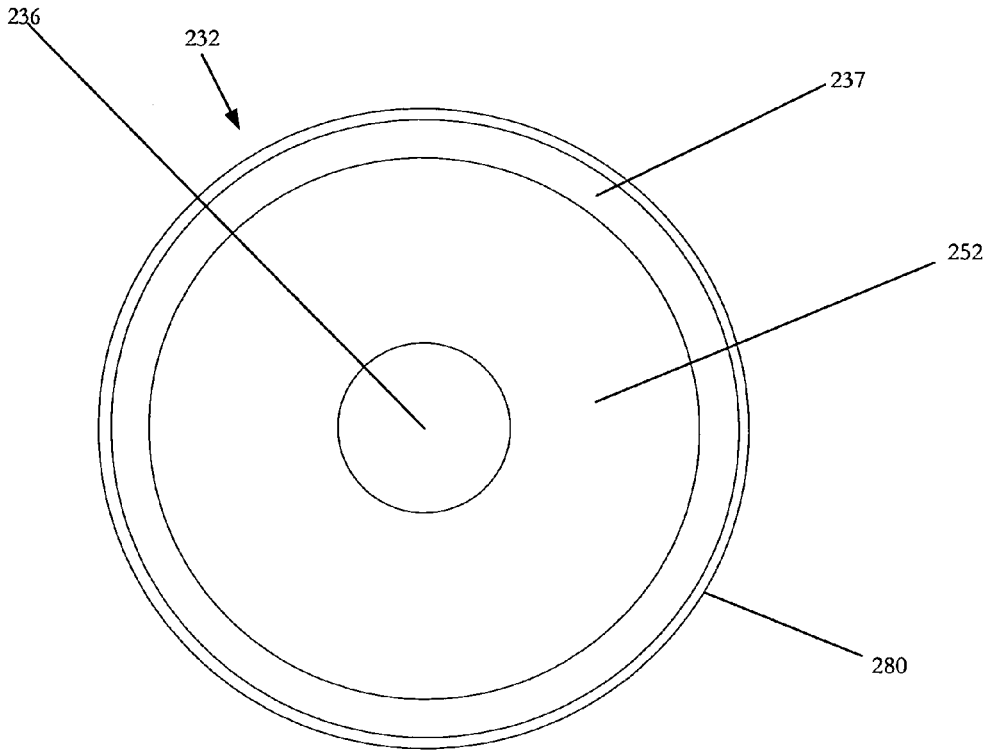
FIG. 28 depicts the top view of another preferred embodiment of a leakdown plunger.

FIG. 28 depicts a top view of the second plunger opening 232 of the embodiment depicted in FIG. 25. In FIG. 28, the second annular plunger surface 237 is shown in relation to the first inner conical plunger surface 252 and the plunger hole 236. As shown in FIG. 28, the plunger hole 236 is concentric relative to the outer plunger surface 280 and the annulus formed by the second annular plunger surface 237.

Referring now to FIG. 23, the outer plunger surface 280 encloses an inner plunger surface 250. The inner plunger surface 250 includes a plurality of surfaces. In the alternative embodiment depicted in FIG. 23, the inner plunger surface 250 includes a first inner cylindrical surface 256. The first inner cylindrical surface 256 is located adjacent to the first annular plunger surface 235. The first annular plunger surface 235 is located adjacent to a rounded plunger surface 251 that defines a plunger hole 236. Those skilled in the art will appreciate that the rounded plunger surface 251 need not be rounded, but may be flat. The rounded plunger surface 251 is located adjacent to a first inner conical plunger surface 252, which is located adjacent to a second inner cylindrical surface 253. The second inner cylindrical surface 253 is located adjacent to a second inner conical plunger surface 254, which is located adjacent to a third inner cylindrical plunger surface 255. The third inner cylindrical plunger surface 255 is located adjacent to the second annular plunger surface 237, which is located adjacent to the fourth inner cylindrical surface 257.

The inner plunger surface 250 includes a plurality of diameters. As shown in FIG. 25, the first inner cylindrical plunger surface 256 is provided with a first inner diameter 261, the third inner cylindrical plunger surface 255 is provided with a third inner diameter 263, and the fourth cylindrical plunger surface 257 is provided with a fourth inner diameter 264. In the embodiment depicted, the third inner diameter 263 is smaller than the fourth inner diameter 264.

FIG. 29 depicts an embodiment of the leakdown plunger 210 within another body cooperating with a plurality of inserts. The undercut plunger surface 282 preferably cooperates with another body, such as a lash adjuster body or a valve lifter, to form a leakdown path 293. FIG. 29 depicts an embodiment of the leakdown plunger 210 within a lash adjuster body 110; however, those skilled in the art will appreciate that the leakdown plunger 210 may be inserted within other bodies, such as roller followers and valve lifters.

As shown in FIG. 29, in the preferred embodiment, the undercut plunger surface 282 is configured to cooperate with the inner lash adjuster surface 140 of a lash adjuster body 110. The undercut plunger surface 282 and the inner lash adjuster surface 140 of the lash adjuster body 110 cooperate to define a leakdown path 293 for a liquid such as a lubricant.

The embodiment depicted in FIG. 29 is further provided with a cylindrical plunger surface 281. The cylindrical plunger surface 281 cooperates with the inner lash adjuster surface 140 of the lash adjuster body 110 to provide a first chamber 238. Those skilled in the art will appreciate that the first chamber 238 functions as a high pressure chamber for a liquid, such as a lubricant.

The second plunger opening 232 is configured to cooperate with a socket, such as the socket 310. The socket 310 is configured to cooperate with a push rod 396. As shown in FIG. 29, the socket 310 is provided with a push rod cooperating surface 335. The push rod cooperating surface 335 is configured to function with a push rod 396. Those skilled in the art will appreciate that the push rod 396 cooperates with the rocker arm (not shown) of an internal combustion engine (not shown).

The socket 310 cooperates with the leakdown plunger 210 to define at least in part a second chamber 239 within the inner plunger surface 250. Those skilled in the art will appreciate that the second chamber 239 may advantageously function as a reservoir for a lubricant. The inner plunger surface 250 of the leakdown plunger 210 functions to increase the quantity of retained fluid in the second chamber 239 through the damming action of the second inner conical plunger surface 254.

The socket 310 is provided with a plurality of passages that function to fluidly communicate with the lash adjuster cavity 130 of the lash adjuster body 110. In the embodiment depicted in FIG. 29, the socket 310 is provided with a socket passage 337 and a plunger reservoir passage 338. The plunger reservoir passage 338 functions to fluidly connect the second chamber 239 with the lash adjuster cavity 130 of the lash adjuster body 110. As shown in FIG. 29, the socket passage 337 functions to fluidly connect the socket 310 and the lash adjuster cavity 130 of the lash adjuster body 110.

FIGS. 30 to 34 illustrate the presently preferred method of fabricating a leakdown plunger. FIGS. 30 to 34 depict what is known in the art as "slug progressions" that show the fabrication of the leakdown plunger 210 of the present invention from a rod or wire to a finished or near-finished body. In the slug progressions shown herein, pins are shown on the punch side; however, those skilled in the art will appreciate that the pins can be switched to the die side without departing from the scope of the present invention.

The leakdown plunger 210 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 30:
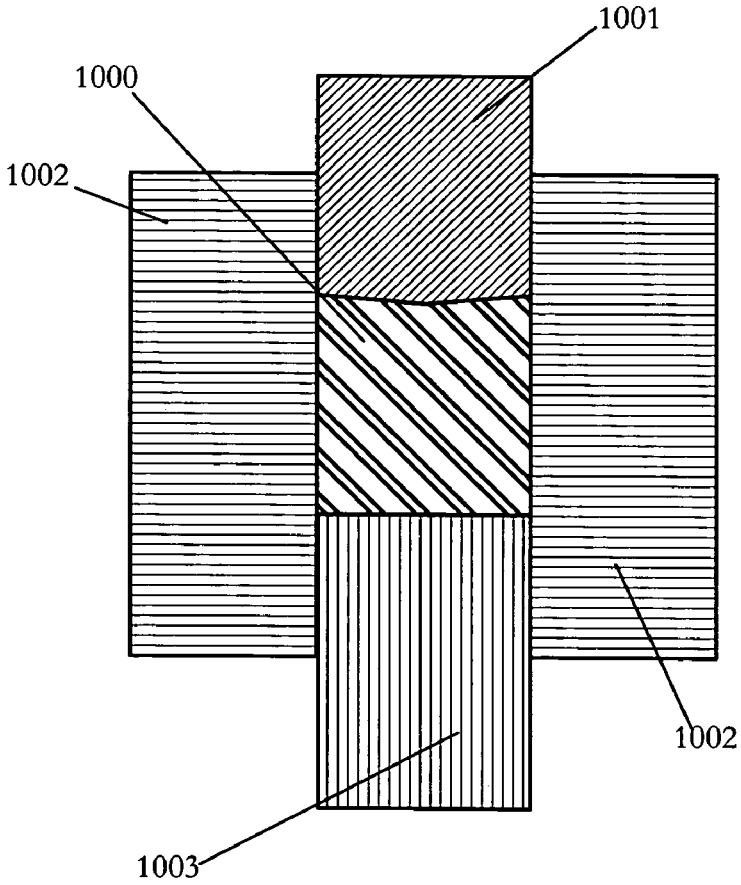
FIG. 30–34 depict a preferred method of fabricating a leakdown plunger.

The process of forging the leakdown plunger 210 an embodiment of the present invention begins with a metal wire or metal rod 1000 which is drawn to size. The ends of the wire or rod are squared off As shown in FIG. 30, this is accomplished through the use of a first punch 1001, a first die 1002, and a first knock out pin 1003.

Figure 31:
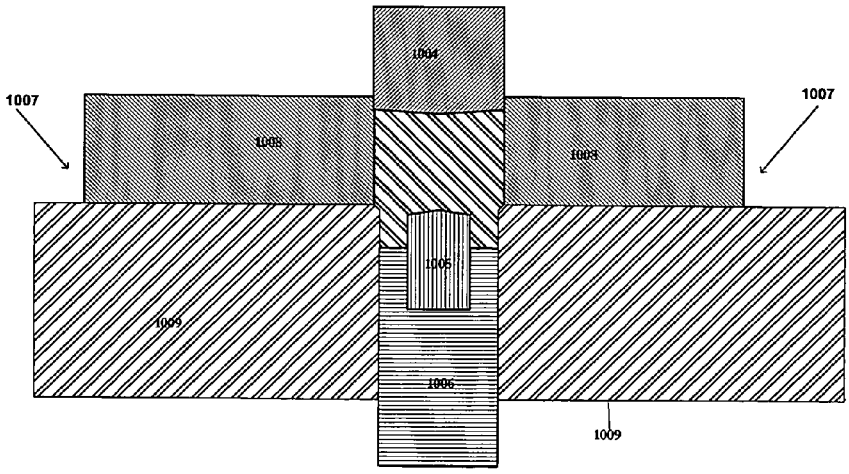

After being drawn to size, the wire or rod 1000 is run through a series of dies or extrusions. As depicted in FIG. 31, the fabrication of the second plunger opening 232 and the outer plunger surface 280 is preferably commenced through use of a second punch 1004, a second knock out pin 1005, a first sleeve 1006, and a second die 1007. The second plunger opening 232 is fabricated through use of the second knock out pin 1005 and the first sleeve 1006. The second die 1007 is used to fabricate the outer plunger surface 280. As shown in FIG. 31, the second die 1007 is composed of a second die top 1008 and a second die rear 1009. In the preferred forging process, the second die rear 1009 is used to form the undercut plunger surface 282 and the conical plunger surface 283.

Figure 32:
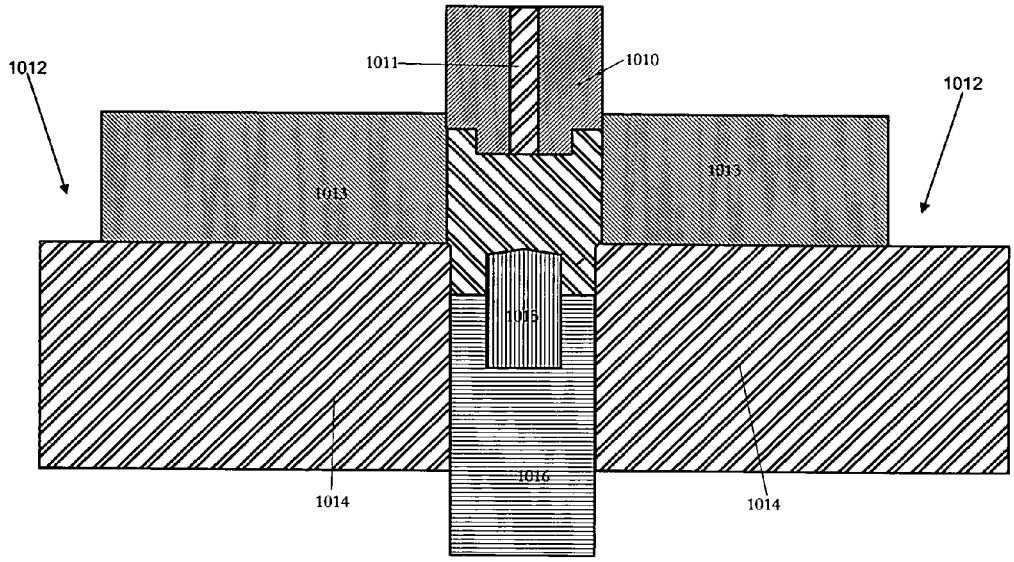

As depicted in FIG. 32, the first plunger opening 231 is fabricated through use of a third punch 1010. Within the third punch 1010 is a first pin 1011. The third punch 1010 and the first pin 1011 are used to fabricate at least a portion of the annular plunger surface 235. As shown in FIG. 32, it is desirable to preserve the integrity of the outer plunger surface 280 through use of a third die 1012. The third die 1012 is composed of a third die top 1013 and a third die rear 1014. Those skilled in the art will appreciate the desirability of using a third knock out pin 1015 and a second sleeve 1016 to preserve the forging of the second opening.

Figure 33:
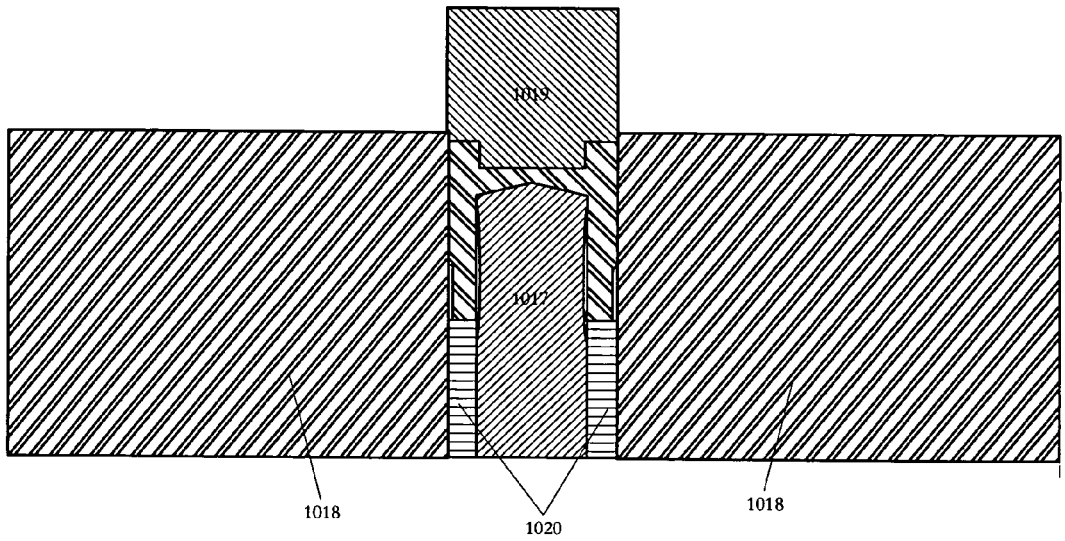

FIG. 33 depicts the forging of the inner plunger surface 250. As depicted, the inner plunger surface 250 is forged through use of a punch extrusion pin 1017. Those skilled in the art will appreciate that it is advantageous to preserve the integrity of the first plunger opening 231 and the outer plunger surface 280. This function is accomplished through use of a fourth die 1018 and a fourth knock out pin 1019. A punch stripper sleeve 1020 is used to remove the punch extrusion pin 1017 from the inner plunger surface 250.

Figure 34:
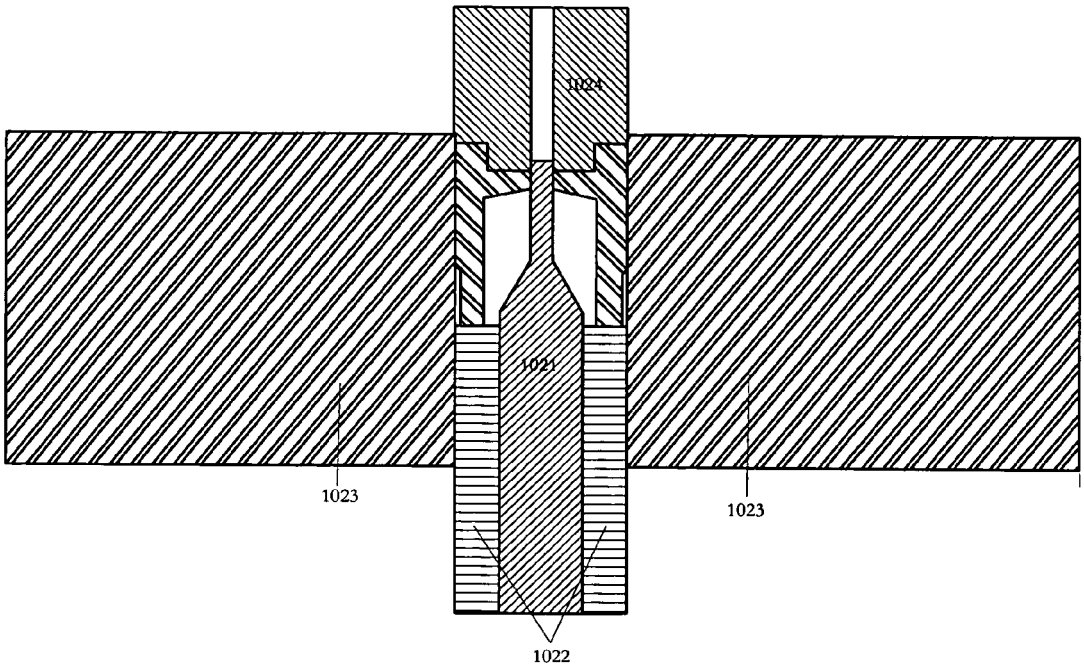

As shown in FIG. 34, the plunger hole 236 is fabricated through use of a piercing punch 1021 and a stripper sleeve 1022. To assure that other forging operations are not affected during the fabrication of the plunger hole 236, a fifth die 1023 is used around the outer plunger surface 280 and a tool insert 1024 is used at the first plunger opening 231.

Figure 35:
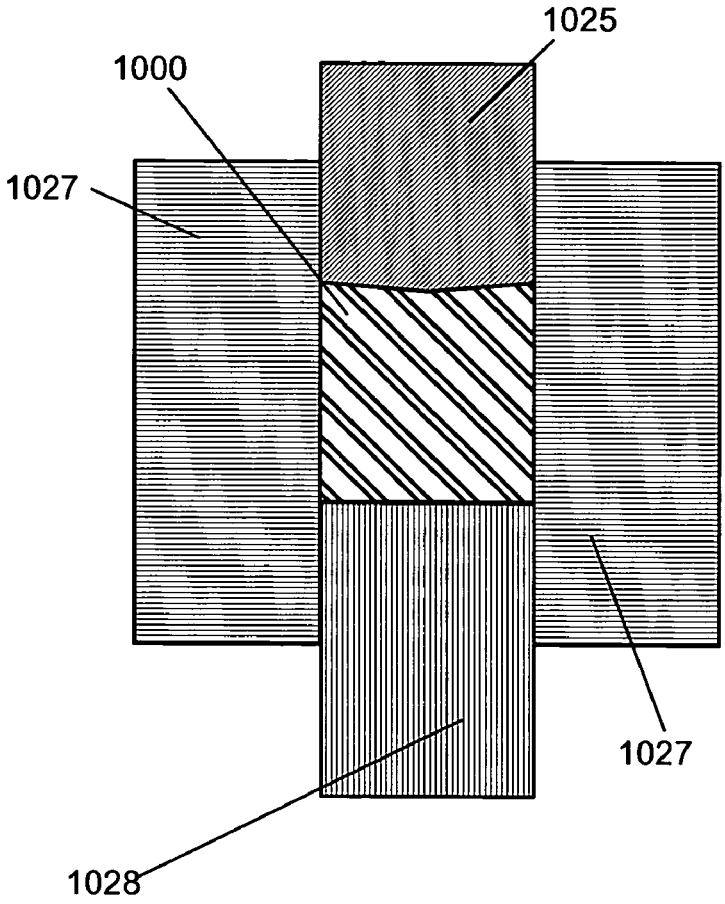
FIG. 35–39 depict an alternative method of fabricating a leakdown plunger.

FIGS. 35 to 39 illustrate an alternative method of fabricating a leakdown plunger. FIG. 35 depicts a metal wire or metal rod 1000 drawn to size. The ends of the wire or rod 1000 are squared off through the use of a first punch 1025, a first die 1027, and a first knock out pin 1028.

Figure 36:
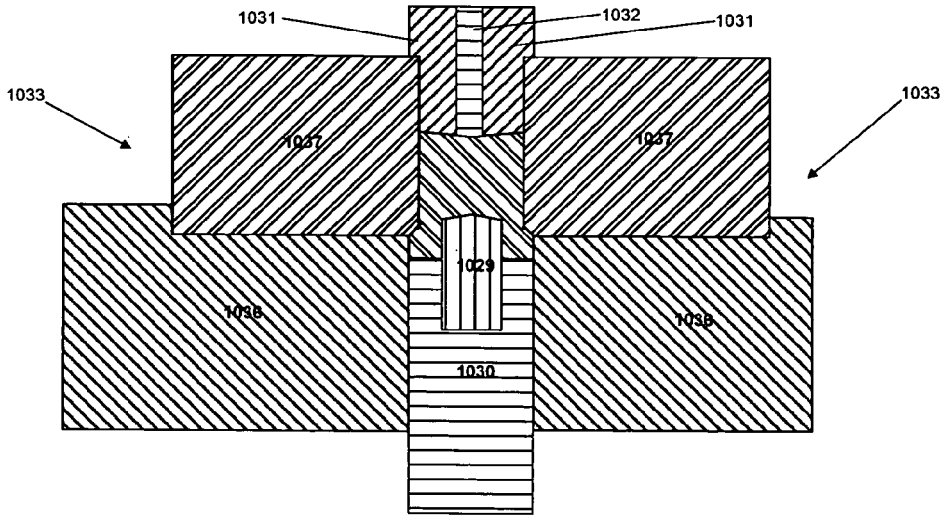

As depicted in FIG. 36, the fabrication of the first plunger opening 231, the second plunger opening 232, and the outer plunger surface 280 is preferably commenced through use of a punch pin 1029, a first punch stripper sleeve 1030, second knock out pin 1031, a stripper pin 1032, and a second die 1033. The first plunger opening 231 is fabricated through use of the second knock out pin 1031. The stripper pin 1032 is used to remove the second knock out pin 1031 from the first plunger opening 231.

The second plunger opening 232 is fabricated, at least in part, through the use of the punch pin 1029. A first punch stripper sleeve 1030 is used to remove the punch pin 1029 from the second plunger opening 232. The outer plunger surface 280 is fabricated, at least in part, through the use of a second die 1033. The second die 1033 is composed of a second die top 1036 and a second die rear 1037.

Figure 37:
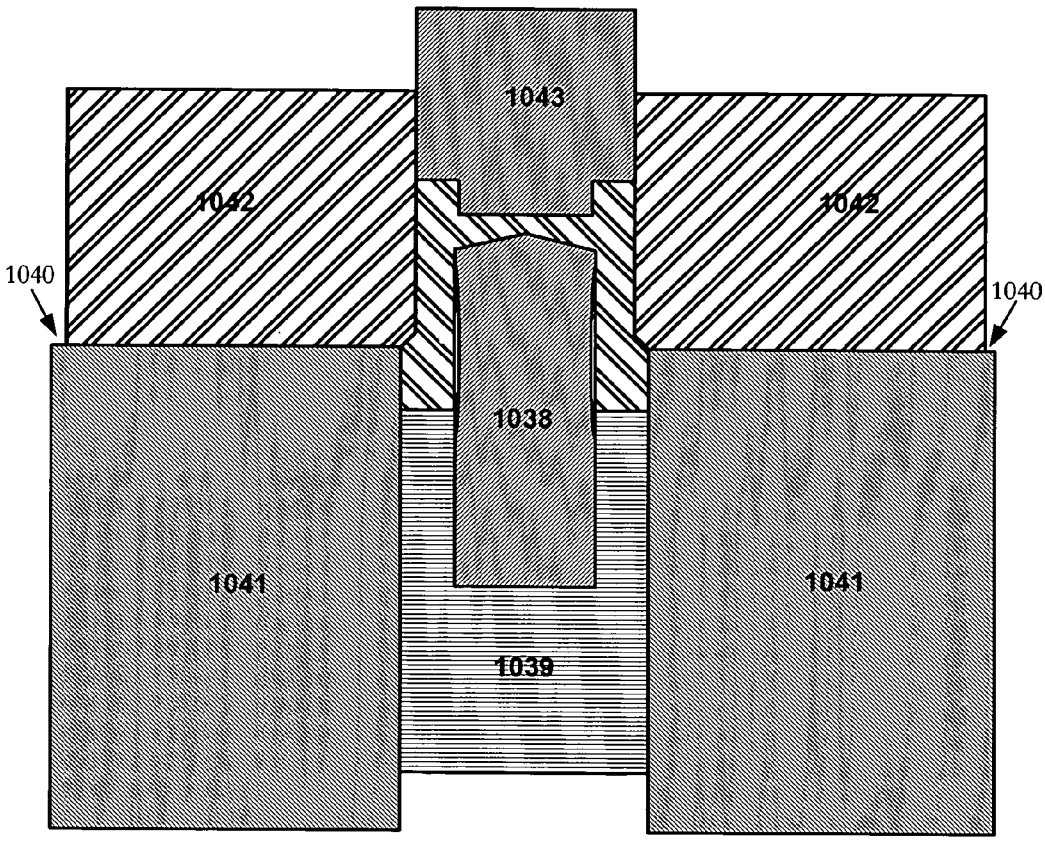

FIG. 37 depicts the forging of the inner plunger surface 250. As depicted, the inner plunger surface 250 is forged through the use of an extrusion punch 1038. A second punch stripper sleeve 1039 is used to remove the extrusion punch 1038 from the inner plunger surface 250.

Those skilled in the art will appreciate that it is advantageous to preserve the previous forging of the first plunger opening 231 and the outer plunger surface 280. A third knock out pin 1043 is used to preserve the previous forging operations on the first plunger opening 231. A third die 1040 is used to preserve the previous forging operations on the outer plunger surface 280. As depicted in FIG. 37, the third die 1040 is composed of a third die top 1041 and a third die rear 1042.

Figure 38:
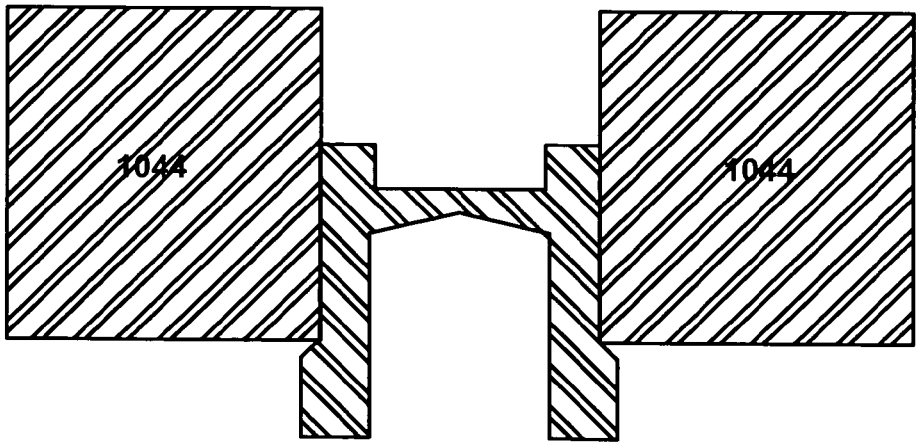

As depicted in FIG. 38, a sizing die 1044 is used in fabricating the second inner conical plunger surface 254 and the second inner cylindrical plunger surface 255. The sizing die 1044 is run along the outer plunger surface 280 from the first plunger opening 231 to the second plunger opening 232. This operation results in metal flowing through to the inner plunger surface 250.

Figure 39:
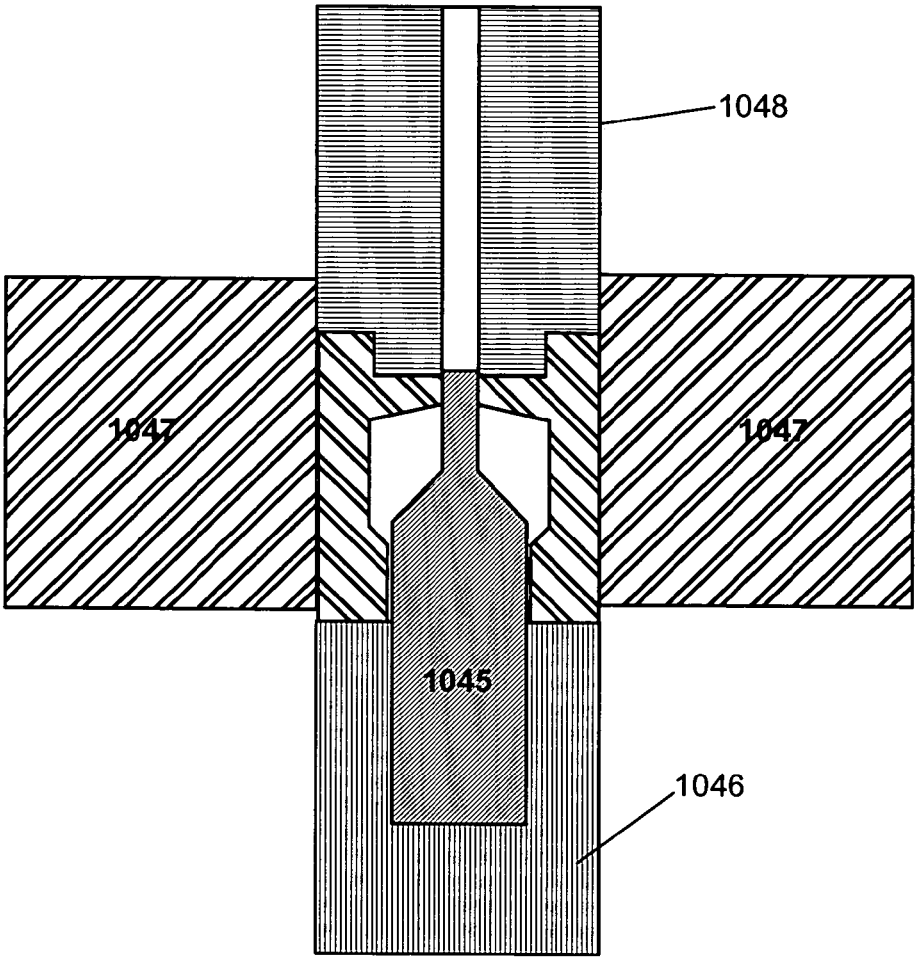

As shown in FIG. 39, the plunger hole 236 is fabricated through use of a piercing punch 1045 and a stripper sleeve 1046. The stripper sleeve 1046 is used in removing the piercing punch 1045 from the plunger hole 236. To assure that other forging operations are not affected during the fabrication of the plunger hole 236, a fourth die 1047 is used around the outer plunger surface 280 and a tool insert 1048 is used at the first plunger opening 231.

Figure 40:
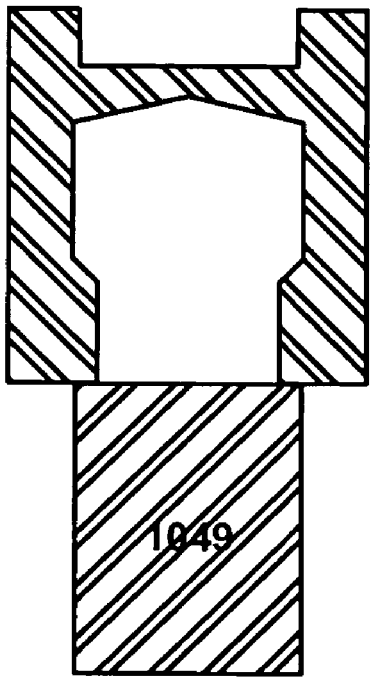
FIG. 40 depicts a step in an alternative method of fabricating a leakdown plunger.

Those skilled in the art will appreciate that further desirable finishing may be accomplished through machining. For example, an undercut plunger surface 282 may be fabricated and the second plunger opening 232 may be enlarged through machining. Alternatively, as depicted in FIG. 40, a shave punch 1049 may be inserted into the second plunger opening 232 and plow back excess material.

Figure 41:
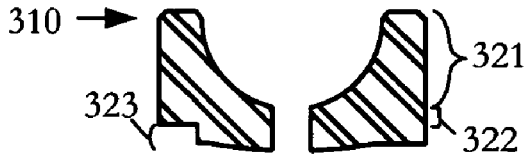
FIG. 41 depicts a preferred embodiment of a socket.
Figure 42:
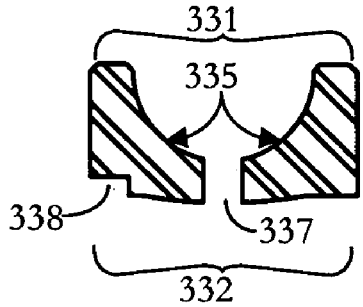
FIG. 42 depicts a preferred embodiment of a socket.
Figure 43:
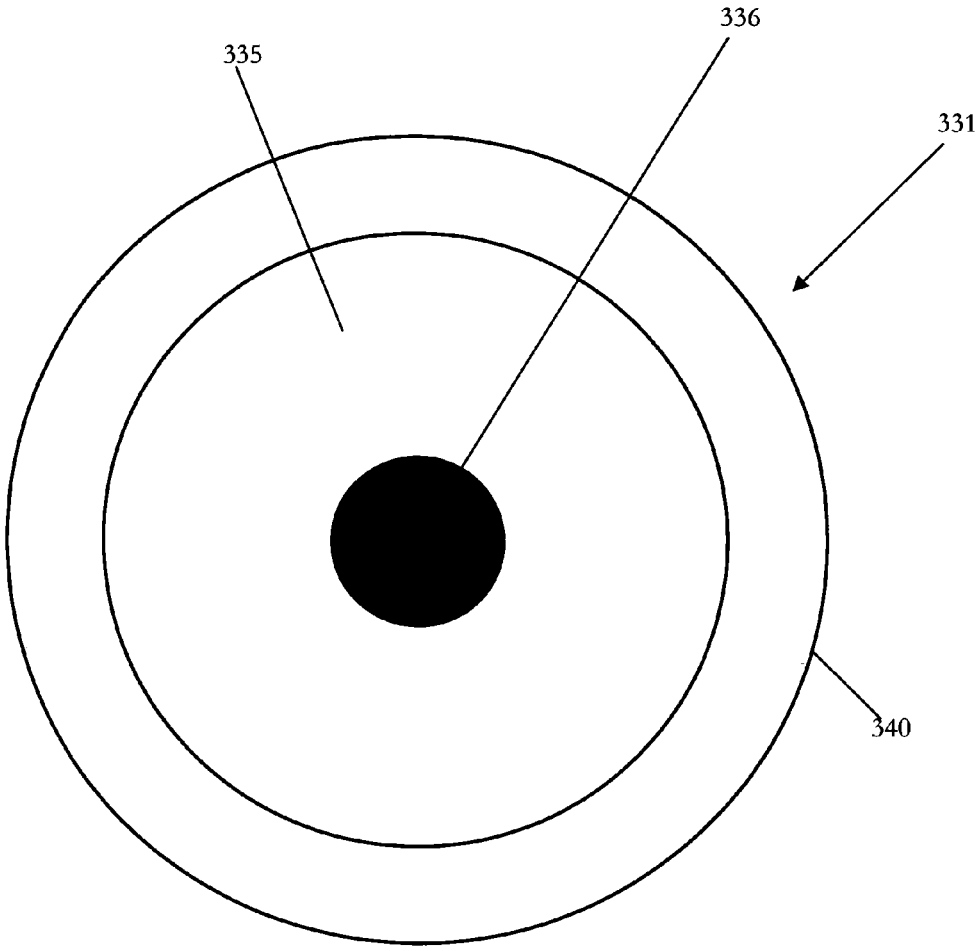
FIG. 43 depicts the top view of a surface of a socket.

FIGS. 41, 42, and 43, show a preferred embodiment of a socket 310. The socket 310 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the socket 310 is composed of pearlitic material. According to still another aspect of the present invention, the socket 310 is composed of austenitic material. According to another aspect of the present invention, the metal is a ferritic material.

The socket 310 is composed of a plurality of socket elements. According to one aspect of the present invention, the socket element is cylindrical in shape. According to another aspect of the present invention, the socket element is conical in shape. According to yet another aspect of the present invention, the socket element is solid. According to still another aspect of the present invention, the socket element is hollow.

FIG. 41 depicts a cross-sectional view of the socket 310 composed of a plurality of socket elements. FIG. 41 shows the socket, generally designated 310. The socket 310 functions to accept a liquid, such as a lubricant and is provided with a plurality of surfaces and passages. Referring now to FIG. 43, the first socket surface 331 functions to accommodate an insert, such as, for example, a push rod 396.

The socket 310 of the preferred embodiment is fabricated from a single piece of metal wire or rod and is described herein as a plurality of socket elements. As shown in FIG. 41, the socket 310 includes a first hollow socket element 321, a second hollow socket element 322, and a third hollow socket element 323. As depicted in FIG. 41, the first hollow socket element 321 is located adjacent to the second socket element 322. The second hollow socket element 322 is located adjacent to the third hollow socket element 323.

The first hollow socket element 321 functions to accept an insert, such as a push rod. The third hollow socket element 323 functions to conduct fluid. The second hollow socket element 322 functions to fluidly link the first hollow socket element 321 with the third hollow socket element 323.

Referring now to FIG. 42, the socket 310 is provided with a plurality of outer surfaces and inner surfaces. FIG. 42 depicts a cross sectional view of the socket 310 of the preferred embodiment of the present invention. As shown in FIG. 42, the preferred embodiment of the present invention is provided with a first socket surface 331. The first socket surface 331 is configured to accommodate an insert. The preferred embodiment is also provided with a second socket surface 332. The second socket surface 332 is configured to cooperate with an engine workpiece.

FIG. 43 depicts a top view of the first socket surface 331. As shown in FIG. 43, the first socket surface 331 is provided with a generally spherical push rod cooperating surface 335 defining a first socket hole 336. Preferably, the push rod cooperating surface 335 is concentric relative to the outer socket surface 340; however, such concentricity is not necessary.

In the embodiment depicted in FIG. 43, the first socket hole 336 fluidly links the first socket surface 331 with a socket passage 337 (shown in FIG. 42). The socket passage 337 is shaped to conduct fluid, preferably a lubricant. In the embodiment depicted in FIG. 42, the socket passage 337 is cylindrically shaped; however, those skilled in the art will appreciate that the socket passage 337 may assume any shape so long as it is able to conduct fluid.

Figure 44:
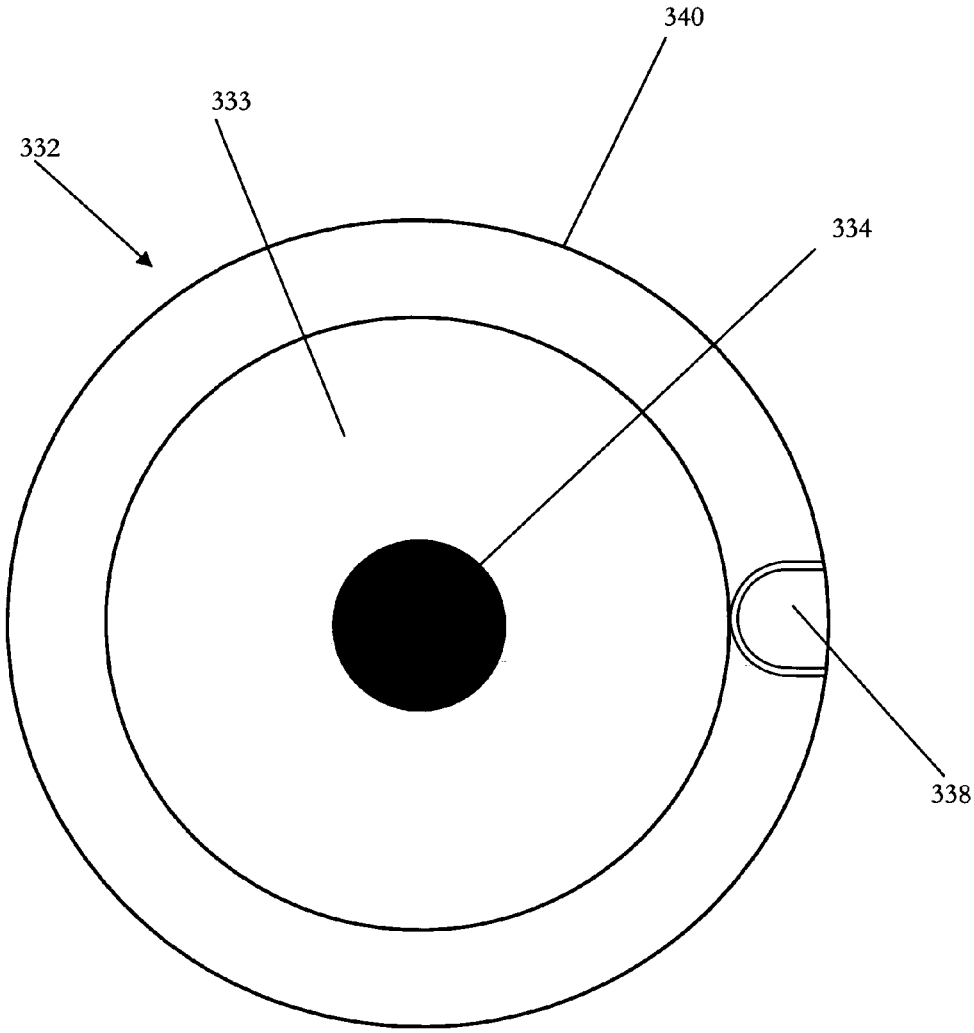
FIG. 44 depicts the top view of another surface of a socket.

FIG. 44 depicts a top view of the second socket surface 332. The second socket surface is provided with a plunger reservoir passage 338. The plunger reservoir passage 338 is configured to conduct fluid, preferably a lubricant. As depicted in FIG. 44, the plunger reservoir passage 338 of the preferred embodiment is generally cylindrical in shape; however, those skilled in the art will appreciate that the plunger reservoir passage 338 may assume any shape so long as it conducts fluid.

The second socket surface 332 defines a second socket hole 334. The second socket hole 334 fluidly links the second socket surface 332 with socket passage 337. The second socket surface 332 is provided with a protruding socket surface 333. In the embodiment depicted, the protruding socket surface 333 is generally curved. The protruding socket surface 333 is preferably concentric relative to the outer socket surface 340. However, those skilled in the art will appreciate that it is not necessary that the second socket surface 332 be provided with a protruding socket surface 333 or that the protruding socket surface 333 be concentric relative to the outer socket surface 340. The second socket surface 332 may be provided with any surface, and the protruding socket surface 333 of the preferred embodiment may assume any shape so long as the second socket surface 332 cooperates with the opening of an engine workpiece.

As shown in FIG. 5, the protruding socket surface 333 on the second socket surface 332 is located between a first flat socket surface 360 and a second flat socket surface 361. As shown therein, the protruding socket surface 333 is raised with respect to the first and second flat socket surfaces 360, 361.

Figure 45:
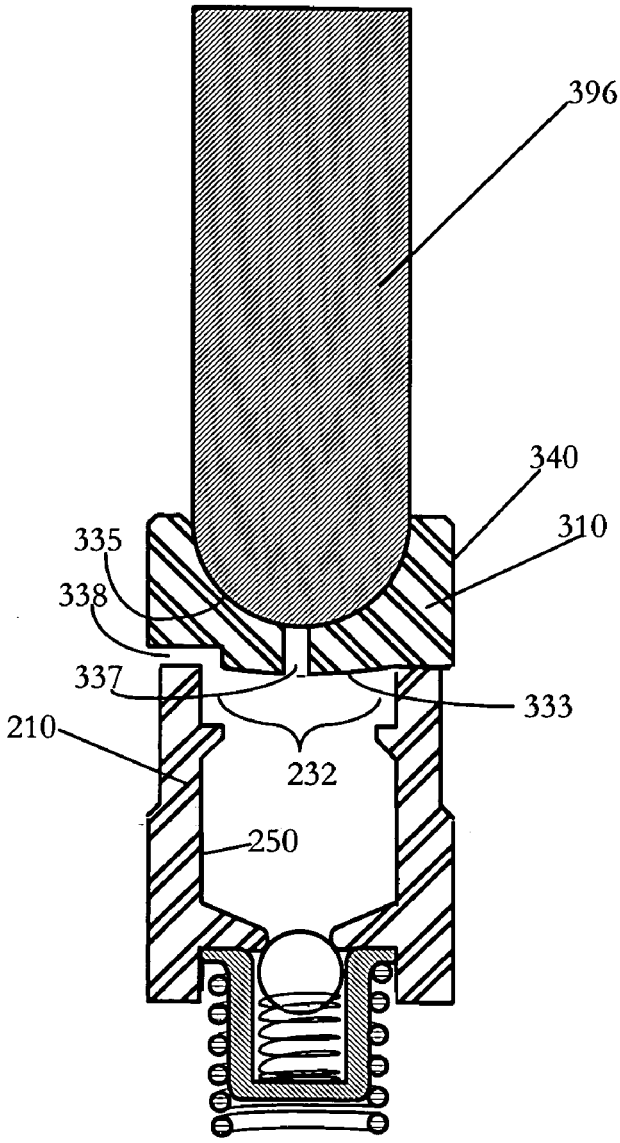
FIG. 45 depicts an embodiment of a socket accommodating an engine work piece.

Referring now to FIG. 45, the first socket surface 331 is depicted accommodating an insert. As shown in FIG. 45, that insert is a push rod 396. The second socket surface 332 is further depicted cooperating with an engine workpiece. In FIG. 45, that engine workpiece is the leakdown plunger 210. Those skilled in the art will appreciate that push rods other than the push rod 396 shown herein can be used without departing from the scope and spirit of the present invention. Furthermore, those skilled in the art will appreciate that leakdown plungers other than the leakdown plunger 210 shown herein can be used without departing from the scope and spirit of the present invention.

As depicted in FIG. 45, the protruding socket surface 333 preferably cooperates with the second plunger opening 232 of the leakdown plunger 210. According to one aspect of the present invention, the protruding socket surface 333 preferably corresponds to the second plunger opening 232 of the leakdown plunger 210. According to another aspect of the present invention, the protruding socket surface 333 preferably provides a closer fit between the second socket surface 332 of the socket 310 and second plunger opening 232 of the leakdown plunger 210.

In the socket 310 depicted in FIG. 45, a socket passage 337 is provided. The socket passage 337 preferably functions to lubricate the push rod cooperating surface 335. The embodiment depicted in FIG. 45 is also provided with a plunger reservoir passage 338. The plunger reservoir passage 338 is configured to conduct fluid, preferably a lubricant.

The plunger reservoir passage 338 performs a plurality of functions. According to one aspect of the present invention, the plunger reservoir passage 338 fluidly links the second plunger opening 232 of the leakdown plunger 210 and the outer socket surface 340 of the socket 310. According to another aspect of the present invention, the plunger reservoir passage 338 fluidly links the inner plunger surface 250 of the leakdown plunger 210 and the outer socket surface 340 of the socket 310.

Those skilled in the art will appreciate that the plunger reservoir passage 338 can be extended so that it joins socket passage 337 within the socket 310. However, it is not necessary that the socket passage 337 and plunger reservoir passage 338 be joined within the socket 310. As depicted in FIG. 45, the plunger reservoir passage 338 of an embodiment of the present invention is fluidly linked to socket passage 337. Those skilled in the art will appreciate that the outer socket surface 340 is fluidly linked to the first socket surface 331 in the embodiment depicted in FIG. 45.

Figure 46:
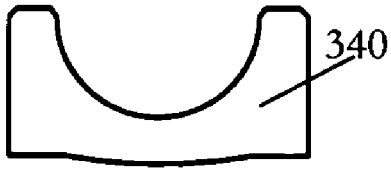
FIG. 46 depicts an outer surface of an embodiment of a socket.

As depicted in FIG. 46, the socket 310 of the preferred embodiment is provided with an outer socket surface 340. The outer socket surface 340 is configured to cooperate with the inner surface of an engine workpiece. The outer socket surface 340 of the presently preferred embodiment is cylindrically shaped. However, those skilled in the art will appreciate that the outer socket surface 340 may assume any shape so long as it is configured to cooperate with the inner surface of an engine workpiece.

Figure 47:
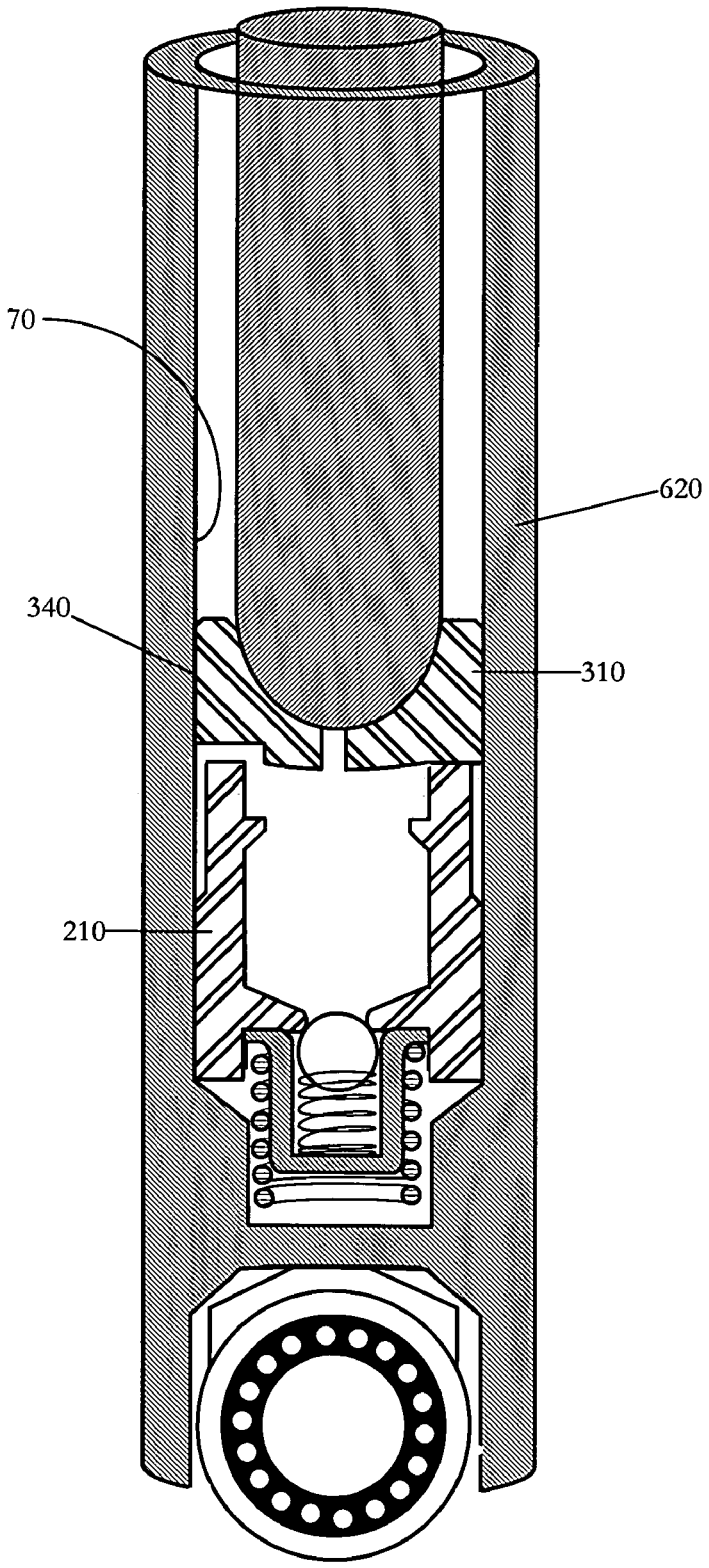
FIG. 47 depicts an embodiment of a socket cooperating with an engine work piece.

As FIG. 47 depicts, the outer socket surface 340 may advantageously be configured to cooperate with the inner surface of an engine workpiece. As shown in FIG. 47, the outer socket surface 340 is configured to cooperate with the second inner surface 70 of a valve lifter body 10. Those skilled in the art will appreciate that the outer socket surface 340 may advantageously be configured to cooperate with the inner surfaces of other lifter bodies.

Figure 48:
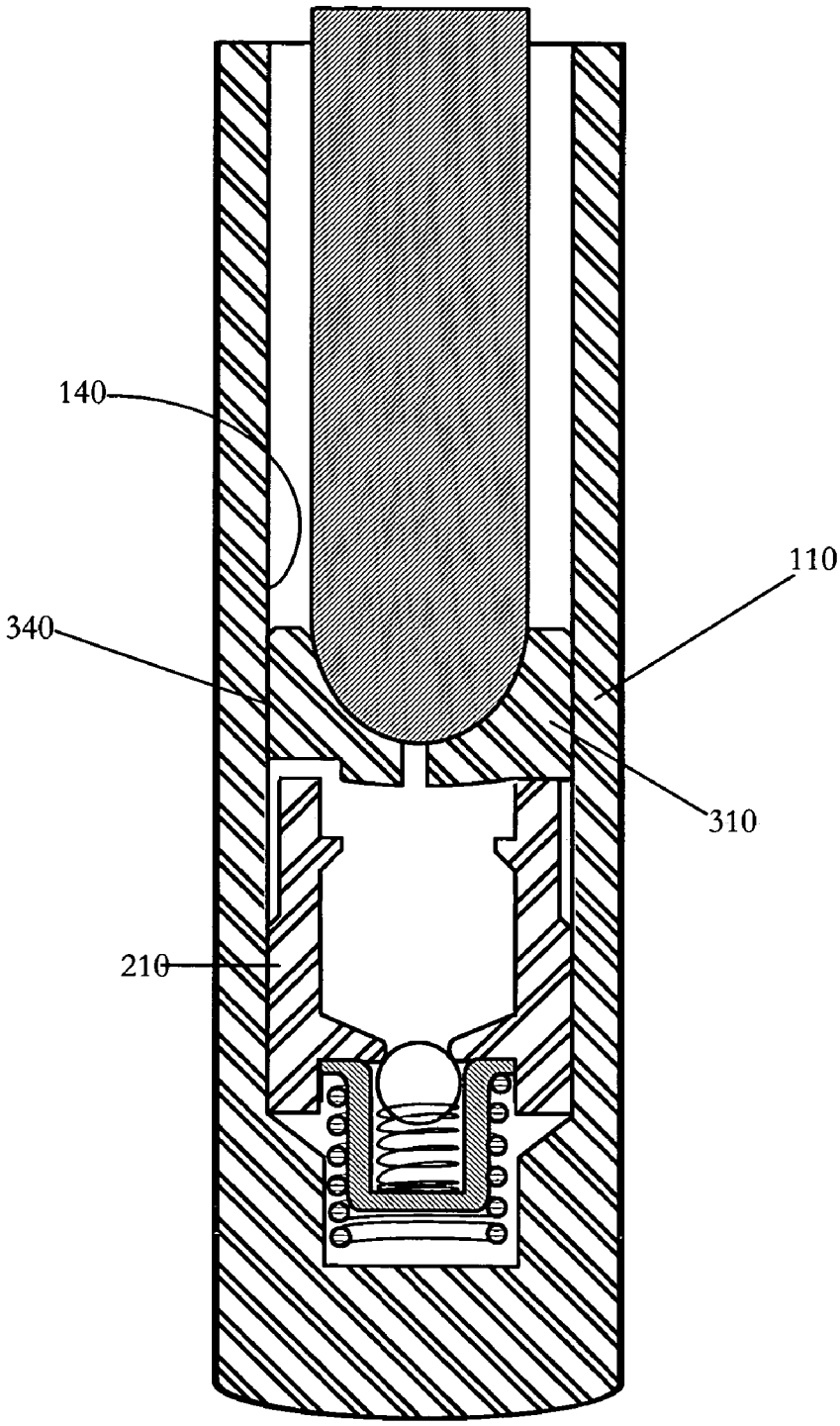
FIG. 48 depicts an embodiment of a socket cooperating with an engine work piece.

FIG. 48 depicts the outer socket surface 40 configured to cooperate with the inner surface of another workpiece. As shown in FIG. 48, the outer socket surface 340 is configured to cooperate with the inner surface of a lash adjuster body, such as the inner lash adjuster surface 140 of the lash adjuster body 110. As depicted in FIG. 12, the lash adjuster body 110, with the socket 310 of the present invention located therein, may be inserted into a roller follower body 410.

Referring now to FIG. 49 to FIG. 53, the presently preferred method of fabricating a metering socket 310 is disclosed. FIGS. 49 to 53 depict what is known in the art as a "slug progression" that shows the fabrication of the present invention from a rod or wire to a finished or near-finished socket body. In the slug progression shown herein, pins are shown on the punch side; however, those skilled in the art will appreciate that the pins can be switched to the die side without departing from the scope of the present invention.

The socket 310 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 49:
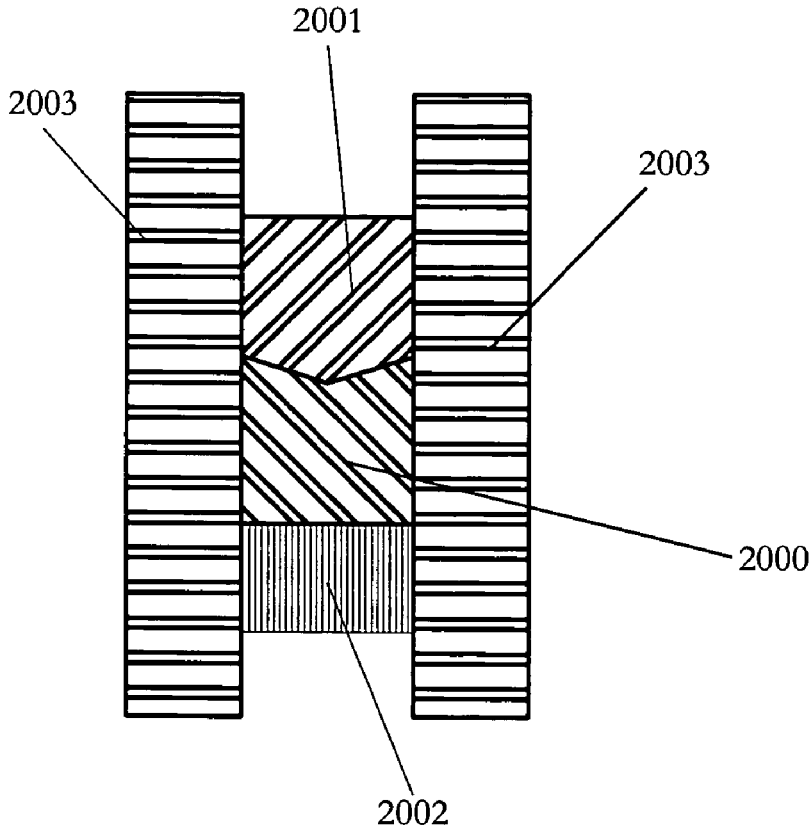
FIG. 49–53 depict a preferred method of fabricating a socket.

The process of forging an embodiment of the present invention begins with a metal wire or metal rod 2000 which is drawn to size. The ends of the wire or rod are squared off As shown in FIG. 49, this is accomplished through the use of a first punch 2001, a first die 2002, and a first knock out pin 2003.

Figure 50:
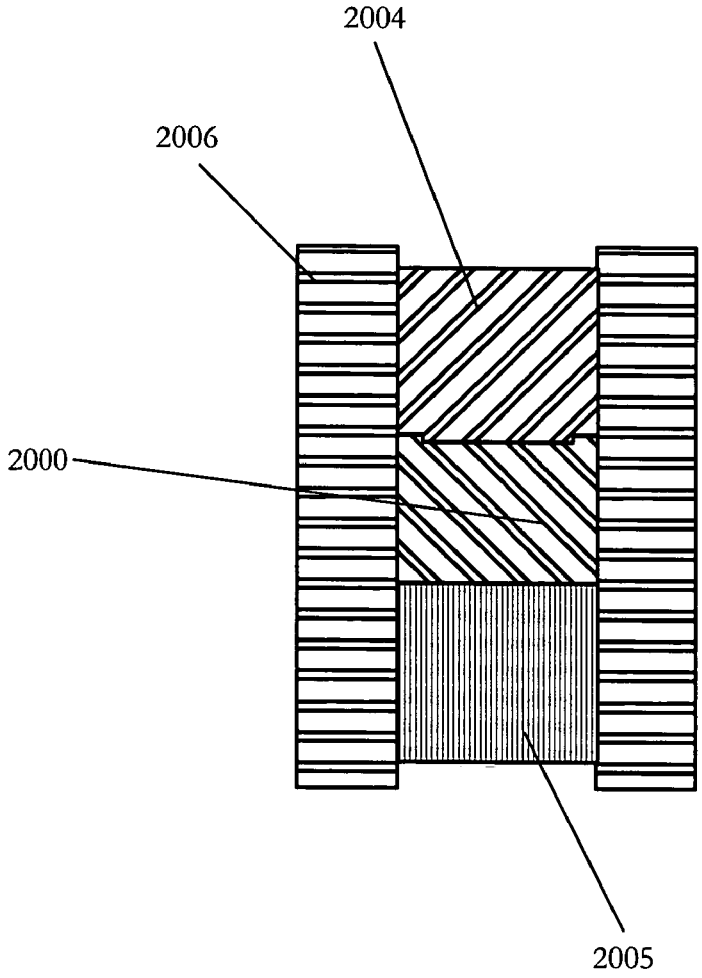

After being drawn to size, the wire or rod 2000 is run through a series of dies or extrusions. As depicted in FIG. 50, the fabrication of the first socket surface 331, the outer socket surface, and the second socket surface 332 is preferably commenced through use of a second punch 2004, a second knock out pin 2005, and a second die 2006. The second punch 2004 is used to commence fabrication of the first socket surface 331. The second die 2006 is used against the outer socket surface 340. The second knock out pin 2005 is used to commence fabrication of the second socket surface 332.

Figure 51:
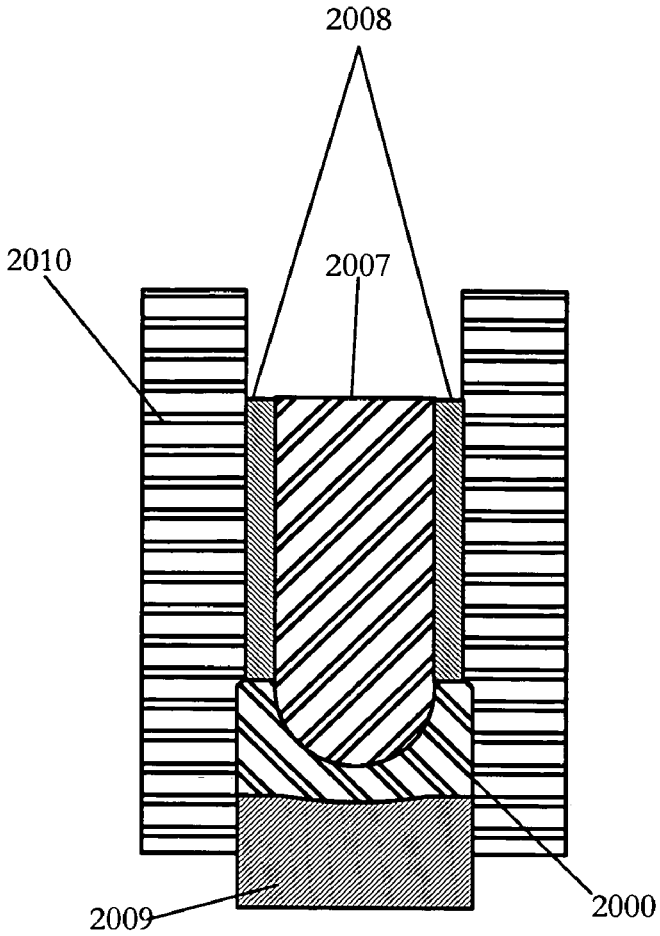

FIG. 51 depicts the fabrication of the first socket surface 331, the second socket surface 332, and the outer socket surface 340 through use of a third punch 2007, a first stripper sleeve 2008, a third knock out pin 2009, and a third die 2010. The first socket surface 331 is fabricated using the third punch 2007. The first stripper sleeve 2008 is used to remove the third punch 2007 from the first socket surface 331. The second socket surface 332 is fabricated through use of the third knock out pin 2009, and the outer socket surface 340 is fabricated through use of the third die 2010.

Figure 52:
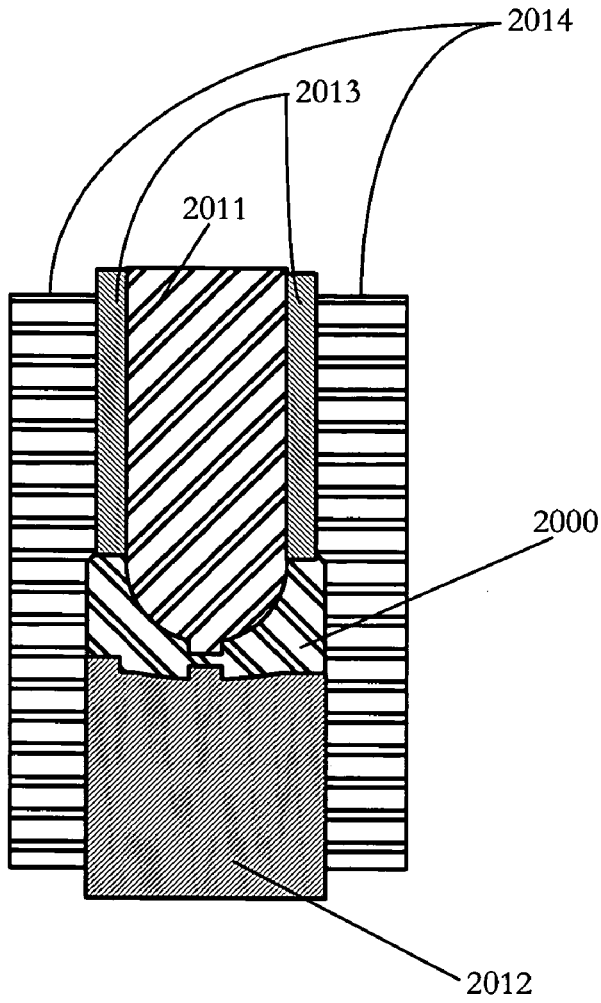

As depicted in FIG. 52, the fabrication of the socket passage 337 and plunger reservoir passage 338 is commenced through use of a punch pin 2011 and a fourth knock out pin 2012. A second stripper sleeve 2013 is used to remove the punch pin 2011 from the first socket surface 331. The fourth knock out pin 2012 is used to fabricate the plunger reservoir passage 338. A fourth die 2014 is used to prevent change to the outer socket surface 340 during the fabrication of the socket passage 337 and plunger reservoir passage 338.

Figure 53:
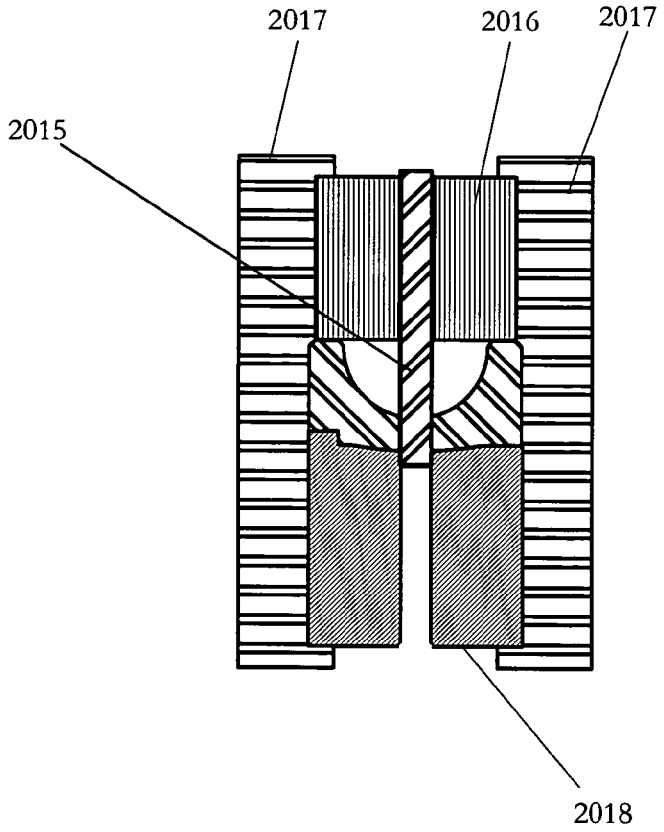
Figure 54:
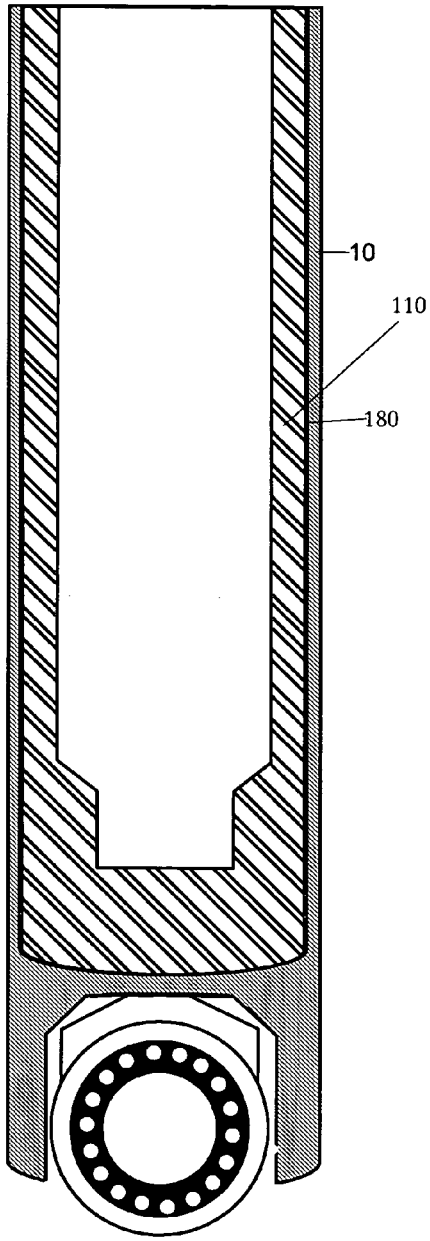
FIG. 54 depicts an alternative embodiment of the lash adjuster body within a valve lifter.

Referring now to FIG. 53, fabrication of socket passage 337 is completed through use of pin 2015. A third stripper sleeve 2016 is used to remove the pin 2015 from the first socket surface 331. A fifth die 2017 is used to prevent change to the outer socket surface 340 during the fabrication of socket passage 337. A tool insert 2018 is used to prevent change to the second socket surface 332 and the plunger reservoir passage 338 during the fabrication of socket passage 337.

Those skilled in the art will appreciate that further desirable finishing may be accomplished through machining. For example, socket passage 337 and plunger reservoir passage 338 may be enlarged and other socket passages may be drilled. However, such machining is not necessary.

Figure 55:
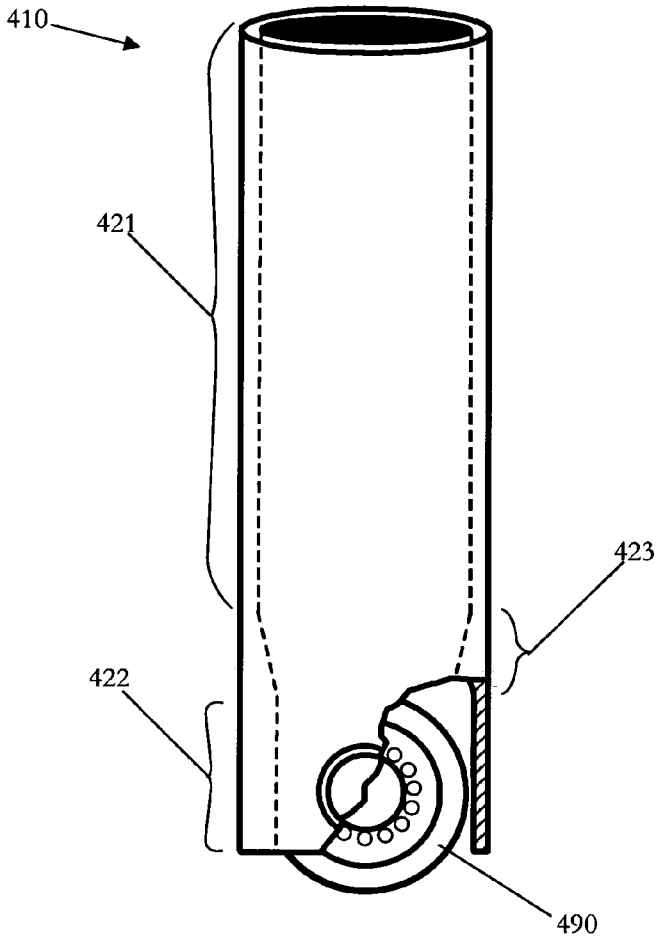
FIG. 55 depicts a preferred embodiment of a roller follower body.
Figure 56:
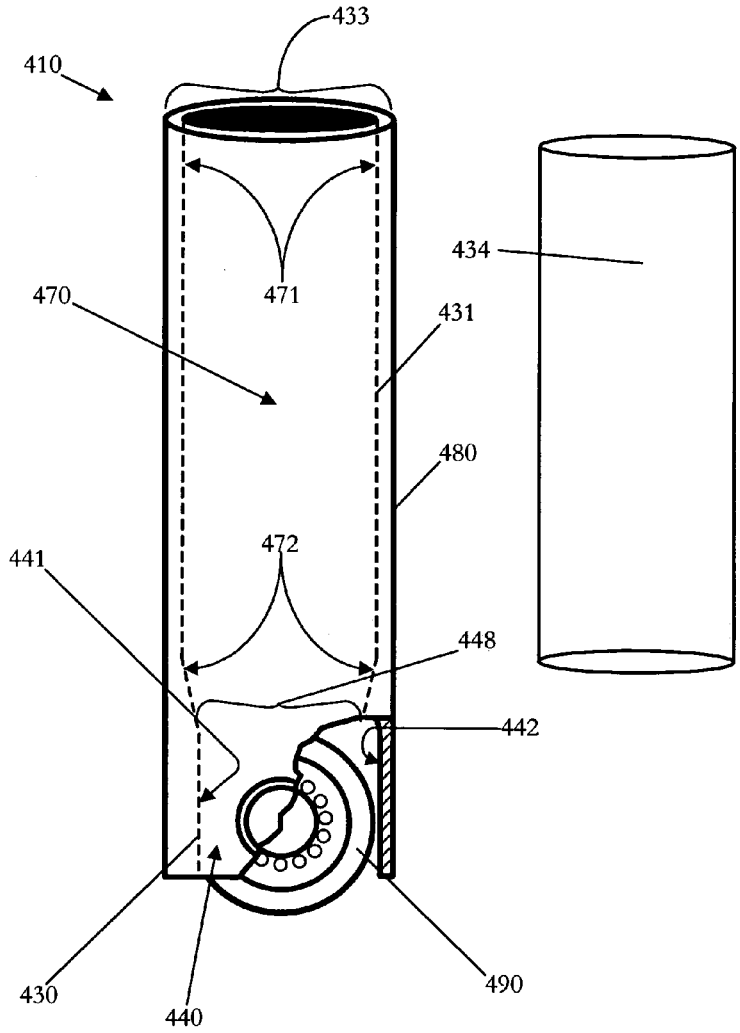
FIG. 56 depicts a preferred embodiment of a roller follower body.

Turning now to the drawings, FIGS. 55 and 56 show a preferred embodiment of the roller follower body 410. The roller follower body 410 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the roller follower body 410 is composed of pearlitic material. According to still another aspect of the present invention, the roller follower body 410 is composed of austenitic material. According to another aspect of the present invention, the metal is a ferritic material.

The roller follower body 410 is composed of a plurality of roller elements. According to one aspect of the present invention, the roller element is cylindrical in shape. According to another aspect of the present invention, the roller element is conical in shape. According to yet another aspect of the present invention, the roller element is solid. According to still another aspect of the present invention, the roller element is hollow.

FIG. 55 depicts a cross-sectional view of the roller follower body 410 composed of a plurality of roller elements. FIG. 55 shows the roller follower body, generally designated 410. The roller follower body 410 of the preferred embodiment is fabricated from a single piece of metal wire or rod and is described herein as a plurality of roller elements. The roller follower body 410 includes a first hollow roller element 421, a second hollow roller element 422, and a third hollow roller element 423. As depicted in FIG. 55, the first hollow roller element 421 is located adjacent to the third hollow roller element 423. The third hollow roller element 423 is located adjacent to the second hollow roller element 422.

The first hollow roller element 421 has a cylindrically shaped inner surface. The second hollow roller element 422 has a cylindrically shaped inner surface with a diameter which is smaller than the diameter of the first hollow roller element 421. The third hollow roller element 423 has an inner surface shaped so that an insert (not shown) rests against its inner surface "above" the second hollow roller element 422. Those skilled in the art will understand that, as used herein, terms like "above" and terms of similar import are used to specify general relationships between parts, and not necessarily to indicate orientation of the part or of the overall assembly. In the preferred embodiment, the third hollow roller element 423 has a conically or frustoconically shaped inner surface; however, an annularly shaped surface could be used without departing from the scope of the present invention.

The roller follower body 410 functions to accommodate a plurality of inserts. According to one aspect of the present invention, the roller follower body 410 accommodates a lash adjuster, such as the lash adjuster body 110. According to another aspect of the present invention, the roller follower body 410 accommodates a leakdown plunger, such as the leakdown plunger 210. According to another aspect of the present invention, the roller follower body 410 accommodates a push rod seat (not shown). According to yet another aspect of the present invention, the roller follower body 410 accommodates a socket, such as the metering socket 10.

The roller follower body 410 is provided with a plurality of outer surfaces and inner surfaces. FIG. 56 depicts a cross-sectional view of the roller follower body 410 of the preferred embodiment. As shown therein, the roller follower body 410 is provided with an outer roller surface 480 which is cylindrically shaped. The outer surface 480 encloses a plurality of cavities. As depicted in FIG. 56, the outer surface 480 encloses a first cavity 430 and a second cavity 431. The first cavity 430 includes a first inner surface 440. The second cavity 431 includes a second inner surface 470.

Figure 57A:
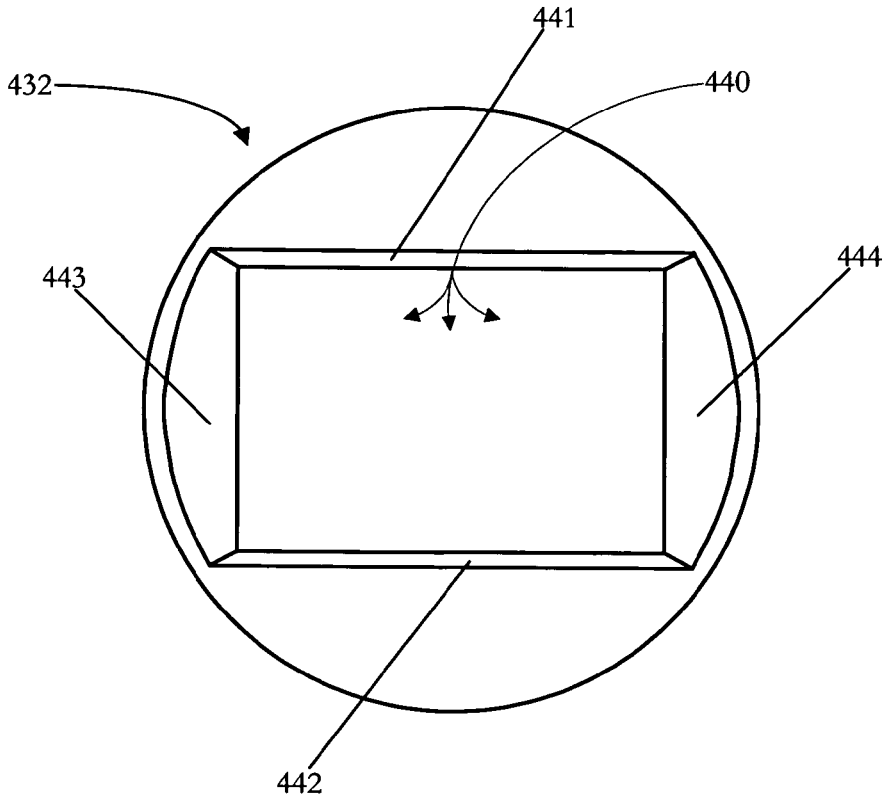
FIG. 57-*a* depicts the top view of a preferred embodiment of a roller follower body.
Figure 57B:
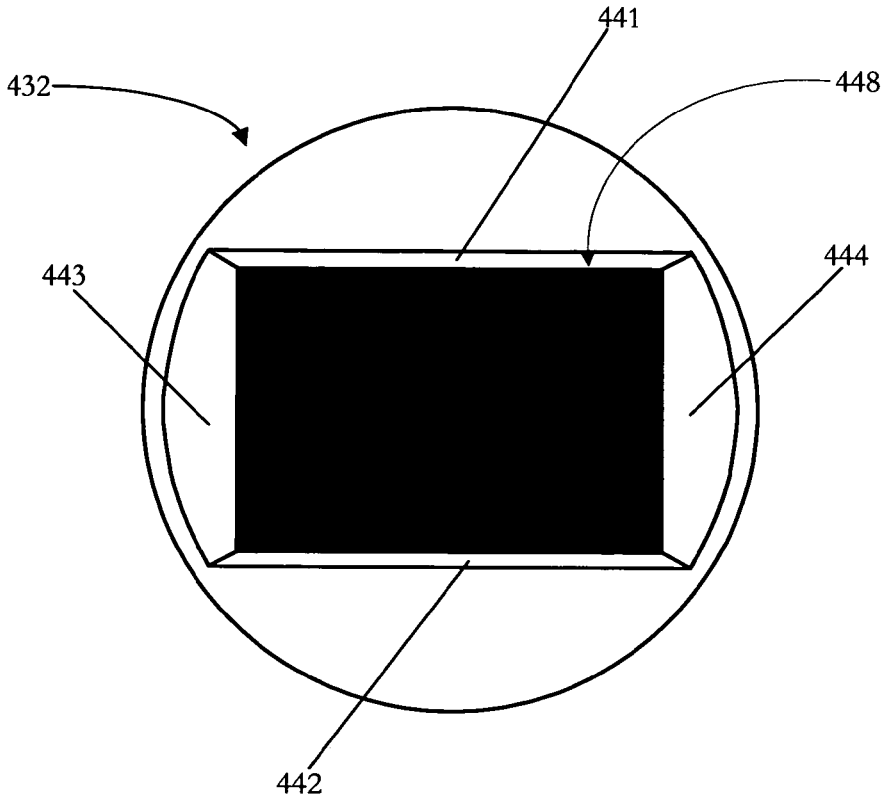

FIG. 57*a* and FIG. 57*b* depict top views and provide greater detail of the first roller cavity 430 of the preferred embodiment. As shown in FIG. 57*b*, the first roller cavity 430 is provided with a first roller opening 432 shaped to accept a cylindrical insert. Referring to FIG. 57*a*, the first inner roller surface 440 is configured to house a cylindrical insert 490, which, in the preferred embodiment of the present invention, functions as a roller. Those skilled in the art will appreciate that housing a cylindrical insert can be accomplished through a plurality of different configurations. In FIGS. 57*a* and 57*b*, the first inner roller surface 440 of the preferred embodiment includes a plurality of walls. As depicted in FIGS. 57*a* and 57*b*, the inner roller surface 440 defines a transition roller opening 448 which is in the shape of a polygon, the preferred embodiment being rectangular. The inner roller surface 440 includes opposing roller walls 441, 442 and opposing roller walls 443, 444. The first roller wall 441 and the second roller wall 442 are located generally on opposite sides of the transition roller opening 448. The transition roller opening 448 is further defined by the third and fourth roller walls 443, 444.

Referring now to FIG. 56, the second roller cavity 431 of the preferred embodiment includes a second roller opening 433 that is in a circular shape. The second roller cavity 431 is provided with a second inner roller surface 470 that is configured to house an inner body 434. In the preferred embodiment the inner body 434 is the lash adjuster body 110. The second inner roller surface 470 of the preferred embodiment is cylindrically shaped. Alternatively, the second inner roller surface 470 is conically or frustoconically shaped. As depicted in FIG. 56, the second inner roller surface 470 is a plurality of surfaces including a cylindrically shaped roller surface 471 adjacent to a conically or frustoconically shaped roller surface 472.

The present invention is fabricated through a plurality of processes. According to one aspect of the present invention, the roller follower body 410 is machined. According to another aspect of the present invention, the roller follower body 410 is forged. According to yet another aspect of the present invention, the roller follower body 410 is fabricated through casting. The preferred embodiment of the present invention is forged. As used herein, the term "forge," "forging," or "forged" is intended to encompass what is known in the art as "cold forming," "cold heading," "deep drawing," and "hot forging."

The roller follower body 410 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

The process of forging in the preferred embodiment begins with a metal wire or metal rod which is drawn to size. The ends of the wire or rod are squared off by a punch. After being drawn to size, the wire or rod is run through a series of dies or extrusions.

The second roller cavity 431 is extruded through use of a punch and an extruding pin. After the second roller cavity 431 has been extruded, the first roller cavity 430 is forged. The first roller cavity 430 is extruded through use of an extruding punch and a forming pin.

Alternatively, the roller follower body 410 is fabricated through machining. As used herein, machining means the use of a chucking machine, a drilling machine, a grinding machine, or a broaching machine. Machining is accomplished by first feeding the roller follower body 410 into a chucking machine, such as an ACME-Gridley automatic chucking machine. Those skilled in the art will appreciate that other machines and other manufacturers of automatic chucking machines can be used.

To machine the second roller cavity 431, the end containing the second roller opening 433 is faced so that it is substantially flat. The second roller cavity 431 is bored. Alternatively, the second roller cavity 431 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second roller cavity 431 is ground using an internal diameter grinding machine, such as a Heald grinding machine. Those skilled in the art will appreciate that the second roller cavity 431 can be ground using other grinding machines.

Those skilled in the art will appreciate that the other features of the present invention may be fabricated through machining. For example, the first roller cavity 430 can be machined. To machine the first roller cavity 430, the end containing the first roller opening 432 is faced so that it is substantially flat. The first roller cavity 430 is drilled and then the first roller opening 432 is broached using a broaching machine.

Figure 58:
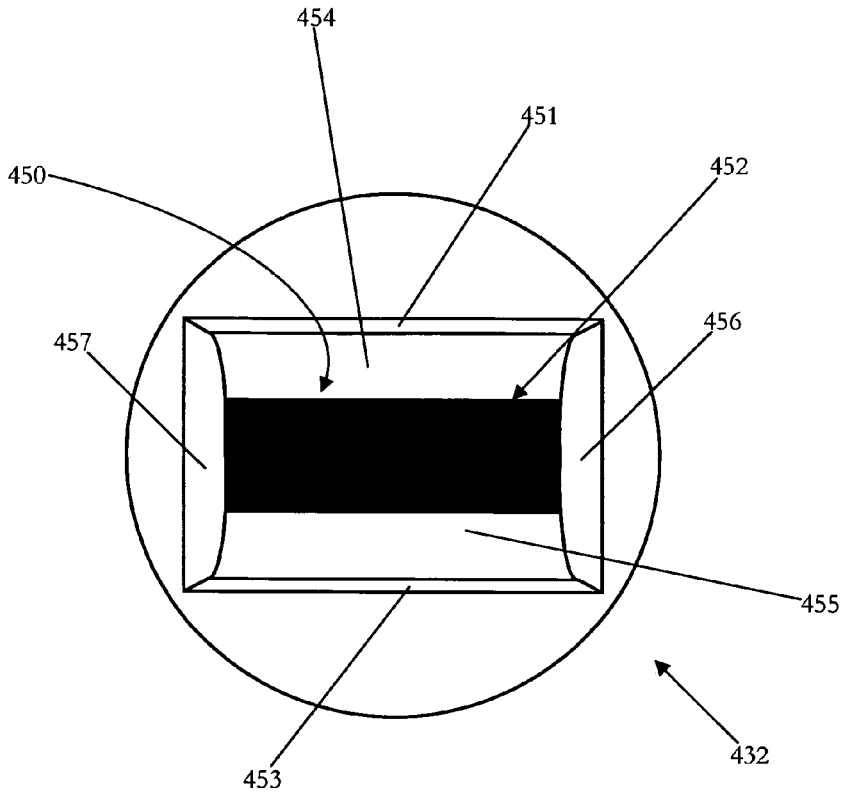
FIG. 58 depicts the top view of another preferred embodiment of a roller follower body.

In an alternative embodiment depicted in FIG. 58, the first roller cavity 430 is provided with a first inner roller surface 450 and first roller opening 432 shaped to accept a cylindrical insert 490. The first inner roller surface 450 defines a transition roller opening 452 and includes a plurality of curved surfaces and a plurality of walls. As depicted in FIG. 58, a fourth roller wall 451 is adjacent to a first curved roller surface 454. The first curved roller surface 454 and a second curved roller surface 455 are located on opposing sides of the transition roller opening 452. The second curved roller surface 455 is adjacent to a first roller wall 453. On opposing sides of the first and second roller walls 451, 453 are third and second roller walls 456, 457.

Figure 59:
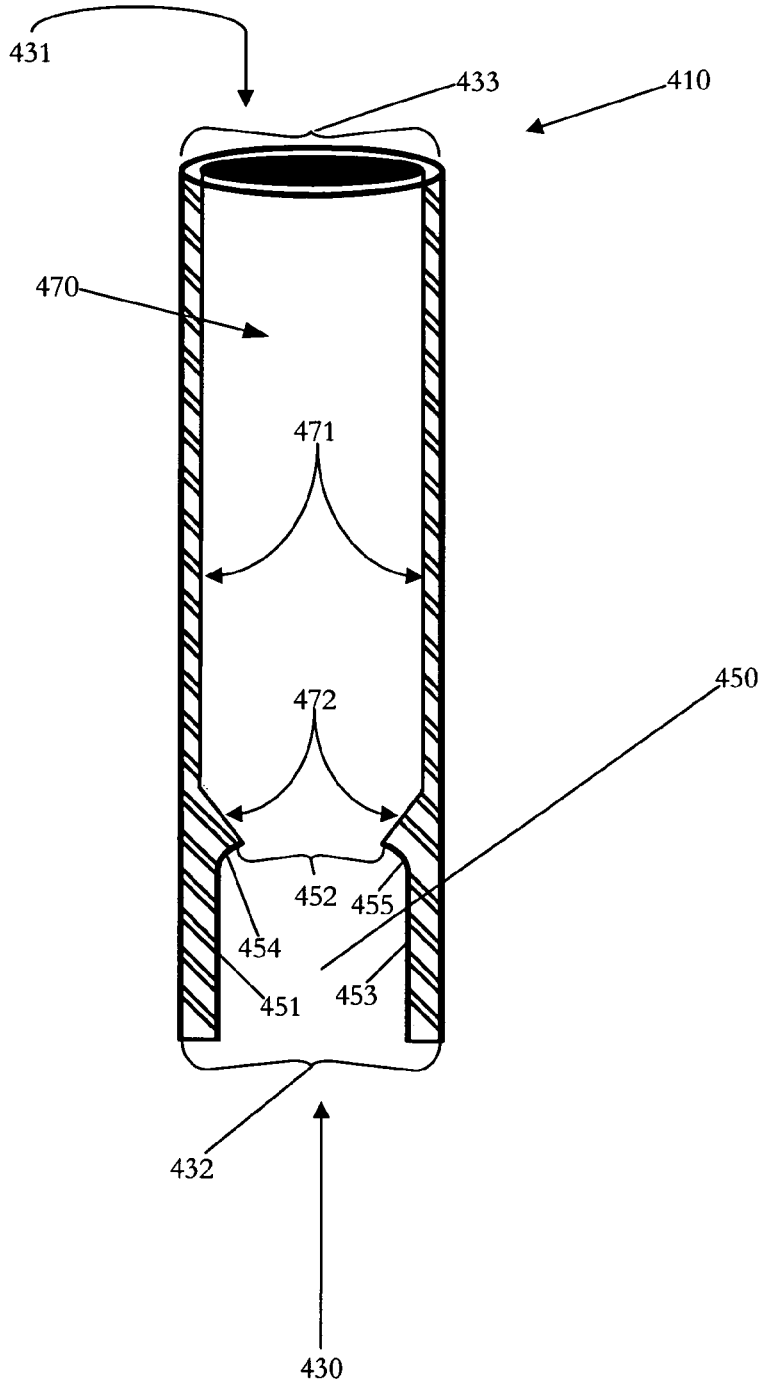
FIG. 59 depicts a second embodiment of a roller follower body.

FIG. 59 depicts a cross-sectional view of the roller follower body 410 with the first roller cavity 430 shown in FIG. 59. As shown in FIG. 59, the roller follower body 410 is also provided with a second cavity 431 which includes a second opening 433 which is in a circular shape. The second cavity 431 is provided with a second inner roller surface 470 which includes a plurality of surfaces. The second inner roller surface 470 includes a cylindrically shaped roller surface 471 and a frustoconically shaped roller surface 472.

Figure 60:
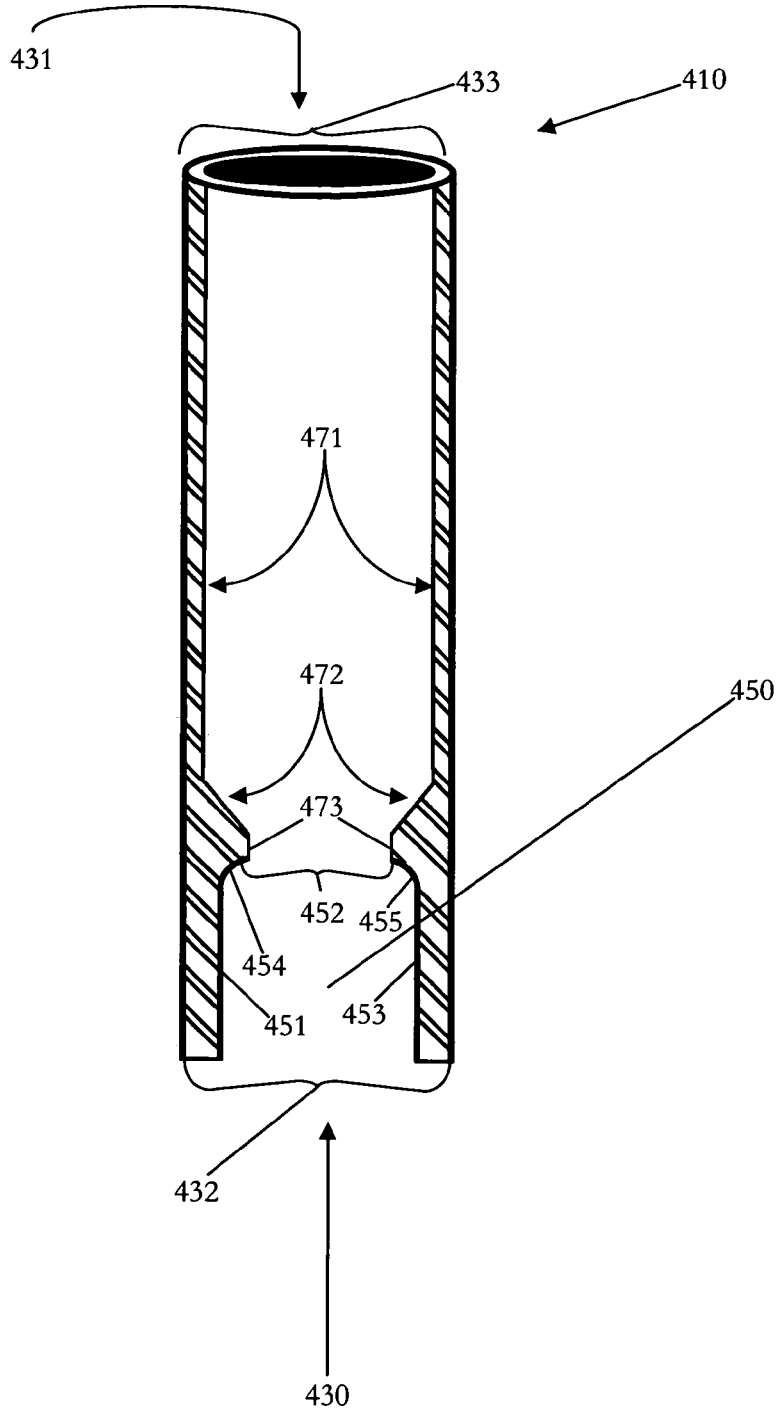
FIG. 60 depicts a third embodiment of a roller follower body.

Alternatively, the second inner roller surface 470 includes a plurality of cylindrical surfaces. As depicted in FIG. 60, the second inner roller surface 470 includes a first cylindrical roller surface 471 and a second cylindrical roller surface 473. The second inner roller surface 470 of the embodiment depicted in FIG. 60 also includes a frustoconical roller surface 472.

Figure 61:
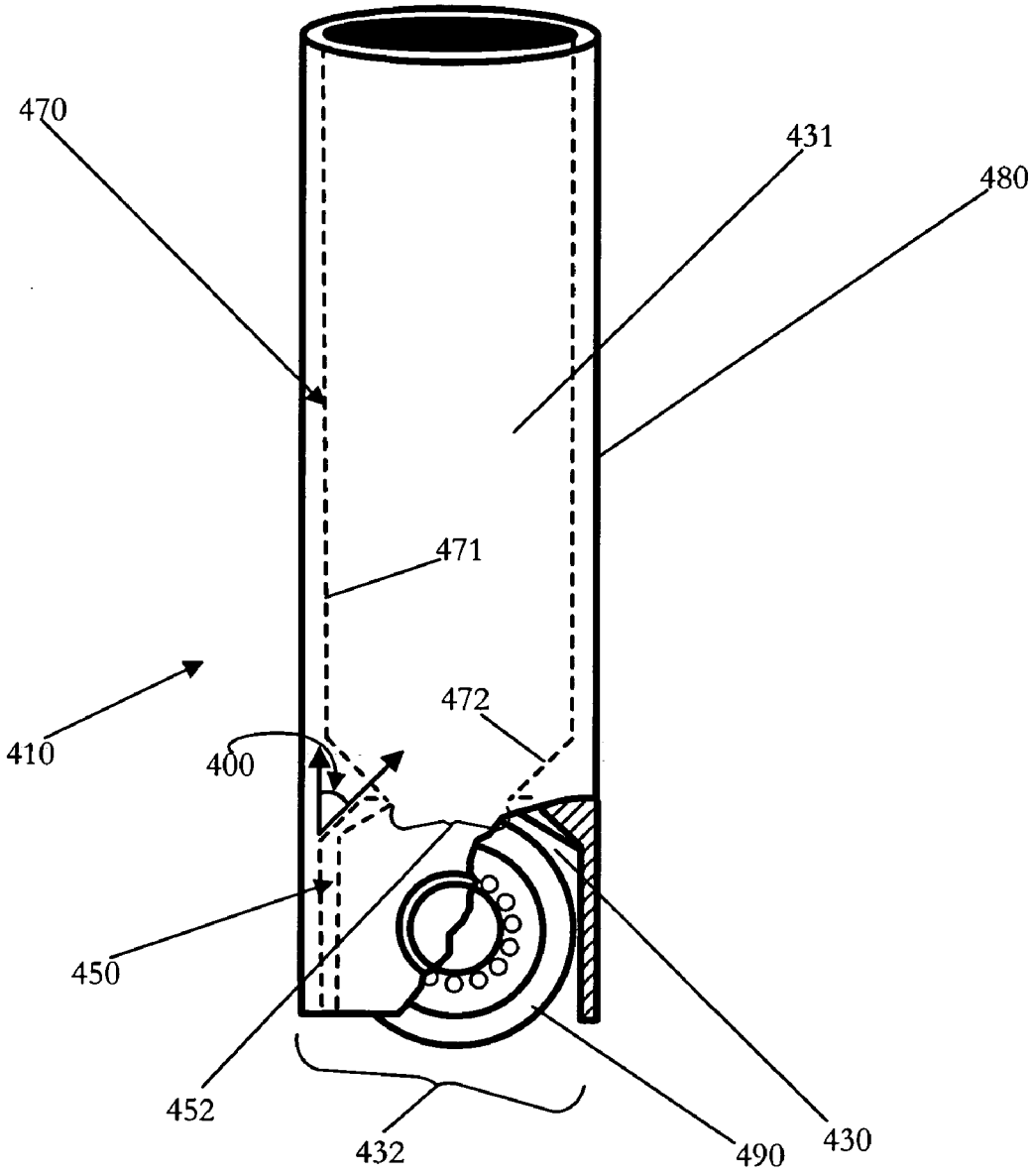
FIG. 61 depicts a fourth embodiment of a roller follower body.

In yet another alternative embodiment of the present invention, as depicted in FIG. 61, the first roller cavity 430 is provided with a first roller opening 432 shaped to accept a cylindrical insert and a first inner roller surface 450. The first inner roller surface 450 defines a transition roller opening 452 linking the first roller cavity 430 with a second roller cavity 431. The second roller cavity 431 is provided with a second inner roller surface 470 which includes a plurality of surfaces. As shown in FIG. 61, the second inner roller surface 470 includes a cylindrical roller surface 471 and a frustoconical roller surface 472.

Figure 62:
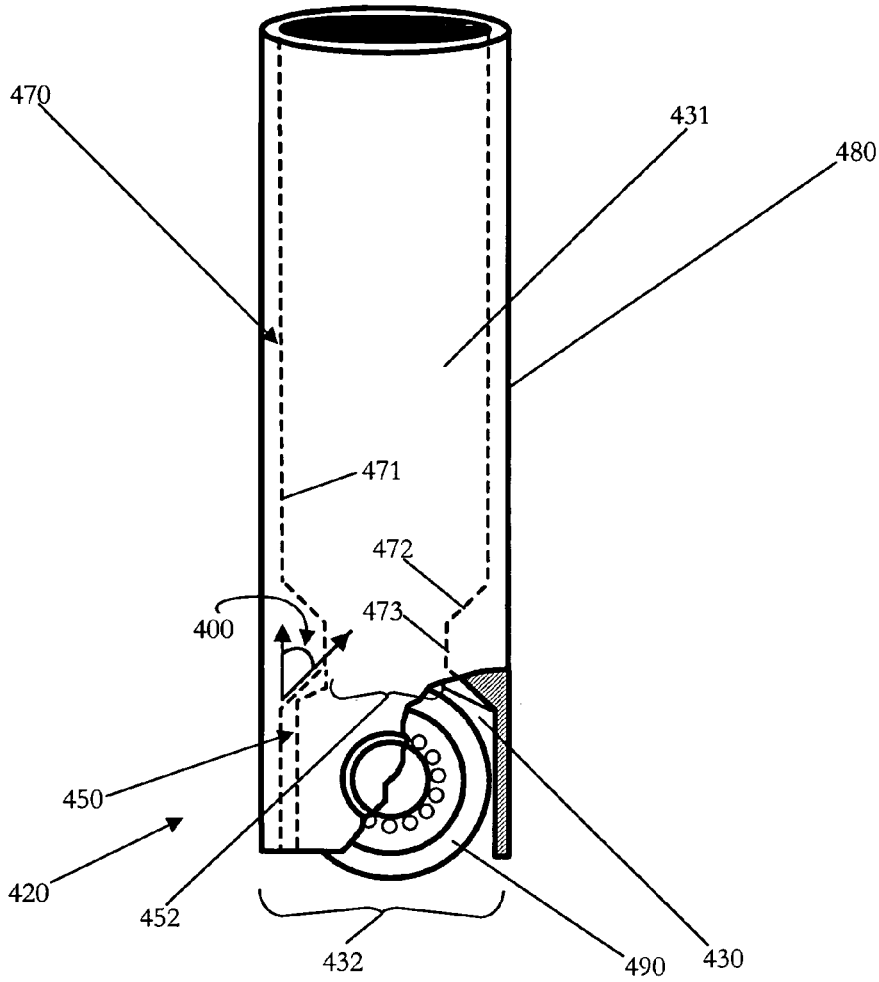
FIG. 62 depicts a fifth embodiment of a roller follower body.

Those skilled in the art will appreciate that the second inner roller surface 470 may include a plurality of cylindrical surfaces. FIG. 62 depicts a second inner roller surface 470 which includes a first cylindrical roller surface 471 adjacent to a frustoconical roller surface 472. Adjacent to the frustoconical roller surface 472 is a second cylindrical roller surface 473. The second cylindrical roller surface 473 depicted in FIG. 62 defines a transition roller opening 452 linking a second roller cavity 431 with a first roller cavity 430. The first roller cavity 430 is provided with a first inner roller surface 450 and a first roller opening 432 shaped to accept a cylindrical insert. The first inner roller surface 450 includes a plurality of curved surfaces, angled surfaces, walls, and angled walls.

Figure 63:
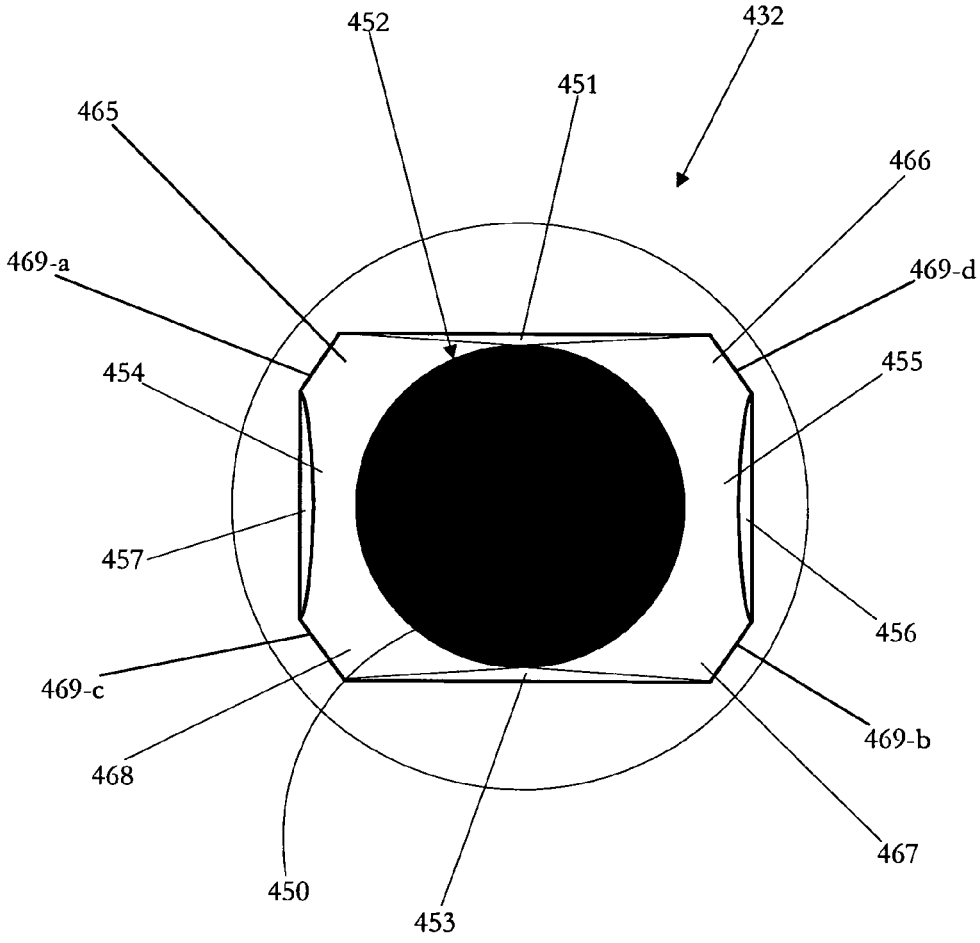
FIG. 63 depicts the top view of another preferred embodiment of a roller follower body.

FIG. 63 depicts a first inner roller surface 450 depicted in FIGS. 61 and 62. A first roller wall 451 is adjacent to the transition roller opening 452, a first angled roller surface 465, and a second angled roller surface 466. The first angled roller surface 465 is adjacent to the transition roller opening 452, a first roller curved surface 454, and a first angled roller wall 469-*a*. As depicted in FIGS. 61 and 62, the first angled roller surface 465 is configured to be at an angle 400 relative to the plane of a first angled roller wall 469-*a*, preferably between sixty-five and about ninety degrees.

The second angled roller surface 466 is adjacent to the transitional roller opening 452 and a fourth angled roller wall 469-*d*. As shown in FIGS. 61 and 62, the second angled roller surface 466 is configured to be at an angle 400 relative to the plane of the second angled roller wall 469-*b*, preferably between sixty-five and about ninety degrees. The second angled roller surface 466 is adjacent to a second curved roller surface 455. The second curved roller surface 455 is adjacent to a third angled roller surface 467 and a third roller wall 456. The third angled roller surface 467 is adjacent to the transitional roller opening 452, a second roller wall 453, and a second angled roller wall 469-*b*. As depicted in FIGS. 61 & 62, the third angled roller surface 467 is configured to be at an angle 400 relative to the plane of the third angled roller wall 469-*c*, preferably between sixty-five and about ninety degrees.

The second roller wall 453 is adjacent to a fourth angled roller surface 468. The fourth angled roller surface 468 adjacent to the first curved roller surface 454, a third angled roller wall 469-*c*, and a fourth roller wall 457. As depicted in FIGS. 61 and 62, the fourth angled roller surface 468 is configured to be at an angle relative to the plane of the fourth angled roller wall 469-*d*, preferably between sixty-five and about ninety degrees. FIGS. 61 and 62 depict cross-sectional views of embodiments with the first roller cavity 430 of FIG. 63.

Figure 64:
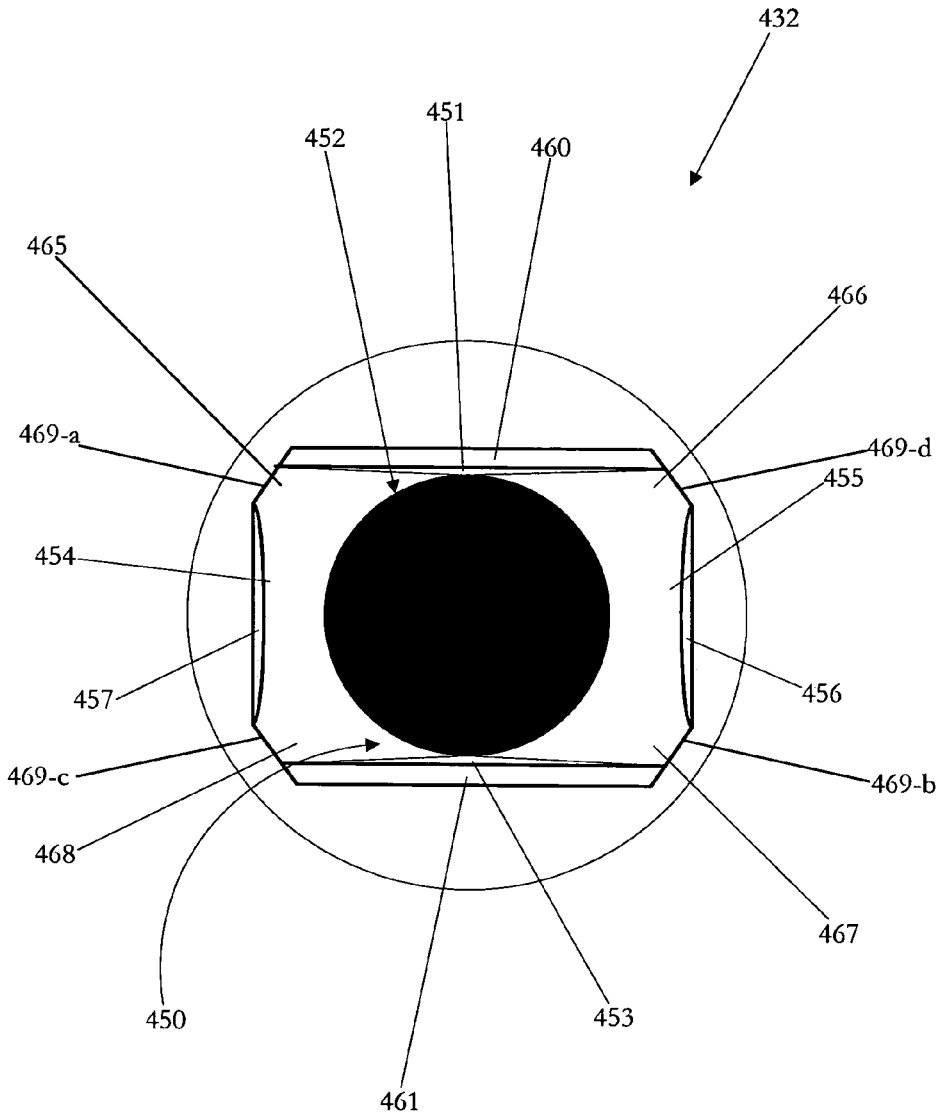
FIG. 64 depicts the top view of another preferred embodiment of a roller follower body.

Shown in FIG. 64 is an alternative embodiment of the first roller cavity 430 depicted in FIG. 63. In the embodiment depicted in FIG. 64, the first roller cavity 430 is provided with a chamfered roller opening 432 and a first inner roller surface 450. The chamfered roller opening 432 functions so that a cylindrical insert can be introduced to the roller follower body 410 with greater ease. The chamfered roller opening 432 accomplishes this function through roller chamfers 460, 461 which are located on opposing sides of the chamfered roller opening 432. The roller chamfers 460, 461 of the embodiment shown in FIG. 64 are flat surfaces at an angle relative to the roller walls 451, 453 so that a cylindrical insert 490 can be introduced through the first roller opening 432 with greater ease. Those skilled in the art will appreciate that the roller chamfers 460, 461 can be fabricated in a number of different configurations; so long as the resulting configuration renders introduction of a cylindrical insert 490 through the first roller opening 432 with greater ease, it is a "chamfered roller opening" within the spirit and scope of the present invention.

The roller chamfers 460, 461 are preferably fabricated through forging via an extruding punch pin. Alternatively, the roller chamfers 460, 461 are machined by being ground before heat-treating. Those skilled in the art will appreciate that other methods of fabrication can be employed within the scope of the present invention.

Figure 65:
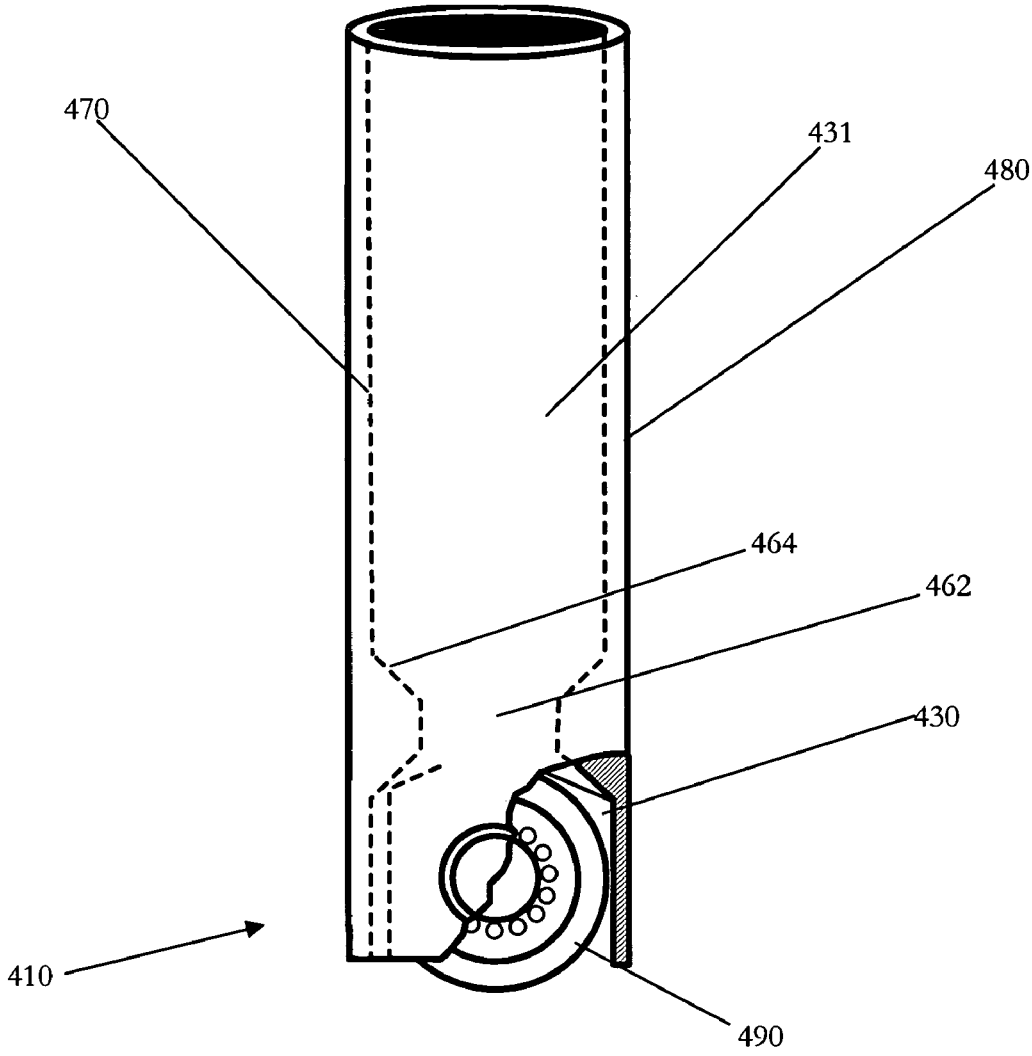
FIG. 65 depicts a sixth embodiment of a roller follower body.
Figure 66:
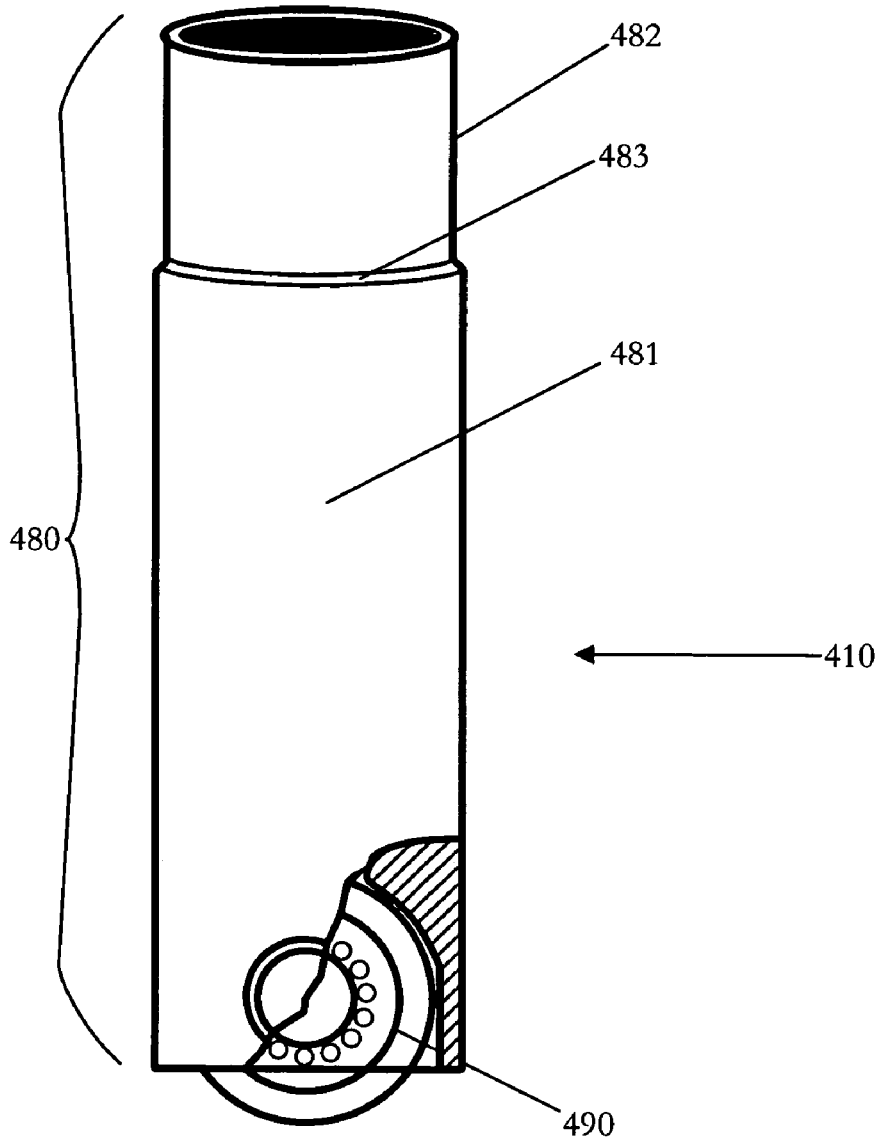
FIG. 66 depicts a seventh embodiment of a roller follower body.
Figure 67:
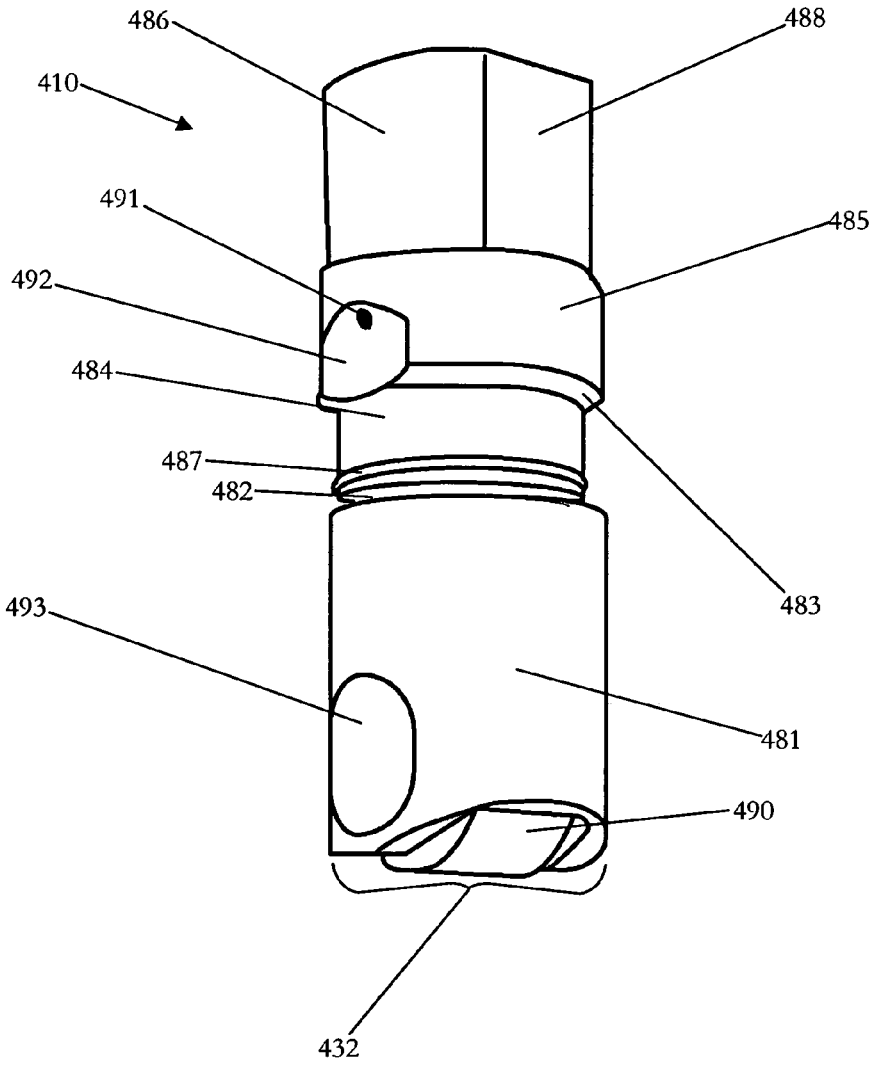
FIG. 67 depicts an eight embodiment of a roller follower body.

FIG. 65 discloses the second roller cavity 431 of yet another alternative embodiment of the present invention. As depicted in FIG. 65, the roller follower body 410 is provided with a second roller cavity 431 which includes a plurality of cylindrical and conical surfaces. The second roller cavity 431 depicted in FIG. 65 includes a second inner roller surface 470. The second inner roller surface 470 of the preferred embodiment is cylindrically shaped, concentric relative to the cylindrically shaped outer roller surface 480. The second inner roller surface 470 is provided with a transitional tube 462. The transitional tube 462 is shaped to fluidly link the second roller cavity 431 with a first roller cavity 430. In the embodiment depicted in FIG. 65, the transitional tube 462 is cylindrically shaped at a diameter that is smaller than the diameter of the second inner roller surface 470. The cylindrical shape of the transitional tube 462 is preferably concentric relative to the outer roller surface 480. The transitional tube 462 is preferably forged through use of an extruding die pin.

Alternatively, the transitional tube 462 is machined by boring the transitional tube 462 in a chucking machine. Alternatively, the transitional tube 462 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the transitional tube 462 is ground using an internal diameter grinding machine, such as a Heald grinding machine. Those skilled in the art will appreciate that the transitional tube 462 can be ground using other grinding machines.

Adjacent to the transitional tube 462, the embodiment depicted in FIG. 64 is provided with a conically-shaped roller lead surface 464 which can be fabricated through forging or machining. However, those skilled in the art will appreciate that the present invention can be fabricated without the roller lead surface 464

Those skilled in the art will appreciate that the features of the roller follower body 410 may be fabricated through a combination of machining, forging, and other methods of fabrication. By way of example and not limitation, the first roller cavity 430 can be machined while the second roller cavity 431 is forged. Conversely, the second roller cavity 431 can be machined while the first roller cavity 430 is forged.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A valve lifter body that is generally cylindrical about an axis and provided with a first end and a second end, comprising:

a) an outer surface that encloses a first cavity and a second cavity;

b) the first end of the valve lifter body includes a first opening shaped to accept a roller;

c) the first cavity includes a first inner surface that is provided with a first wall, a second wall, a third wall, a fourth wall, a first angled wall, a second angled wall, a third angled wall, fourth angled wall, a first curved surface, a second curved surface, and a flat surface;

d) the first wall and the second wall extend axially into the valve lifter body from the first opening and are positioned so that the first wall faces the second wall;

e) the third wall extends axially into the valve lifter body from the first opening and terminates, at least in part, at the second curved surface;

f) the fourth wall extends axially into the valve lifter body from the first opening and terminates, at least in part, at the first curved surface;

g) the third wall and the fourth wall are positioned so that the third wall faces the fourth wall;

h) the first angled wall extends axially into the valve lifter body from the first opening, faces the second angled wall, and is located between the fourth wall and the first wall;

i) the second angled wall extends axially into the valve lifter body from the first opening, faces the first angled wall, and is located between the second wall and the third wall;

j) the third angled wall extends axially into the valve lifter body from the first opening, faces the fourth angled wall, and is located between the second wall and the fourth wall;

k) the fourth angled wall extends axially into the valve lifter body from the first opening, faces the third angled wall, and is located between the first wall and the third wall;

l) the first and second curved surfaces arc, at least in part, located adjacent to the flat surface, which is generally orthogonal to the axis of the valve lifter body;

m) the second end of the valve lifter body includes a second opening;

n) the second cavity extends axially into the valve lifter body from the second opening and includes a second inner surface that is provided with a plurality of cylindrical surfaces and configured to accommodate a socket body and a leakdown plunger; and o) the first cavity is fabricated, at least in part, through cold forming.

2. The valve lifter body according to claim 1 wherein the flat surface is generally circular in shape.

3. The valve lifter body according to claim 1 wherein the first opening has been cold formed to provide a chamfered opening.

4. A valve lifter body that is generally cylindrical about an axis and provided with a first end and a second end, comprising;

a) an outer surface that encloses a first cavity and a second cavity;

b) the first end of the valve lifter body includes a first opening shaped to accept a roller;

c) the first cavity includes a first inner surface that is provided with a first wall, a second wall, a third wall, a fourth wall, a first curved surface, a second curved surface, and a flat surface;

d) the first wall extends axially into the valve lifter body from the first opening, faces the second wall, and terminates, at least in part, at the first curved surface;

e) the second wall extends axially into the valve lifter body from the first opening, faces the first wall, and terminates, at least in part, at the second curved surface;

f) the third wall extends axially into the valve lifter body from the first opening, faces the fourth wall, and terminates, at least in part, at the flat surface;

g) the fourth wall extends axially into the valve lifter body from the first opening, faces the third wall, and terminates, at least in part, at the flat surface;

h) the first curved surface extends from the first wall towards the axis of the valve lifter body and terminates, at least in part, at the flat surface;

i) the second curved surface extends from the second wall towards the axis of the valve lifter body and terminates, at least in part, at the flat surface;

j) the flat surface is generally rectangular in shape and generally orthogonal to the axis of the valve lifter body;

k) the second end of the valve lifter body includes a second opening;

l) the second cavity extends axially into the valve lifter body from the second opening and includes a second inner surface that is provided with a plurality of cylindrical surfaces and configured to accommodate a socket body and a leakdown plunger; and m) the first cavity is fabricated, at least in part, through cold forming.

5. The valve lifter body of claim 4 wherein the second cavity includes a well that is cylindrically shaped and provided with a diameter that is smaller than a diameter of the second inner surface.

6. The valve lifter body of claim 4 wherein:

a) the second cavity includes a well and a lead surface;

b) the lead surface extends from the second inner surface towards the axis of the valve lifter body and terminates, at least in part, at the well; and c) the well is cylindrically shaped and provided with a diameter that is smaller than a diameter of the second inner surface.

7. The valve lifter body of claim 4 wherein:

a) the second cavity includes a well and a lead surface;

b) the lead surface is frusto-conical in shape, extends from the second inner surface towards the axis of the valve lifter body, and terminates, at least in part, at the well; and c) the well is cylindrically shaped and provided with a diameter that is smaller than a diameter of the second inner surface.

8. The valve lifter body of claim 4 wherein:

a) the second cavity includes a well and a lead surface;

b) the lead surface extends from the second inner surface towards the axis of the valve lifter body and terminates, at least in part, at the well; and c) the well is cylindrically shaped, provided wit a diameter that is smaller than a diameter of the second inner surface, and generally concentric relative to the second inner surface.

* * * * *